US008342675B2

(12) United States Patent
Motojima et al.

(10) Patent No.: US 8,342,675 B2
(45) Date of Patent: Jan. 1, 2013

(54) NEWSPAPER PRODUCTION SYSTEM AND PRODUCTION METHOD FOR NEWSPAPER

(75) Inventors: Kazuyuki Motojima, Kanagawa (JP); Taizou Abe, Kanagawa (JP)

(73) Assignee: Tokyo Kikai Seisakusho, Ltd., Tokyo (JP)

( * ) Notice: Subject to any disclaimer, the term of this patent is extended or adjusted under 35 U.S.C. 154(b) by 282 days.

(21) Appl. No.: 12/599,006

(22) PCT Filed: Mar. 26, 2008

(86) PCT No.: PCT/JP2008/056511

§ 371 (c)(1), (2), (4) Date: Apr. 26, 2010

(87) PCT Pub. No.: WO2009/118915

PCT Pub. Date: Oct. 1, 2009

(65) Prior Publication Data

US 2010/0201774 A1 Aug. 12, 2010

(51) Int. Cl.
*B41J 2/01* (2006.01)

(52) U.S. Cl. ..... 347/104; 156/277; 346/25; 347/2; 347/4; 347/47; 347/221; 347/101; 358/1.13

(58) Field of Classification Search ..... None
See application file for complete search history.

(56) References Cited

U.S. PATENT DOCUMENTS 5,001,500 A * 3/1991 Wolfberg et al. ..... 347/118
(Continued)

FOREIGN PATENT DOCUMENTS

JP 09-227021 A 9/1997
(Continued)

OTHER PUBLICATIONS

PCT/JP2008/056511, filed Mar. 26, 2008, Intl. Search Report dated May 20, 2008 (1 page).

*Primary Examiner* — Matthew Luu
*Assistant Examiner* — John P Zimmermann
(74) *Attorney, Agent, or Firm* — Foley & Lardner LLP

(57) ABSTRACT

An object of this invention is to provide a newspaper production system, having the structure of a system that is provided with a supply unit for a continuous web provided at an upstream side of a printing unit for printing on one surface and the other surface of a continuous web, and a processing unit for carrying out cutting and folding processing of a continuous web after printing at a downstream side, by making the area of an installation flat region for the printing unit for printing on one surface and the other surface of a continuous web, having an ink jet printing device group for printing one side of the continuous web and an ink jet printing device group for printing the other side of the paper sheet, small, and with which it is easy for a single person to carry out a newspaper production operation of monitoring the entire system. It is also an object of this invention to provide a newspaper production system and newspaper production method that enables production of a few sizes of a plurality of newspaper pages arranged horizontally as sheets constituting a newspaper by sequentially cutting, and being capable of producing a newspaper formed of various page configurations.

11 Claims, 21 Drawing Sheets

U.S. PATENT DOCUMENTS

| | | | | |
|---|---|---|---|---|
| 5,764,263 | A * | 6/1998 | Lin | 347/101 |
| 6,332,149 | B1 * | 12/2001 | Warmus et al. | 715/246 |
| 6,533,324 | B2 * | 3/2003 | Zorn | 283/56 |
| 6,659,602 | B2 * | 12/2003 | Izawa et al. | 347/102 |
| 6,821,038 | B2 * | 11/2004 | Izawa | 400/621.1 |
| 6,997,539 | B2 * | 2/2006 | Hoisington et al. | 347/25 |
| 7,978,349 | B1 * | 7/2011 | Clupper et al. | 358/1.13 |
| 2009/0027449 | A1 * | 1/2009 | Silva et al. | 347/47 |

FOREIGN PATENT DOCUMENTS

| | | | |
|---|---|---|---|
| JP | 11-072974 | A | 3/1999 |
| JP | 11-320923 | A | 11/1999 |
| JP | 2001-058446 | A | 3/2001 |
| JP | 2003-011452 | A | 1/2003 |
| JP | 2003-341927 | A | 12/2003 |

* cited by examiner (a)

FIG. 7
(a)

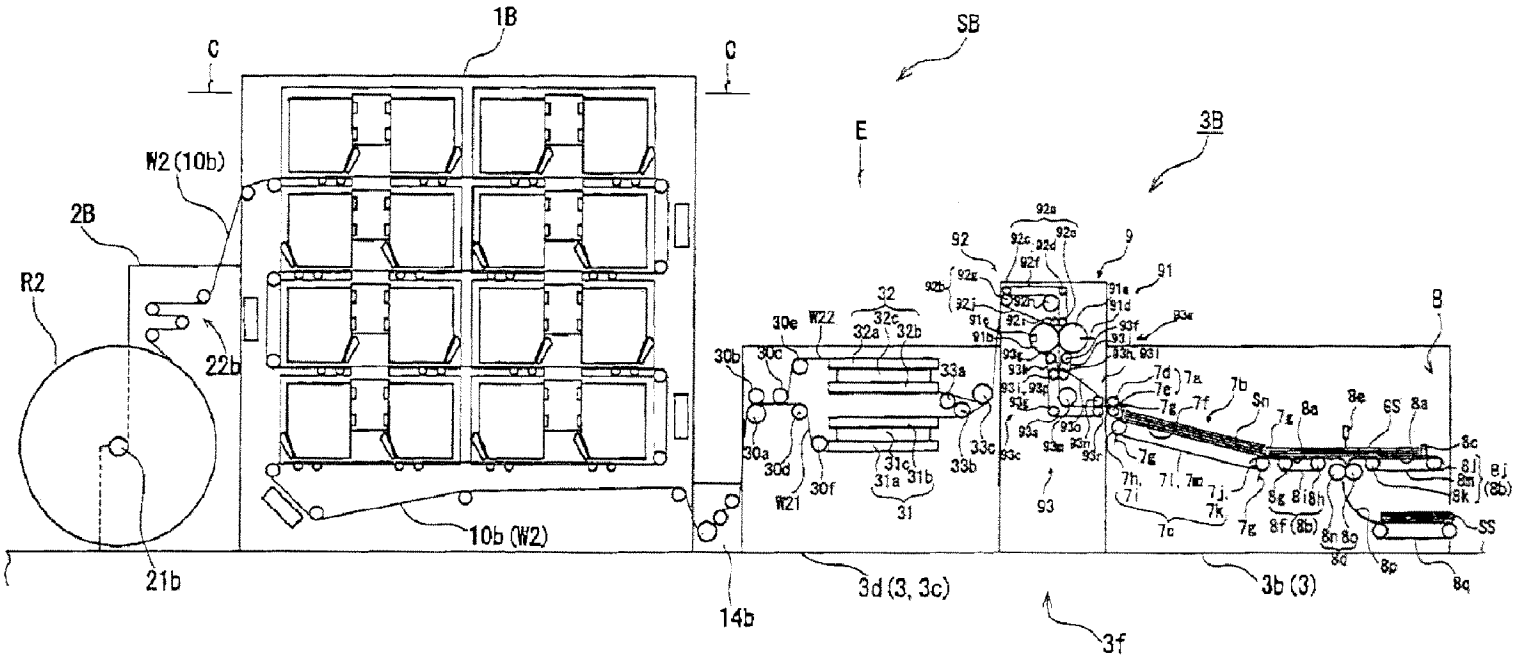
3B
SB
B
E
C
C
1B
2B
R2
W2 (10b)
22b
21b
10b (W2)
14b
3d (3, 3c)
3b (3)
3f
93
92
91
9
32
31
33a
33b
30a
30b
30c
30d
30e
30f
W21
W22
7a
7b
7c
7d
7e
7f
7g
7h
7i
7j
7k
7l
7m
7n
8a
8b
8c
8d
8e
8f
8g
8h
8i
8j
8k
8l
8m
8n
8o
8p
8q
8r
8s
8t
8u
8v
8w
8x
8y
8z
8aa
8ab
8ac
8ad
8ae
8af
8ag
8ah
8ai
8aj
8ak
8al
8am
8an
8ao
8ap
8aq
8ar
8as
8at
8au
8av
8aw
8ax
8ay
8az
8ba
8bb
8bc
8bd
8be
8bf
8bg
8bh
8bi
8bj
8bk
8bl
8bm
8bn
8bo
8bp
8bq
8br
8bs
8bt
8bu
8bv
8bw
8bx
8by
8bz
8ca
8cb
8cc
8cd
8ce
8cf
8cg
8ch
8ci
8cj
8ck
8cl
8cm
8cn
8co
8cp
8cq
8cr
8cs
8ct
8cu
8cv
8cw
8cx
8cy
8cz
8da
8db
8dc
8dd
8de
8df
8dg
8dh
8di
8dj
8dk
8dl
8dm
8dn
8do
8dp
8dq
8dr
8ds
8dt
8du
8dv
8dw
8dx
8dy
8dz
8ea
8eb
8ec
8ed
8ee
8ef
8eg
8eh
8ei
8ej
8ek
8el
8em
8en
8eo
8ep
8eq
8er
8es
8et
8eu
8ev
8ew
8ex
8ey
8ez
8fa
8fb
8fc
8fd
8fe
8ff
8fg
8fh
8fi
8fj
8fk
8fl
8fm
8fn
8fo
8fp
8fq
8fr
8fs
8ft
8fu
8fv
8fw
8fx
8fy
8fz
8ga
8gb
8gc
8gd
8ge
8gf
8gg
8gh
8gi
8gj
8gk
8gl
8gm
8gn
8go
8gp
8gq
8gr
8gs
8gt
8gu
8gv
8gw
8gx
8gy
8gz
8ha
8hb
8hc
8hd
8he
8hf
8hg
8hh
8hi
8hj
8hk
8hl
8hm
8hn
8ho
8hp
8hq
8hr
8hs
8ht
8hu
8hv
8hw
8hx
8hy
8hz
8ia
8ib
8ic
8id
8ie
8if
8ig
8ih
8ii
8ij
8ik
8il
8im
8in
8io
8ip
8iq
8ir
8is
8it
8iu
8iv
8iw
8ix
8iy
8iz
8ja
8jb
8jc
8jd
8je
8jf
8jg
8jh
8ji
8jj
8jk
8jl
8jm
8jn
8jo
8jp
8jq
8jr
8js
8jt
8ju
8jv
8jw
8jx
8jy
8jz
8ka
8kb
8kc
8kd
8ke
8kf
8kg
8kh
8ki
8kj
8kk
8kl
8km
8kn
8ko
8kp
8kq
8kr
8ks
8kt
8ku
8kv
8kw
8kx
8ky
8kz
8la
8lb
8lc
8ld
8le
8lf
8lg
8lh
8li
8lj
8lk
8ll
8lm
8ln
8lo
8lp
8lq
8lr
8ls
8lt
8lu
8lv
8lw
8lx
8ly
8lz
8ma
8mb
8mc
8md
8me
8mf
8mg
8mh
8mi
8mj
8mk
8ml
8mm
8mn
8mo
8mp
8mq
8mr
8ms
8mt
8mu
8mv
8mw
8mx
8my
8mz
8na
8nb
8nc
8nd
8ne
8nf
8ng
8nh
8ni
8nj
8nk
8nl
8nm
8nn
8no
8np
8nq
8nr
8ns
8nt
8nu
8nv
8nw
8nx
8ny
8nz
8oa
8ob
8oc
8od
8oe
8of
8og
8oh
8oi
8oj
8ok
8ol
8om
8on
8oo
8op
8oq
8or
8os
8ot
8ou
8ov
8ow
8ox
8oy
8oz
8pa
8pb
8pc
8pd
8pe
8pf
8pg
8ph
8pi
8pj
8pk
8pl
8pm
8pn
8po
8pp
8pq
8pr
8ps
8pt
8pu
8pv
8pw
8px
8py
8pz
8qa
8qb
8qc
8qd
8qe
8qf
8qg
8qh
8qi
8qj
8qk
8ql
8qm
8qn
8qo
8qp
8qq
8qr
8qs
8qt
8qu
8qv
8qw
8qx
8qy
8qz
8ra
8rb
8rc
8rd
8re
8rf
8rg
8rh
8ri
8rj
8rk
8rl
8rm
8rn
8ro
8rp
8rq
8rr
8rs
8rt
8ru
8rv
8rw
8rx
8ry
8rz
8sa
8sb
8sc
8sd
8se
8sf
8sg
8sh
8si
8sj
8sk
8sl
8sm
8sn
8so
8sp
8sq
8sr
8ss
8st
8su
8sv
8sw
8sx
8sy
8sz
8ta
8tb
8tc
8td
8te
8tf
8tg
8th
8ti
8tj
8tk
8tl
8tm
8tn
8to
8tp
8tq
8tr
8ts
8tt
8tu
8tv
8tw
8tx
8ty
8tz
8ua
8ub
8uc
8ud
8ue
8uf
8ug
8uh
8ui
8uj
8uk
8ul
8um
8un
8uo
8up
8uq
8ur
8us
8ut
8uu
8uv
8uw
8ux
8uy
8uz
8va
8vb
8vc
8vd
8ve
8vf
8vg
8vh
8vi
8vj
8vk
8vl
8vm
8vn
8vo
8vp
8vq
8vr
8vs
8vt
8vu
8vv
8vw
8vx
8vy
8vz
8wa
8wb
8wc
8wd
8we
8wf
8wg
8wh
8wi
8wj
8wk
8wl
8wm
8wn
8wo
8wp
8wq
8wr
8ws
8wt
8wu
8wv
8ww
8wx
8wy
8wz
8xa
8xb
8xc
8xd
8xe
8xf
8xg
8xh
8xi
8xj
8xk
8xl
8xm
8xn
8xo
8xp
8xq
8xr
8xs
8xt
8xu
8xv
8xw
8xx
8xy
8xz
8ya
8yb
8yc
8yd
8ye
8yf
8yg
8yh
8yi
8yj
8yk
8yl
8ym
8yn
8yo
8yp
8yq
8yr
8ys
8yt
8yu
8yv
8yw
8yx
8yy
8yz
8za
8zb
8zc
8zd
8ze
8zf
8zg
8zh
8zi
8zj
8zk
8zl
8zm
8zn
8zo
8zp
8zq
8zr
8zs
8zt
8zu
8zv
8zw
8zx
8zy
8zz
9a
9b
9c
9d
9e
9f
9g
9h
9i
9j
9k
9l
9m
9n
9o
9p
9q
9r
9s
9t
9u
9v
9w
9x
9y
9z
10a
10b
10c
10d
10e
10f
10g
10h
10i
10j
10k
10l
10m
10n
10o
10p
10q
10r
10s
10t
10u
10v
10w
10x
10y
10z
11a
11b
11c
11d
11e
11f
11g
11h
11i
11j
11k
11l
11m
11n
11o
11p
11q
11r
11s
11t
11u
11v
11w
11x
11y
11z (b)

(a)

(b)

(b)

(a)

(d)

(c)

NEWSPAPER PRODUCTION SYSTEM AND PRODUCTION METHOD FOR NEWSPAPER

TECHNICAL FIELD

The present invention relates to a newspaper production system provided with an ink jet printing unit for performing ink jet printing on one surface and the other surface of a continuous web, and to a production method for newspapers using the newspaper production system.

BACKGROUND ART

A printing unit for printing on one surface and the other surface of a continuous web using ink jet printing devices is disclosed in Japanese Unexamined Patent Publication No. He. 11-320923 (related art 1), Japanese Unexamined Patent Publication No. 2001-58446 (related art 2) and Japanese Unexamined Patent Publication No. 2003-11452 (related art 3). A production method for newspapers using a digital printing device including an ink jet printing unit is disclosed in Japanese Unexamined Patent Publication No. 2003-341927 (related art 4).

The printing unit for printing on one surface and the other surface of a continuous web disclosed in related art 1 and related art 2 has an ink jet printing unit with an ink jet print head arranged so that ink jets are formed in a cross direction of the continuous web. Specifically, the ink jet printing units (a number of the units is equal to the number of inks used in printing on one side of the continuous web) are arranged at regular intervals in the length direction of the continuous web. Next to this arrangement, other ink jet printing units (a number of the units is equal to the number of inks used in printing the other side of the continuous web) are arranged at regular intervals in the length direction of the continuous web. A continuous web reverse travel mechanism is provided so that a continuous web, that has been guided below an ink jet printing unit for printing one side, is fed above the ink jet printing unit for printing the other side. And then, after it has passed the ink jet printing unit for printing the other side, the guiding direction is reversed. The surface of the continuous web has been turned upside down as a result of this reversing. The continuous web is guided below the ink jet printing unit for printing the other surface. Accordingly, a continuous web is first guided below an ink jet printing unit for printing one side, and that one side is printed, then the continuous web is reversed by the continuous web reverse travel mechanism, and in the turned over state is guided below the ink jet printing unit for printing the other side, and the other side is printed, and after that the travel direction is reversed again and the continuous web is guided outside the continuous web double sided printing unit.

The printing unit for printing on one surface and the other surface of a continuous web of related art 3 is provided with a turn bar for changing the travel direction of a continuous web traveling substantially horizontally through 90 degrees, and also turning over the continuous web and causing it to travel substantially horizontally. The printing unit is provided with ink jet printing units for printing one side of the continuous web being arranged at regular intervals in the travel direction, above the traveling path of the continuous web facing the turn bar. The printing unit is also provided with other ink jet print units for printing the other side of the continuous web being arranged at regular intervals in the travel direction above the traveling path of the continuous web that has passed the turn bar. Accordingly, the continuous web is first made to travel along the travel route of the continuous web facing the turn bar, to print one side, then the continuous web is reversed by the turn bat and in the turned over state made to travel the traveling path of the continuous web that passed through the turn bar to print the other side.

Also, the newspaper manufacturing method of related art 4 is a method in which a plurality of lateral printed rows, having different printing content for each printing line, the lateral printed rows having at least two printed surfaces corresponding to each other on either side of a continuous web in a cross direction of the continuous web, are handled as one print cycle, are repeatedly printed on both sides of the continuous web in a printing direction using a digital printing device, a cut is made for every double sided double spread, and for each lateral printed row, setting is performed for each printing cycle, and for each setting a double spread is folded to produce newspapers of a number of pages corresponding to the number of printing cycles.

In related art 4, as a system for executing the newspaper manufacturing method, a mechanism is disclosed in which a continuous web is supplied from an upstream side of the digital printing device, the continuous web is cut to a specified size at a downstream side of the digital printing device, and the cut sheets are stacked to a specified number and folded.

As disclosed in related art 3, in the current technology it is a precondition for an ink jet print head for printing a continuous web that the ink discharge ports face downwards, and a continuous web that is to be printed on must have a printing surface facing upwards, and be guided underneath the ink jet print head.

However, the related arts the above description have the following problems.

Specifically, the printing unit for printing on one surface and the other surface of a continuous web as disclosed in related art 1 and related art 2 has an ink jet printing unit group for printing one side and an ink jet printing unit group for printing the other side aligned on a substantially horizontal plane and in the same direction, and arranged spaced apart from each other at regular intervals. This gives a printing unit for printing on one surface and the other surface of a continuous web that is long in the arrangement direction, and necessitates a long flat region for installation. Also, the printing unit for printing on one surface and the other surface of a continuous web generally has a supply unit for the continuous web provided at an upstream side and a processing unit for appropriately processing the continuous web after printing arranged at a downstream side, and is used as a ink jet printing system for a continuous web, to carry out printing and post printing processing in a consistent manner, but with such a ink jet printing system for a continuous web the overall length of the system becomes longer, and when a single person carries out continuous operation of monitoring the overall system they must stay alert and must never be absent.

The printing unit for printing on one surface and the other surface of a continuous web disclosed in related art 3 has an ink jet printing unit group for printing one side and an ink jet printing unit group for printing the other side arranged on a substantially horizontal plane but with row directions differing by 90 degrees, and spaced apart at regular intervals, with a turn bar provided between the two ink jet printing unit groups in a state inclined by 45 degrees with respect to the row direction of the ink jet print unit group for printing on the one side, and a continuous web that has passed through the ink jet printing unit group for printing the one side traveling substantially horizontally and been printed on the one side is rotated through 180 degrees on the peripheral surface of the turn bar so as to be turned upside down, and the substantially horizontal traveling direction is changed by 90 degrees to guide the continuous web to the ink jet printing unit group for printing the other side, and the other side is printed. Therefore, the length in one direction is shorter than the printing unit for printing on one surface and the other surface of a continuous web disclosed in related art 1 and related art 2, but is not really that different in total length, and since the ink jet printing unit group for printing one side and the ink jet printing unit group for printing the other side are arranged with arrangement directions 90 degrees different from each other it requires a rectangular flat installation region that is wider than the installation region for the printing unit for printing on one surface and the other surface of a continuous web disclosed in related art 1 and related art 2, where lengths in which at least a group of ink jet printing devices are arranged are taken as two adjacent sides.

Also, the printing unit for printing on one surface and the other surface of a continuous web, similarly to the printing unit for printing on one surface and the other surface of a continuous web disclosed in related art 1 and related art 2, generally has a feed unit for the continuous web and a processing unit for suitably processing the continuous web after printing arranged at an upstream side and a downstream side respectively, and is used as an ink jet printing system for a continuous web for carrying out printing and post printing processing in a consistent fashion. However, with this type of ink jet printing system for a continuous web, it is necessary for a rectangular flat installation space for installation of the entire system to be wider, and when a single person carrying out continuous operations to monitor the overall system they must stay alert and be constantly present.

On the other hand, the newspaper manufacturing method of related art 4 is a method in which a plurality of lateral printed rows, each having different print content, and with each row having at least two printed segments corresponding to each other on both sides of a continuous web in a cross direction of the continuous web, are handled as one print cycle, with repeated printing in a printing direction, a cut is made for every lateral printed row and for every double sided double spread, setting is performed for each printing cycle, and for each setting a double spread is folded to manufacture newspapers of a number of pages corresponding to the number of printing cycles.

Therefore, when a digital printing device has an ink jet printing unit, in printing newspapers of a blanket size (broadsheet), the fact that printing is possible for an advertisement page spanning two whole adjacent newspaper pages, which has recently become common, means it is necessary for the ink jet print heads to be small, and to have a width enabling printing of two newspaper pages that are next to each other in a cross direction, that is, a width in excess 800 mm, but operating such a wide in jet print head with good precision is extremely difficult, and inevitable leads to high costs. Also, printing an advertisement page spanning the whole of two adjacent pages of a newspaper with two ink jet print heads each capable of printing one page of a newspaper is not inconceivable, but installing the ink jet print head to be aligned with good precision, so that there are no streaks remaining such as portions where printing does not occur at the boundaries of printing image using double sided ink jet print heads, or portions where printing has overlapped, is extremely difficult. In addition, in any event maintenance is not simple, and the burden placed on an operator increases with the size of the system or with precision becoming more important. Also, a cut is made for each sideways print line, and for each double spread, which means that also in cases where two or more pages are printed on a continuous web of large paper width, it is difficult to make cuts changing the number of pages arranged for each sideways printing row, it is not possible to obtain a paper space of a single page size, or a large page space where three pages or more are arranged sideways such as in what is called a desired panorama page which there has recently been a demand for, and it is not possible to produce newspapers having a page form with variable folding.

DISCLOSURE OF THE INVENTION

An object of this invention is to provide a newspaper production system, having the structure of a system that is provided with a supply unit for a continuous web provided at an upstream side of a printing unit for printing on one surface and the other surface of a continuous web, and a processing unit for carrying out cutting and folding processing of a continuous web after printing at a downstream side, by making the area of an installation flat region for the printing unit for printing on one surface and the other surface of a continuous web, having an ink jet printing unit group for printing one side of the paper sheet and an ink jet printing unit group for printing the other side of the paper sheet, small, and with which it is easy for a single person to carry out a newspaper production operation of monitoring the entire system. It is also an object of this invention to provide a newspaper production system and newspaper production method that enable continuous cut production of a few sizes of a plurality of newspaper pages arranged horizontally as sheets constituting a newspaper, and being capable of producing a newspaper formed of various page configurations.

This invention is a newspaper production system including, an ink jet printing unit having ink jet printing devices, each having an ink jet printing head, provided at a plurality of levels in a vertical direction, and capable of printing on the one surface and the other surface of the continuous web, a continuous web supply unit provided at an upstream side of the ink jet printing unit capable of printing on the one surface and the other surface of the continuous web and capable of supplying the continuous web from a continuous web roll to the ink jet printing unit capable of printing on the one surface and the other surface of the continuous web, at least one processing unit provided at a downstream side of the ink jet printing unit capable of printing on the one surface and the other surface of the continuous web, having a cutting mechanism and a folding mechanism, capable of cutting the continuous web that has been printed by the ink jet printing unit capable of printing on the one surface and the other surface to a predetermined size, and capable of folding the cut sheets, and, control member for controlling to cause the continuous web to travel from the continuous web supply unit, via the ink jet printing unit capable of printing on the one surface and the other surface of the continuous web, to the processing unit, and controlling to correlate printing of each page of the newspaper by the ink jet printing unit capable of printing on the one surface and the other surface of the continuous web, in accordance with a travel speed of the continuous web, and the cutting and folding by the processing unit, wherein the control member causes the ink jet printing unit capable of printing on the one surface and the other surface of the continuous web to align printing positions of each page of the newspaper on the one surface and the other surface of the continuous web such that a height direction of the newspaper is placed parallel to a cross direction of the continuous web, and while considering a predetermined number of pages constituting one part of a newspaper as one set, to arrange the pages of a newspaper next to each other in a running direction of the continuous web to repetitively print for every set, and causes the processing unit to cut the continuous web that has been printed by the ink jet printing unit capable of printing on the one surface and the other surface of the continuous web to form a rectangular cut sheet having a size of a number of pages, being a natural number, printed side by side, in which the same number of pages, being the natural number, are printed on the one surface and the other surface of the rectangular cut sheet and a length of one set of two parallel sides is equal to a height direction length of the newspaper, then to fold the cut sheets having a size of three or more pages of a newspaper printed side by side, among the rectangular cut sheets, to a size that is, at largest, that of two pages of a newspaper printed side by side, then to stack each of the cut sheets in a number constituting one part of a newspaper to thereby form a bundle of cut sheets for every one part of the newspaper, and to fold the bundle of cut sheets for every one part of the newspaper to thereby form a signature newspaper.

Also, the control member of the newspaper production system of this invention carries out control to cause the processing unit to cut the continuous web that has been printed by the ink jet printing unit capable of printing on the one surface and the other surface of the continuous web to form a rectangular cut sheet having a size of two pages of a newspaper printed side by side, in which two pages of a newspaper are printed side by side on the one surface and the other surface of the rectangular cut sheet and a length of one set of two parallel sides is equal to the height direction length of the newspaper, to stack the cut sheets having a size of two pages of a newspaper printed side by side in a number constituting one part of a newspaper to thereby form a bundle of cut sheets for every one part of the newspaper, and to fold the bundle of cut sheets for every one part of the newspaper to thereby form a signature newspaper.

Further, the control member of the newspaper production system of this invention carries out control to cause the processing unit to cut the continuous web that has been printed by the ink jet printing unit capable of printing on the one surface and the other surface of the continuous web to form a rectangular cut sheet having a size of two pages of a newspaper printed side by side, in which two pages of a newspaper are printed side by side on the one surface and the other surface of the rectangular cut sheet and a length of one set of two parallel sides is equal to the height direction length of the newspaper, to form rectangular cut sheets having a size of one printed page of a newspaper for every formation of a predetermined number of cut sheets having a size of one page of a newspaper printed, in which one page of a newspaper is printed on the one surface and the other surface of the rectangular cut sheet and a length of one set of two parallel sides is equal to the height direction length of the newspaper, to stack the cut sheets having a size of two pages printed side by side and the cut sheets having a size of one printed page of a newspaper in a number constituting one part of the newspaper such that the cut sheets having a size of one printed page of a newspaper overlap on one of the pages printed on the cut sheets having a size of two pages printed side by side to thereby form a bundle of cut sheets for every one part of the newspaper, and to fold the bundle of cut sheets for every one part of the newspaper to thereby form a signature newspaper.

Also, the control member of the newspaper production system of this invention causes the processing unit to cut the continuous web that has been printed by the ink jet printing unit capable of printing on the one surface and the other surface of the continuous web to form a rectangular cut sheet having a size of two pages of a newspaper printed side by side, in which two pages of a newspaper are printed side by side on the one surface and the other surface of the rectangular cut sheet and a length of one set of two parallel sides is equal to the height direction length of the newspaper, to form, for every formation of a predetermined number of cut sheets having a size of two pages of a newspaper printed side by side, rectangular cut sheets having a size of three pages of a newspaper printed side by side, in which three pages of a newspaper are printed side by side on the one surface and the other surface of the rectangular cut sheet and a length of one set of two parallel sides is equal to the height direction length of the newspaper, or rectangular cut sheets having a size of four pages of a newspaper printed side by side, in which four pages of a newspaper are printed side by side on the one surface and the other surface of the rectangular cut sheet and a length of one set of two parallel sides is equal to the height direction length of the newspaper, to make the rectangular cut sheets having a size of three pages of a newspaper printed side by side to the same size as that of the cut sheet having a size of two pages of a newspaper printed side by side by folding either one of the side pages thereof to overlap on the middle pages thereof, to make the rectangular cut sheets having a size of four pages of a newspaper printed side by side to the same size as that of the cut sheets having a size of two pages of a newspaper printed side by side by folding the respective side pages thereof to overlap on respective adjacent pages thereof, and to stack, in a number constituting one part of the newspaper, the cut sheets having a size of two pages of a newspaper printed side by side, the cut sheets having a size of three pages of a newspaper printed side by side and folded to the same size as that of the cut sheets having a size of two pages of a newspaper printed side by side, and the cut sheets having a size of four pages of a newspaper printed side by side and folded to the same size as that of the cut sheets having a size of two pages of a newspaper printed side by side, to thereby form a bundle of cut sheets for every one part of the newspaper, and to fold the bundle of cut sheets for every one part of the newspaper to thereby form a signature newspaper.

Still further, the control member of the newspaper production system of this invention causes the processing unit to cut the continuous web that has been printed by the ink jet printing unit capable of printing on the one surface and the other surface of the continuous web to form a rectangular cut sheet having a size of two pages of a newspaper printed side by side, in which two pages of a newspaper are printed side by side on the one surface and the other surface of the rectangular cut sheet and a length of one set of two parallel sides is equal to the height direction length of the newspaper, to form, for every formation of a predetermined number of cut sheets having a size of two pages of a newspaper printed side by side, rectangular cut sheets having a size of one printed page of a newspaper, in which one page of a newspaper is printed on the one surface and the other surface of the rectangular cut sheet and a length of one set of two parallel sides is equal to the height direction length of the newspaper, cut sheets having a size of three pages of a newspaper printed side by side, in which three pages of a newspaper are printed side by side on the one surface and the other surface of the rectangular cut sheet and a length of one set of two parallel sides is equal to the height direction length of the newspaper, or rectangular cut sheets having a size of four pages of a newspaper printed side by side, in which four pages of a newspaper are printed side by side on the one surface and the other surface of the rectangular cut sheet and a length of one set of two parallel sides is equal to the height direction length of the newspaper, to make the rectangular cut sheets having a size of three pages of a newspaper printed side by side the same size as that of the cut sheet having a size of two pages of a newspaper printed side by side by folding either one of the side pages thereof to overlap on the middle pages thereof, to make the rectangular cut sheets having a size of four pages of a newspaper printed side by side the same size as that of the cut sheets having a size of two pages of a newspaper printed side by side by folding the respective side pages thereof to overlap on respective adjacent pages thereof, and to stack, in a number constituting one part of the newspaper, the cut sheets having a size of two pages of a newspaper printed side by side, the cut sheets having a size of one page of the newspaper printed, the cut sheets having a size of three pages of a newspaper printed side by side and folded to the same size as that of the cut sheets having a size of two pages of a newspaper printed side by side, and the cut sheets having a size of four pages of a newspaper printed side by side and folded to the size as that of a size of two pages of a newspaper printed side by side such that the cut sheets having a size of one printed page of the newspaper overlap on one of the pages printed on the cut sheets having a size of two pages printed side by side to thereby form a bundle of cut sheets for every one part of the newspaper, and to fold the bundle of cut sheets for every one part of the newspaper to thereby form a signature newspaper.

Also, this invention is a production method for newspapers, for producing newspapers, using an ink jet printing unit having ink jet printing devices, each having an ink jet printing head, provided at a plurality of levels in a vertical direction, and capable of printing on the one surface and the other surface of the continuous web; a continuous web supply unit provided at an upstream side of the ink jet printing unit capable of printing on the one surface and the other surface of the continuous web and capable of supplying the continuous web from a continuous web roller to the ink jet printing unit capable of printing on the one surface and the other surface of the continuous web; at least one processing unit provided at a downstream side of the ink jet printing unit capable of printing on the one surface and the other surface of the continuous web, having a cutting mechanism and a folding mechanism, capable of cutting the continuous web that has been printed by the ink jet printing unit capable of printing on the one surface and the other surface to a predetermined size, and capable of folding the cut sheets; and control member for controlling to cause the continuous web to travel from the continuous web supply unit, via the ink jet printing unit capable of printing on the one surface and the other surface of the continuous web, to the processing unit, and controlling to correlate printing of each page of the newspaper by the ink jet printing unit capable of printing on the one surface and the other surface of the continuous web, in accordance with a travel speed of the continuous web, and the cutting and folding by the processing unit, comprising: a newspaper sheet printing step of printing on the one surface and the other surface of the continuous web to align printing positions of each page of the newspaper on the one surface and the other surface of the continuous web such that a height direction of the newspaper is placed parallel to a cross direction of the continuous web, and while considering a predetermined number of pages constituting one part of a newspaper as one set, to arrange the pages of a newspaper next to each other in a running direction of the continuous web to repetitively print for every set, a newspaper sheet cutting step of cutting the continuous web that has been printed by the ink jet printing unit capable of printing on the one surface and the other surface of the continuous web to form a rectangular cut sheet having a size of a number of pages, being a natural number, printed side by side, in which the same number of pages, being the natural number, are printed on the one surface and the other surface of the rectangular cut sheet and a length of one set of two parallel sides is equal to a height direction length of the newspaper, a first folding step of folding the cut sheets having a size of three or more pages of a newspaper printed side by side, among the rectangular cut sheets, to a size that is, at largest, that of two pages of a newspaper printed side by side, a newspaper sheet stacking step of stacking each of the cut sheets in a number constituting one part of a newspaper to thereby form a bundle of cut sheets for every one part of the newspaper, and a second folding step of folding the bundle of cut sheets for every one part of the newspaper to thereby form a signature newspaper.

Also the newspaper sheet cutting step of the newspaper production method of this invention is a step of cutting the continuous web that has been printed by the ink jet printing unit capable of printing on the one surface and the other surface of the continuous web to form a rectangular cut sheet having a size of two pages of a newspaper printed side by side, in which two pages of a newspaper are printed side by side on the one surface and the other surface of the rectangular cut sheet and a length of one set of two parallel sides is equal to the height direction length of the newspaper, the newspaper sheet stacking step is a step of stacking the cut sheets having a size of two pages of a newspaper printed side by side in a number constituting one part of a newspaper to thereby form a bundle of cut sheets for every one part of the newspaper, and the second folding step is a step of folding the bundle of cut sheets for every one part of the newspaper to thereby form a signature newspaper.

Further the newspaper sheet cutting step of the newspaper production method of the present invention is a step of cutting the continuous web that has been printed by the ink jet printing unit capable of printing on the one surface and the other surface of the continuous web to form a rectangular cut sheet having a size of two pages of a newspaper printed side by side, in which two pages of a newspaper are printed side by side on the one surface and the other surface of the rectangular cut sheet and a length of one set of two parallel sides is equal to the height direction length of the newspaper, and forming rectangular cut sheets having a size of one printed page of a newspaper for every formation of a predetermined number of cut sheets having a size of two pages of a newspaper printed side by side, in which one page of a newspaper is printed on the one surface and the other surface of the rectangular cut sheet and a length of one set of two parallel sides is equal to the height direction length of the newspaper, the newspaper sheet stacking step is a step of stacking the cut sheets having a size of two pages printed side by side and the cut sheets having a size of one printed page of a newspaper in a number constituting one part of the newspaper such that the cut sheets having a size of one printed page of a newspaper overlap on one of the pages printed on the cut sheets having a size of two pages printed side by side to thereby form a bundle of cut sheets for every one part of the newspaper, and the second folding step is a step of folding the bundle of cut sheets for every one part of the newspaper to thereby form a signature newspaper.

Also the newspaper sheet cutting step of the newspaper production method of the present invention is a step of cutting the continuous web that has been printed by the ink jet printing unit capable of printing on the one surface and the other surface of the continuous web to form a rectangular cut sheet having a size of two pages of a newspaper printed side by side, in which two pages of a newspaper are printed side by side on the one surface and the other surface of the rectangular cut sheet and a length of one set of two parallel sides is equal to the height direction length of the newspaper, and forming, for every formation of a predetermined number of cut sheets having a size of two pages of a newspaper printed side by side, rectangular cut sheets having a size of three pages of a newspaper printed side by side, in which three pages of a newspaper are printed side by side on the one surface and the other surface of the rectangular cut sheet and a length of one set of two parallel sides is equal to the height direction length of the newspaper, or rectangular cut sheets having a size of four pages of a newspaper printed side by side, in which four pages of a newspaper are printed side by side on the one surface and the other surface of the rectangular cut sheet and a length of one set of two parallel sides is equal to the height direction length of the newspaper, the first folding step is a step of to make the rectangular cut sheets having a size of three pages of a newspaper printed side by side to the same size as that of the cut sheet having a size of two pages of a newspaper printed side by side by folding either one of the side pages thereof to overlap on the middle pages thereof, so as to make the rectangular cut sheets having a size of four pages of a newspaper printed side by side to the same size as that of the cut sheets having a size of two pages of a newspaper printed side by side by folding the respective side pages thereof to overlap on respective adjacent pages thereof, the newspaper sheet stacking step is a step of stacking, in a number constituting one part of the newspaper, the cut sheets having a size of two pages of a newspaper printed side by side, the cut sheets having a size of three pages of a newspaper printed side by side and folded to the same size as that of the cut sheets having a size of two pages of a newspaper printed side by side, and the cut sheets having a size of four pages of a newspaper printed side by side and folded to the same size as that of the cut sheets having a size of two pages of a newspaper printed side by side, to thereby form a bundle of cut sheets for every one part of the newspaper, and the second folding step is a step of folding the bundle of cut sheets for every one part of the newspaper to thereby form a signature newspaper.

Still further the newspaper sheet cutting step of the newspaper production method of the present invention is a step of cutting the continuous web that has been printed by the ink jet printing unit capable of printing on the one surface and the other surface of the continuous web to form a rectangular cut sheet having a size of two pages of a newspaper printed side by side, in which two pages of a newspaper are printed side by side on the one surface and the other surface of the rectangular cut sheet and a length of one set of two parallel sides is equal to the height direction length of the newspaper, and forming, for every formation of a predetermined number of cut sheets having a size of two pages of a newspaper printed side by side, rectangular cut sheets having a size of one printed page of a newspaper, in which one page of a newspaper is printed on the one surface and the other surface of the rectangular cut sheet and a length of one set of two parallel sides is equal to the height direction length of the newspaper, cut sheets having a size of three pages of a newspaper printed side by side, in which three pages of a newspaper are printed side by side on the one surface and the other surface of the rectangular cut sheet and a length of one set of two parallel sides is equal to the height direction length of the newspaper, or rectangular cut sheets having a size of four pages of a newspaper printed side by side, in which four pages of a newspaper are printed side by side on the one surface and the other surface of the rectangular cut sheet and a length of one set of two parallel sides is equal to the height direction length of the newspaper, the first folding step is a step of to make the rectangular cut sheets having a size of three pages of a newspaper printed side by side the same size as that of the cut sheet having a size of two pages of a newspaper printed side by side by folding either one of the side pages thereof to overlap on the middle pages thereof, to make the rectangular cut sheets having a size of four pages of a newspaper printed side by side the same size as that of the cut sheets having a size of two pages of a newspaper printed side by side by folding the respective side pages thereof to overlap on respective adjacent pages thereof, the newspaper sheet stacking step is a step if stacking, in a number constituting one part of the newspaper, the cut sheets having a size of two pages of a newspaper printed side by side, the cut sheets having a size of one page of the newspaper printed, the cut sheets having a size of three pages of a newspaper printed side by side and folded to the same size as that of the cut sheets having a size of two pages of a newspaper printed side by side, and the cut sheets having a size of four pages of a newspaper printed side by side and folded to the size as that of a size of two pages of a newspaper printed side by side such that the cut sheets having a size of one printed page of the newspaper overlap on one of the pages printed on the cut sheets having a size of two pages printed side by side to thereby form a bundle of cut sheets for every one part of the newspaper, and the second folding step is a step of folding the bundle of cut sheets for every one part of the newspaper to thereby form a signature newspaper.

According to this invention, since an ink jet printing unit for a continuous web is configured provided with a plurality of ink jet print heads in a vertically stacked state, a flat region for installation of the ink jet printing unit for a continuous web can be made smaller by up to about half compared to the related art. Accordingly, it is possible to make a newspaper production system, provided with a continuous web supply unit at an upstream side of the ink jet printing unit for a continuous web, and provided with a processing unit for cutting and folding the continuous web at a downstream side of the ink jet printing unit for a continuous web, small and compact. Also, since the ink jet printing unit for a continuous web is configured so as to print by sequentially passing the continuous web from an upper stage to a lower stage in a zigzag fashion, a continuous web that has been printed on a first printing surface at the upper level can be guided by a roller that contacts a second printed surface, which is the reverse surface of the first printed surface, to below the ink jet print heads of the lower level, and the second printing surface can be guided upwards, and it is possible to carry out printing to the second printing surface with the ink jet print heads of the lower level, without lowering of quality due to degradation on the first printing surface that has just been printed etc. Furthermore, when this continuous web is guided below ink jet print heads at a still lower level, guiding is possible using a roller that contacts a first paper surface on which printed ink has stabilized while waiting for completion of printing to the second surface, and even in the event that the printed image of the first printing surface is rubbed by the roller contacting this surface there is hardly any lowering of quality due to smearing etc. Also, there is no lowering of quality due to smearing of the printed image of the second paper surface that has just been printed, and it is possible to carry out printing on the first paper surface using ink jet print heads at a lower level. Then, using a similar operation the second paper surface and the first paper surface are changed over, and it is possible to perform sequential printing according to the number of overlapped ink jet heads. As a result it is possible to acquire a printed product of good quality.

Also, since printing of the newspaper pages is carried out with a vertical direction of one page of the newspaper made parallel to the paper width, then even in the case of printing a blanket sized (broadsheet) newspaper the ink jet print heads suffice with the vertical dimension of one newspaper page, that is, a width of 547 mm, even if the paper is large. Operating the ink jet print heads with good precision is therefore comparatively easy, and is correspondingly less inexpensive, maintenance becomes comparatively easy and it is possible to lighten the load on an operator.

Further, sideways printing is possible for newspaper pages in a feed direction of the continuous web, and as a result an advertisement page spanning two adjacent sheets, and even an advertisement page spanning three or more adjacent pages can be printed using the same ink jet print head.

Also, by controlling operation speed of the cutting mechanism with respect to the traveling speed of the continuous web to appropriately vary the longitudinal direction cutting position of the continuous web, clipping of cut sheets in a state newspaper pages have been laid sideways in an appropriate number is extremely easy, and it is possible to produce newspapers comprising a varying number of pages.

Still further, even in a case where the width of the continuous web is large, a vertical direction of one newspaper page is made parallel to the cross direction of the paper, and printing is carried out for a few newspaper pages laid out in the cross direction of the paper, in the shape of a newspaper, there are parts between two pages that are next to each other in the cross direction of the paper where printing is not carried out, and so it is possible to install ink jet print heads of a size capable of printing the vertical direction of one newspaper page with rough precision next to each other, and it is extremely easy to clip each divided continuous web, that has been divided after printing with a slitter in the feed direction thereof, by controlling longitudinal direction cutting position of the continuous web similarly to as described previously.

For each of the divided cut continuous webs, it is also possible to clip stacked cut sheets, and it is possible to clip cut sheets using individual cutting mechanisms. The former is preferred in production newspapers where a lot of editions do not vary in page structure, while the latter is preferred for producing newspapers where the page structure often varies, or differs with each divided continuous web.

BRIEF DESCRIPTION OF THE DRAWINGS

FIG. 5(*b*) is an enlarged explanatory drawing of the cutting and folding unit 3*a* of FIG. 5(*a*).

FIG. 7(*b*) is an enlarged explanatory drawing of an overlapping unit 3*d*, a cutting unit 3*f* and a folding unit 3*b* that are the embodiment D of the processing unit 3B of FIG. 7(*a*).

FIG. 11 is a partially enlarged explanatory diagram of a separation unit 3*e* and a cutting unit 3*f* that are an embodiment E of the processing unit 3B.

FIG. 12(*a*) is a drawing looking from arrow E of FIG. 7(*a*), and is a substantial plan view of an overlapping unit 3*d* that is the embodiment D of the processing unit 3B.

FIG. 12(*b*) is a drawing looking from the direction of arrow F of FIG. 11, and is a substantial plan view showing a separation unit 3*e* that is the embodiment E of the processing unit 3B.

FIG. 13(*a*) to FIG. 13(*d*) are drawings schematically showing a 1-page cut sheet S1, 2-page cut sheet S2, 3-page cut sheet S3 and 4-page cut sheet S4 formed by the cutting mechanism 5 of the cutting and folding unit 3*a*, with FIG. 13(*a*) schematically showing allocation state of printed images on a 1-page cut sheet, FIG. 13(*b*) schematically showing allocation states of individual printed images on each page of a 2-page cut sheet S2, FIG. 13(*c*) schematically showing allocation state of combined printed images spanning the whole of a 3-page cut sheet S3, for example printed images for a 3-page advertisement, and FIG. 13(*d*) schematically shows allocation state of combined printed images spanning the whole of a 4-page cut sheet S4, for example, printed images for a 4-page advertisement.

FIG. 14(*b*) is a perspective view of a signature SS of the size of one page of a newspaper formed using 2-page cut sheets S2 and 4-page cut sheets S4 folded to the size of the width of 2 pages of a newspaper laid side by side by pre-folding.

FIG. 14(*c*) is a plan view of FIG. 14(*a*).

FIG. 14(*d*) is a plan view of FIG. 14(*b*).

DESCRIPTION OF THE PREFERRED EMBODIMENTS

Embodiments of this invention will now be described with reference to the drawings.

Figure 1:
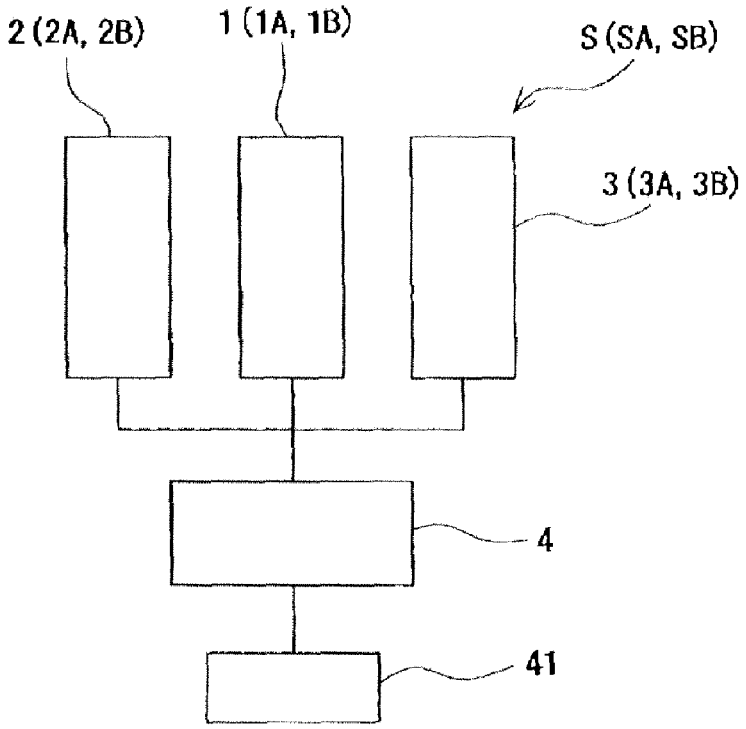
FIG. 1 is a block diagram showing a structural overview of a newspaper production system of this invention.

A newspaper production system S, as shown in FIG. 1, comprises a printing unit for printing on one surface and the other surface of a continuous web 1, a continuous web supply unit 2, provided at an upstream side of the printing unit for printing on one surface and the other surface of a continuous web 1, for supplying a continuous web to the printing unit for printing on one surface and the other surface of a continuous web 1, a processing unit 3, provided at a downstream side of the printing unit for printing on one surface and the other surface of a continuous web 1, for forming a continuous web that has been printed by the printing unit for printing on one surface and the other surface of a continuous web 1 into a newspaper, and control member 4 for controlling drive of each unit to adjust linkage of these units and various operation timing etc.

Figure 2:
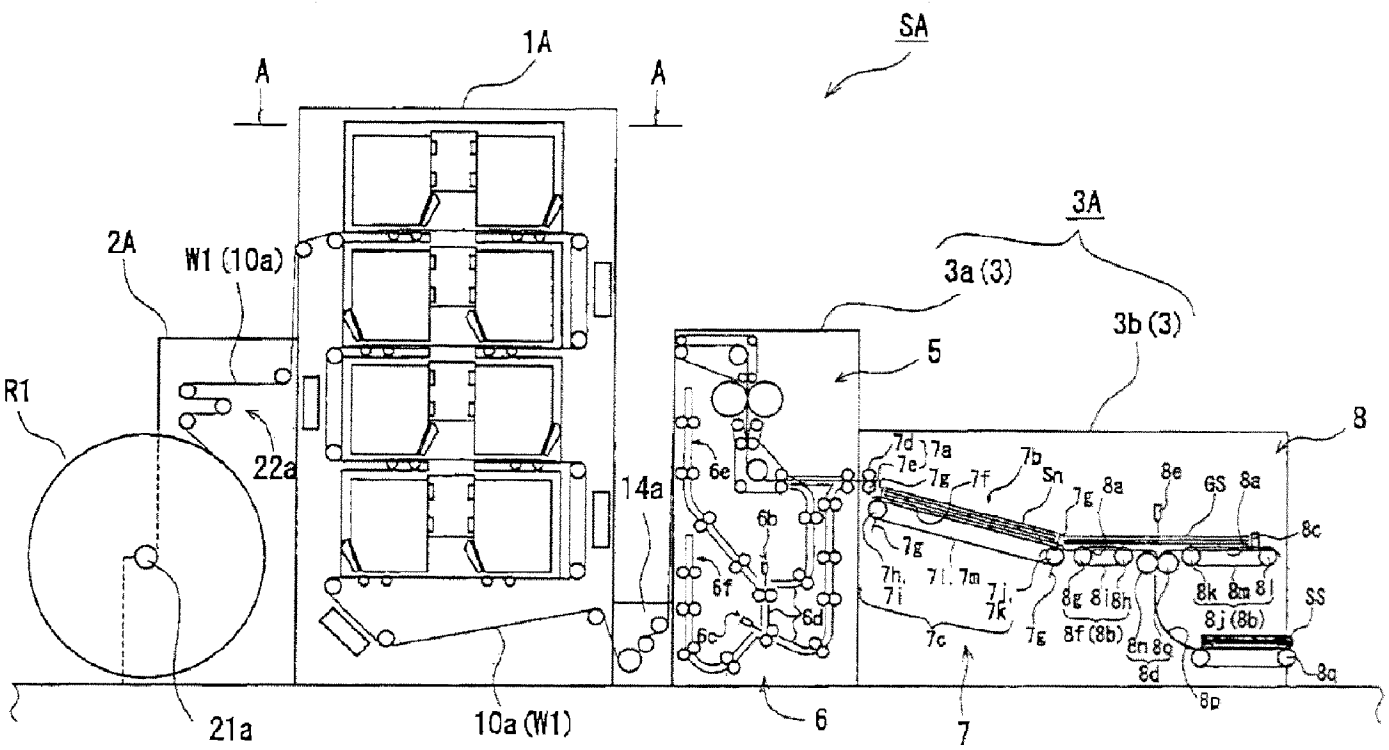
FIG. 2 is an overall structural diagram showing the structural overview of a newspaper production system SA of a first embodiment of the present invention having an ink jet printing unit for a continuous web 1A and a processing unit 3A, and is a structure that can be applied to a continuous web W of paper width that conforms to the vertical dimension of one page of a newspaper.

The newspaper production system SA, which is the first embodiment shown in FIG. 2, has a printing unit for printing on one surface and the other surface of a continuous web 1A and a continuous web supply unit 2A provided at an upstream side of the printing unit for printing on one surface and the other surface of a continuous web 1A, and it is possible to supply a continuous web W1 of a width conforming to the vertical dimension of one newspaper page to the printing unit for printing on one surface and the other surface of a continuous web 1A. Also, a processing unit 3A is provided at a downstream side of the printing unit for printing on one surface and the other surface of a continuous web 1A, and the continuous web W1 is cut and folded after being printed. The processing unit 3A is provided with a cutting and folding unit 3*a* and a folding unit 3*b*.

Figure 4:
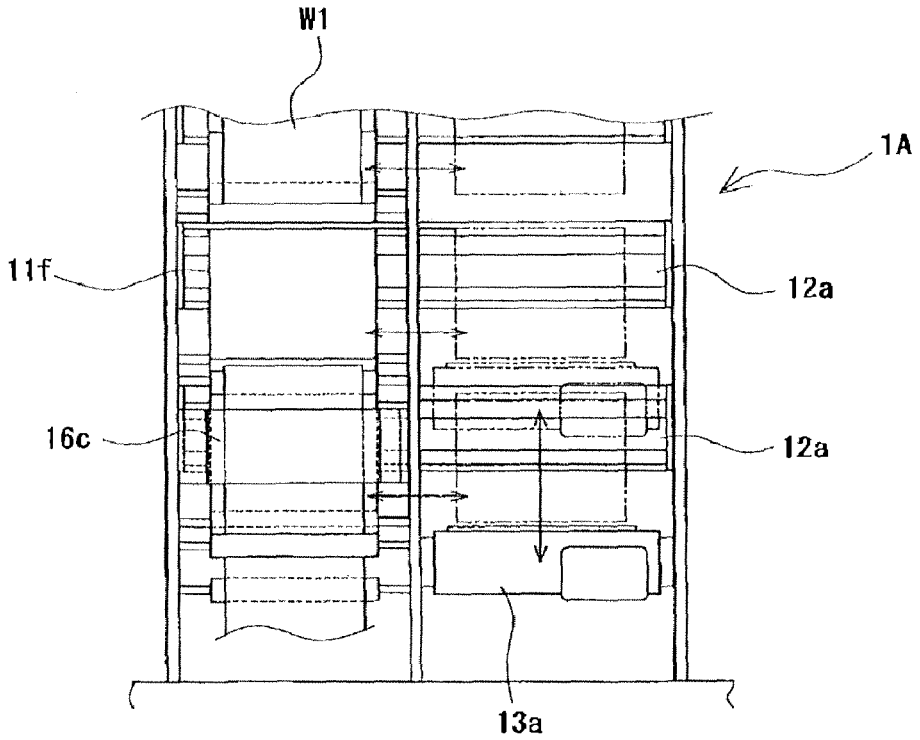
FIG. 4 is a schematic drawing of main parts looking from the direction of arrows BB of FIG. 3.
Figure 5:
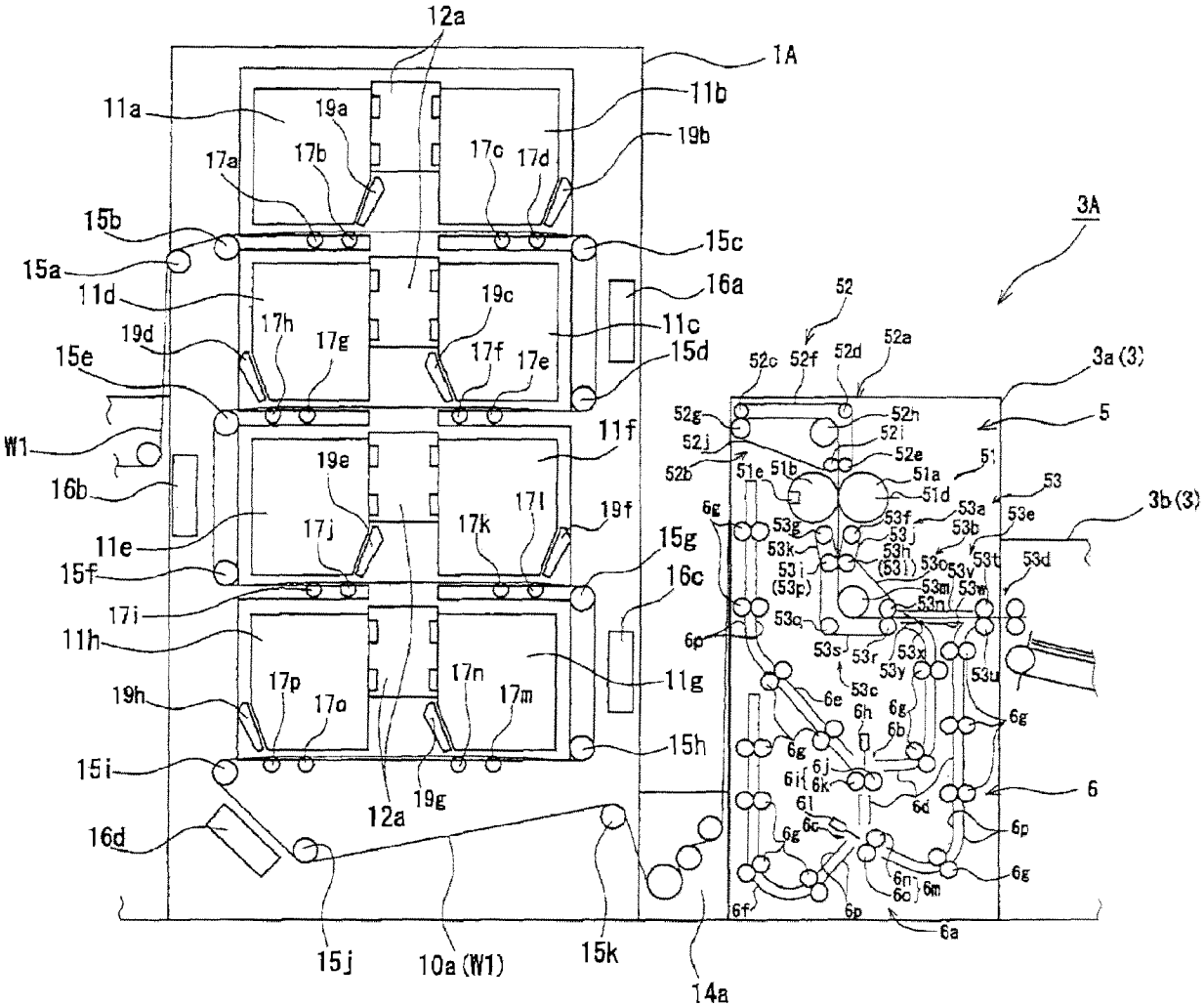
FIG. 5(*a*) is an enlarged explanatory drawing of the ink jet printing unit for a continuous web 1A shown in FIG. 2 and a cutting and folding unit 3*a* that is on of the processing units 3A.
Figure 5:
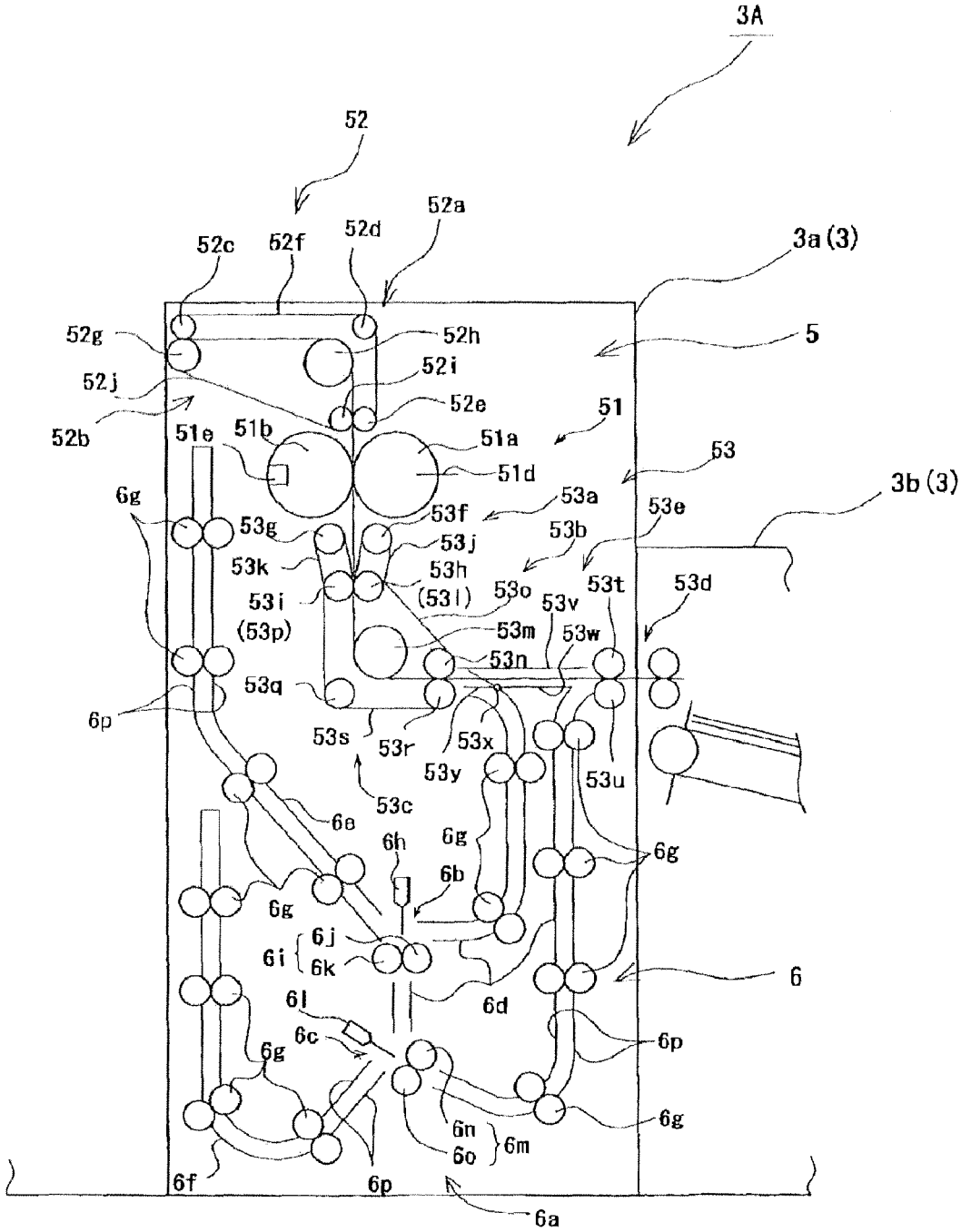

The printing unit for printing on one surface and the other surface of a continuous web 1A has ink jet printing devices 11*a* to 11*h*, having ink jet print heads (not shown) provided with a plurality of ink discharge ports spanning a dimension that is larger than the vertical direction dimension of one page of a newspaper, provided at four vertical levels, with two in each level, as shown in FIG. 5(*a*). Each of the ink jet printing devices 11*a* to 11*h* has the ink discharge ports facing downwards, and are provided so that when at the print position central positions in the cross direction of each of the ink jet printing devices 11*a* to 11*h* are on substantially the same plane. For example, the printing devices 11*a* to 11*h* are provided so that using a lateral movement unit 12*a* provided with a screw feeding mechanism (not shown), fine movement for lateral register adjustment of the printing image, and large movement to the printing position and to a maintenance position (shown by the dashed double-dotted line in FIG. 3 and FIG. 4) for performing maintenance of the ink jet print heads after printing using a maintenance unit 13*a*, is possible.

Also, a plurality of guide rollers 15*a* to 15*k* forming a paper run-through path 10*a* are provided below the ink jet printing devices 11*a* to 11*h* of each stage, that is, below the ink jet print heads of each stage, so that the continuous web W1 is capable of running through from the upper stage to the lower stage sequentially in a zigzag fashion. Drying units 16*a* to 16*d* are provided, respectively facing the paper run-through passages 10*a* spanning between after the paper has passed below the ink jet print heads of the upper stage and below the ink jet print heads of the next stage, and facing the run-through passage 10*a* after running below the ink jet print heads of the lowest stage. In FIG. 5(*a*), reference numerals 17*a* to 17*p* are back-up rollers, 19*a* to 19*h* are suction devices for collecting ink mist that files off at the time of printing, and 14*a* is a feed mechanism for feeding the continuous web W1 to the downstream side.

The continuous web supply unit 2A has a support section 21*a* capable of braking rotation of a continuous web roll R1 of the continuous web W of a width conforming to the vertical dimension of one page of a newspaper, and a tension detecting section 22*a* that is displaced in an oscillating fashion according to traveling tension of the continuous web W1, and the tension detection section 22*a* is provided so that strength of a braking force for braking rotation of the continuous web roll R1 can be automatically adjusted according to the magnitude of detected traveling force of the continuous web W1. The continuous web supply unit 2A is also provided with a continuous web roll lifting mechanism (not shown) for lifting the continuous web roll R1 at the time of loading the continuous web roll R1 into the support section 21*a*. The continuous web roll lifting mechanism is formed from a link mechanism that has a hydraulic cylinder, for example, as a drive source.

The processing unit 3A of the first embodiment comprises a cutting and folding unit 3*a* and a folding unit 3*b*, with the folding unit 3*b* being provided at a downstream side of the cutting and folding unit 3*a*.

The cutting and folding unit 3*a* has a cutting mechanism 5 and a pre-folding mechanism 6, as shown enlarged in FIG. 5(*b*). The cutting mechanism 5 is capable of cutting the continuous web W1 that has been printed by the printing unit for printing on one surface and the other surface of a continuous web 1A, and of forming cut sheets Sn having the size of a number of newspaper pages laid side by side, namely, for example, a 1-page cut sheet S1, a 2-page cut sheet S2, a 3-page cut sheet S3 and a 4-page cut sheet S4. The pre-folding mechanism 6 is capable of respectively pre-folding to a size of 2-page width utilizing folding to fold one page at either side of a 3-page cut sheet S3 formed by the cutting mechanism 5 parallel to a vertical direction of a single newspaper page so that the one page is overlapped on a center page, and folding to fold each side page of a 4-page cut sheet S4 parallel to the vertical direction of a single newspaper page so that associated adjacent pages of the 4-page cut sheet are overlapped on each other on the same side.

The folding unit 3*b* has a stacking section 7 and a folding mechanism 8.

The stacking section 7 neatly stacks cut sheets Sn equivalent to a single newspaper in a stacking space of a size of two pages of a newspaper laid side by side to stack them neatly, and form a cut sheet bundle GS.

The folding mechanism 8 forms a signature SS by folding a formed cut sheet bundle GS at a central position of two pages of a newspaper laid side by side, parallel to the vertical direction of one page of the newspaper.

The cutting mechanism 5 of the cutting and folding unit 3*a* has a cutting section 51, a guide-in section 52 and a delivery section 53. The cutting section 51 has a cutter drum 51*a* and a cutter receiving drum 51*b* provided facing each other either side of the traveling path for the continuous web W1. The guide-in section 52 feeds a continuous web W1 after being printed, that has been fed in by the feed mechanism 14*a* provided at an upstream side of the cutting section 51, to the cutting section 51. A delivery section 53 is provided at a downstream side of the cutting section 51, and causes a continuous web W1 after having been cut to travel towards the down stream side.

The cutter drum 51*a* of the cutting section 51 is provided with at least one cutter 51*d* at an outer surface, and the cutter receiving drum 51*b* is provided with at least one cutter indent 51*e* at the outer surface. Both drums are respectively provided parallel to each other and parallel to the surface of the traveling continuous web W1, and capable of rotation, being driven around an axis at right angles to the travel direction of the continuous web W1, and cut the continuous web W1 to form a cut sheet Sn by meshing the cutter 51*d* with the cutter indent 51*e* by rotation. The cutter drum 51*a* and the cutter receiving drum 51*b* form the cut sheet Sn to a size of a desired number of pages laid side by side, for every cutting out of a sheet Sn, utilizing a cutting section drive source, not shown, operating under the control of control member 4, and are caused to rotate by adjusting rotational speed and rotational phase with respect to travel speed of the continuous web W1 so as to cut the continuous web W1 at blank sections between pages of the printed newspaper.

The guide-in section 52 has a guide-in upper belt section 52*a* and guide-in lower belt section 52*b* provided either side of the traveling path of the continuous web W1.

The guide-in upper belt section 52*a* comprises a plurality of pulley sets 52*c*, 52*d*, and 52*e* that are provided being capable of rotation around an axis parallel to the central axis of the drums of the cutting section 51, each having a predetermined specified number of pulleys being spaced apart spanning in the cross direction of the continuous web W1, and an endless belt set 52*f* with each belt in the set being wound around the associated pulleys of these pulley sets 52*c*, 52*d*, and 52*e* that are at the same axial direction position as each other.

The guide-in lower belt section 52*b* comprises a plurality of pulley sets 52*g*, 52*h*, and 52*i* that are provided being capable of rotation around an axis parallel to the central axis of the drums of the cutting section 51, each pulley set having a predetermined specified number of pulleys being spaced apart spanning in the cross direction of the continuous web W1 so as to be at positions aligned with the pulleys of each pulley set 52*c*, 52*d* and 52*e* of the guide-in upper belt section 52*a*, and an endless belt set 52*j* with each belt in the set being wound around the associated pulleys of these pulley sets 52*g*, 52*h*, and 52*i* that are at the same axial direction position as each other.

The pulley set 52*c* of the guide-in upper belt section 52*a* is rotatably driven by a guide-in upper belt section drive source, not shown, that is operated under the control of the control member 4, and the endless belt set 52*f* is rotatably displaced in an anti-clockwise direction in FIG. 5.

The pulley set 52*g* of the guide-in lower belt section 52*b* is rotatably driven by a guide-in lower belt section drive source, not shown, that is operated under the control of the control member 4, and the endless belt set 52*j* is rotatably displaced in a clockwise direction in FIG. 5. Specifically, each belt of the guide-in upper belt section 52*a* and each belt of the guide-in lower belt section 52*b* face each other across the traveling path of the continuous web W1, and the facing sections sandwich the continuous web W1 and move at the same relative speed and in the same relative direction.

The delivery 53 comprises a hopper belt section 53*a*, a delivery upper belt section 53*b*, and delivery lower belt section 53*c* provided on either side of the traveling path of the continuous web W1, a delivery roller section 53*d*, and a path switching section 53*e* for switching a traveling path for the continuous web W1.

The hopper belt section 53*a* comprises upstream pulley sets 53*f* and 53*g*, provided capable of rotation about an axis parallel to the axial center of the drums of the cutting section 51, with a predetermined specified number of pulleys being spaced apart from each other in a cross direction of the continuous web W1, and provided facing each other on either side of the traveling path for the continuous web W1, and downstream pulley sets 53*h* and 53*i*, provided capable of rotation about an axis parallel to the axial center of the drums of the cutting section 51, with a predetermined specified number of pulleys being spaced apart from each other, in a cross direction of the continuous web W1, so as to be at positioned aligned with the pulleys of the upstream pulley sets 53*f* and 53*g*, and provided facing each other on either side of the traveling path for the continuous web W1, and a one side endless belt set 53*j* which is wound around associated pulleys of the upstream pulley set 53*f* and the downstream pulley set 53*h* at one side of the traveling path of the continuous web W1 that are aligned with each other at axial direction positions, and an other side endless belt set 53*k* which is wound around associated pulleys of the upstream pulley set 53*g* and the downstream pulley set 53*i* at another side of the traveling path of the continuous web W1 that are aligned with each other at axial direction positions. The upstream pulley sets 53*f* and 53*g* are spaced opposite each other slightly apart.

The delivery upper belt section 53*b* comprises a plurality of pulley sets 53*l*, 53*m*, and 53*n* that are provided being capable of rotation around an axis parallel to the central axis of the drums of the cutting section 51, each having a predetermined specified number of pulleys being spaced apart spanning in the cross direction of the continuous web W1, and an endless belt set 53*o* with each belt in the set being wound around the associated pulleys of these pulley sets 53*l*, 53*m*, and 53*n* that are at the same axial direction position as each other. The delivery lower belt section 53*c* comprises a plurality of pulley sets 53*p*, 53*q*, and 53*r* that are provided being capable of rotation around an axis parallel to the central axis of the drums of the cutting section 51, each pulley set having a predetermined specified number of pulleys being spaced apart spanning in the cross direction of the continuous web W1 so as to be at positions aligned with the pulleys of each pulley set 53*l*, 53*m* and 53*n* of the delivery upper belt section 53*b*, and an endless belt set 53*s* with each belt in the set being wound around the associated pulleys of these pulley sets 53*p*, 53*q*, and 53*r* that are at the same axial direction position as each other.

The pulley set 53*l* of the delivery upper belt section 53*b*, and the downstream pulley set 53*h* of the hopper belt section 53*a*, are rotatably driven together by a delivery upper belt section drive source, not shown, provided on the same rotational axis and operated under the control of the control member 4, with the pulley set 53*l* rotatably displacing the endless belt set 53*o* in an anti-clockwise direction in FIG. 5(*b*), and the downstream pulley set 53*h* rotatably displacing one side endless belt set 53*j* in an anti-clockwise direction in FIG. 5(*b*). Also, the pulley set 53*p* of the delivery lower belt section 53*c*, and the downstream pulley set 53*i* of the hopper belt section 53*a*, are rotatably driven together by a delivery lower belt section drive source, not shown, provided on the same rotational axis and operated under control of the control member 4, with the pulley set 53*p* rotatably displacing the endless belt set 53*s* in a clockwise direction in FIG. 5(*b*), and the downstream pulley set 53*i* rotatably displacing the other side endless belt set 53*k* in a clockwise direction in FIG. 5(*b*). Specifically, each belt of the one side endless belt set 53*j* and the other side endless belt set 53*k* of the hopper belt section 53*a* face each other across the traveling path of the continuous web W1 and the facing sections sandwich the continuous web W1 and move at the same relative speed and in the same relative direction. Also, each belts of the endless belt set 53*o* of the delivery upper belt section 53*b* and each belt of the endless belt set 53*s* of the delivery lower belt section 53*c* face each other across the traveling path of the continuous web W1, and the facing sections sandwich the continuous web W1 and move at the same relative speed and in the same relative direction. Accordingly, each belt of the hopper belt section 53*a*, each belt of the delivery upper belt section 53*b* and each belt of the delivery lower belt section 53*c* have opposed sites that are movably displaced at either side of the traveling path of the continuous web W1 that are displaced at the same relative speed and in the same relative direction.

Still further, the guide in upper belt section drive source (not shown) and the guide in lower belt drive source (not shown) of the guide in section 52, together with the delivery upper belt section drive source (not shown) and the delivery lower belt section drive source (not shown) of the feed section 53, are controlled by the control member 4 so moving displacement speed of each belt is the same.

The delivery roller section 53*d* is formed using an upper roller section 53*t* and a lower roller section 53*u*. The upper roller section 53*t* has a predetermined specified number of rollers provided spaced apart spanning the cross direction of the continuous web W1, and capable of rotation around a central axis parallel to the drums of the cutting section 51. The lower roller section 53*u* has a predetermined specified number of rollers provided spaced apart spanning the cross direction of the continuous web W1 so as to be positioned aligned with the rollers of the upper roller section 53*t*, and capable of rotation around a central axis parallel to the drums of the cutting section 51. Each roller of the upper roller section 53*t* and each roller of the lower roller section 53*u* is provided at the most downstream side of the delivery section 53, so as to make gripping contact with the continuous web W1 in the traveling path.

Also, the upper roller section 53*t* of the delivery roller section 53*d* is provided to be rotatably driven in an anti-clockwise direction in FIG. 5 by the delivery upper roller section drive source (not shown), and the lower roller section 53*u* of the delivery roller section 53*d* is provided to be rotatably driven in a clockwise direction in FIG. 5(*b*) by the delivery lower roller section drive source (not shown). The delivery upper roller section drive source is controlled by the control member 4 so that the speed of the outer surface of each roller of the upper roller section 53*t* is the same speed as the speed of displacing movement of each belt of the guide-in section 52 and each belt of the delivery section 53. Also, the delivery lower roller section drive source is controlled by the control member 4 so that the speed of the outer surface of each roller of the lower roller section 53*u* is the same speed as the speed of displacing movement of each belt of the guide-in section 52 and each belt of the delivery section 53. Incidentally, it is also possible in the delivery roller section 53*d* for at least one of the upper roller section 53*t* and the lower roller section 53*u* to be provided with a single roller provided with an external surface that continuously spans the entire cross direction of the continuous web. The path switching section 53*e* is provided between downstream side end sections of the delivery upper belt section 53*b* and the delivery lower belt section 53*c* (in the following made the delivery belt downstream ends) and the delivery roller section 53*d*.

The path switching section 53*e* has a one side constraining member 53*v* and another side constraining member 53*w*, with the one side constraining member 53*v* and the other side constraining member 53*w* constraining at least both sides of the continuous web W1 to form a traveling path (in the following made a direct traveling path) for allowing the continuous web W1 to travel directly from the delivery belt downstream end to the delivery roller section 53*d*.

The one side constraining member 53*v* and the other side constraining member 53*w* are provided respectively spanning the entire continuous web W1 in the cross direction, with a first opening section and a second opening section being formed on the other side constraining section 53*w*, at a suitable position close to the delivery belt downstream end and at a suitable position close to the delivery roller section 53*d*, respectively, in a state warped in the cross direction of the continuous web W1 so that the continuous web W1 is not obstructed and is capable of passing, with a path switching member 53*y* capable of angular displacement about a center axis of the axis 53*x* a drive source (not shown) being provided on the first opening section.

At a normal time, the path switching member 53*y* is held in a posture parallel to the other side constraining member 53*w* to form part of the other constraining member 53*w* by blocking the first opening section, the direct traveling path is closed off together with closing off of the first opening section by rotational displacement, and is provided capable of guiding a tip section of the continuous web W1 formed by the cutting section 51 into the first opening section using the part where the direct traveling path is closed off. A start end of a pre-folding guide path 6*a*, which is a guide path for the continuous web in the pre-folding mechanism 6, that will be described later, is connected to the position of the first opening section, while a terminal end of a pre-folding guide passage 6*a* is connected to the position of the second opening section.

The pre-folding mechanism 6 of the cutting and folding unit 3*a* has a pre-folding guide path 6*a*, a leading side folding section 6*b* and a trailing side folding section 6*c*, and with the illustrated embodiment is provided below the cutting mechanism 5, and capable of linked operation with the cutting mechanism 5 by connecting the start end and terminal end of the pre-folding guide path 6*a* to the cutting mechanism.

The pre-folding guide path 6*a* is capable of respectively pre-folding to a size of 2-page width utilizing folding to fold one page at either side of a 3-page cut sheet S3 formed by the cutting mechanism 51 parallel to a vertical direction of a single newspaper page so that the one page is overlapped on a center page, and folding to fold each side page of a 4-page cut sheet S4 parallel to the vertical direction of a single newspaper page so that associated adjacent pages of the 4-page cut sheet are overlapped on each other on the same side.

The leading side folding section 6*b* is provided at a midpoint of the pre-folding guide path 6*a*, and folds a one leading side page of a 4-page cut sheet S4. The trailing side folding section 6*c* curves one trailing side page of the 4-page cut sheet S4.

The pre-folding guide path 6*a* is provided with a trunk passage 6*d* provided so that a 3-page cut sheet S3 and a 4-page cut sheet S4 (hereafter made a sheet that requires pre-folding) have at least both surfaces constrained and guided by the constraining member 6*p*, and a first branched passage 6*e* and a second branched passage 6*f* that are branched off from the trunk passage 6*d*. The trunk passage 6*d* is provided starting at the start end, leading to the terminal end by way of the leading side folding section 6*b* and the trailing side folding section 6*c*, in that order, the first branched passage 6*e* is provided branching from the trunk passage 6*d* at the position of the leading side folding section 6*b*, the second branched passage 6*f* is provided branching from the trunk passage 6*d* at a position of the trailing side folding section 6*c*, and the trunk passage 6*d* is provided so that a direction in which a sheet that requires pre-folding is guided is changed at each branched section where the first branched section 6*e* and the second branched section 6*f* respectively branch. Also, the trunk passage 6*d*, first branched passage 6*e* and second branched passage 6*f* are respectively provided with paper feed roller mechanisms 6*g*, 6*g*, . . . at appropriate positions.

The paper feed roller mechanisms 6*g* are provided so that sheets sent out by the delivery section 53 that require pre-folding can be guided in the pre-folding guide passage 6*a* at the same speed as the speed at which the delivery section 53 send them out. Specifically, a plurality of paper feed roller mechanisms 6*g* are provided on axes parallel to the central axis of the drums of the cutting section 51, facing each other on either side of the pre-folding guide passage 6*a*, so that outer surfaces facing each other on either side of the pre-folding guide passage 6*a* contact via the cut sheets, and on respective axes arranged at appropriate intervals in the cross direction of the sheets that requires pre-folding. The paper feed roller mechanisms 6*g* are provided so that a plurality of rollers arranged on at least one axis are rotatably driven together around the axis at an outer peripheral speed that is the same speed as the speed that the sheets that require pre-folding are sent out from the delivery section 53, by an appropriate drive source (not shown), and so that rollers that are not driven turn together around the axis by means of the sheets that require pre-folding.

Further, the paper feed mechanisms 6*g* provided in the first branched passage 6*e* reverse the direction of drive rotation in accordance with a folding operation of the folding blade 6*h* of the leading side folding section 6*b* that will be described later, and operate so as to discharge a sheet that requires pre-folding caught inside the first branched passage 6*e*, from the first branched passage 6*e*.

Also, the paper feed mechanisms 6*g* provided in the second branched passage 6*f* reverse the direction of drive rotation in accordance with a folding operation of the folding blade 6*l* of the trailing side folding section 6*c* that will be described later, and operate so as to discharge a sheet that requires pre-folding caught inside the second branched passage 6*f*, from the second branched passage 6*f*.

The leading side folding section 6*b* has a folding blade 6*h* and a pair of folding rollers 6*i*, and is provided at a section for changing the guide direction of the sheets that require pre-folding by the trunk passage 6*d*.

The pair of folding rollers 6*i* is provided with two rollers 6*j* and 6*k*. The two rollers 6*j* and 6*k* are provided with so that outer surfaces face each other on either side of the trunk passage 6*d*, on an end section of the trunk passage 6*d* after guide direction change, capable of rotation around an axis parallel to the central axis of the drums of the cutting section 51. These two rollers 6*j* and 6*k* are provided with opposed outer surfaces capable of contacting at a predetermined fixed length with the overall peripheral length made maximum via the sheets that require pre-folding, and are rotatably driven by drive means (not shown) so that the right side roller 6*j* in FIG. 5 rotates anti-clockwise while the left side roller 6*k* in FIG. 5 rotates clockwise, with an outer surface speed being the same as that of the roller respective paper feed roller mechanisms 6*g*.

The folding blade 6*h* is driven by drive means (not shown) having operation timing controlled by control member 4, and carries out an insertion folding operation between the rollers 6*j* and 6*k* of the pair of folding rollers 6*i* at predetermined places of the sheets that require pre-folding whose leading ends have been guided past the position of the pair of folding rollers 6*i* and into the first branched passage 6*e*.

The trailing side folding section 6*c* has a folding blade 6*l* and a pair of folding rollers 6*m*, and is provided at a section for changing the guide direction of the sheets that require pre-folding by the trunk passage 6*d*, the section being at a more downstream side than the leading side folding section 6*b*.

The pair of folding rollers 6*m* is provided with two rollers 6*n* and 6*o*. The two rollers 6*n* and 6*o* are provided so that outer surfaces face each other on either side of the trunk passage 6*d*, on an end section of the trunk passage 6*d* after guide direction change, capable of rotation around an axis parallel to the central axis of the drums of the cutting section 51. These two rollers 6*n* and 6*o* are provided with opposed outer surfaces capable of contacting at a predetermined fixed length with the overall peripheral length made maximum via the sheets that require pre-folding, and are rotatably driven by drive means (not shown) so that the right upper side roller 6*n* in FIG. 5(*b*) rotates anti-clockwise while the left lower side roller 6*o* in FIG. 5(*b*) rotates clockwise, with an outer surface speed being the same as that of the paper feed roller mechanisms 6*g*.

The folding blade plate 6*l* is driven by drive means (not shown) having operation timing controlled by control member 4, and carries out an insertion folding operation between the rollers 6*n* and 6*o* of the pair of folding rollers 6*m* at predetermined places of the sheets that require pre-folding whose leading ends have been guided past the position of the pair of folding rollers 6*m* and into the second branched passage 6*f*.

Regarding the length and timing at which the rollers 6*j* and 6*k* of the pair of folding rollers 6*i* make contact via the sheets that require pre-folding, it is sufficient to be able to score the sheets that require pre-folding and have been inserted by the folding blade 6*h* between the two rollers 6*j* and 6*k*, and regarding the length and timing at which the rollers 6*n* and 6*o* of the pair of folding rollers 6*m* make contact via the sheets that require pre-folding, it is sufficient to be able to score the sheets that require pre-folding and have been inserted by the folding blade 6*l* between the two rollers 6*n* and 6*o*. Also, the one side constraining member 53*v*, other side constraining member 53*w* and path switching member 53*y* of the path switching section 53*e* of the cutting mechanism 5, and the constraining member 6*p* of the pre-folding guide passage 6*a* of the pre-folding mechanism 6, are not limited to the form of a plate shape or duckboard etc., as long as it is possible to constrain the traveling path or the guide passages, and the material is also not limiting as long as the configuration is stable. Taking into consideration the need to make the travel and guiding smooth, however, it is desirable for at least sections constraining the traveling path of the guide passage to be of a material and configuration having low coefficient of friction.

The folding unit 3*b*, being the processing unit 3, has a stacking section 7 and a folding mechanism 8. The stacking section 7 receives cut sheets Sn equivalent to a single newspaper and stack them neatly to form a cut sheet bundle GS. The folding mechanism 8 forms a signature SS by folding a formed cut sheet bundle GS at a central position of two pages of a newspaper laid side by side, parallel to the vertical direction of one page of the newspaper.

The stacking section 7 is provided with an ejection roller section 7*a*, a stacking space 7*b* and a sheet bundle delivery mechanism 7*c*. The stacking space 7*b* is inclined with a side close to the cutting and folding unit 3*a* higher up. The ejection roller section 7*a* receives cut sheets Sn that have been delivered from the cutting and folding unit 3*a*, and ejects them into the stacking space 7*b*. The sheet set delivery mechanism 7*c* delivers cut sheet bundle GS formed by stacking the cut sheets Sn inside the stacking space 7*b*.

The ejection roller section 7*a* has an upper roller section 7*d* and a lower roller section 7*e*, and the upper roller section 7*d* and the lower roller section 7*e* are respectively provided close to the two rollers of the delivery roller section 53*d* of the cutting and folding unit 3*a*. The upper roller section 7*d* and the lower roller section 7*e* respectively have a predetermined specified number of rollers provided spaced apart spanning the cross direction of the cut sheet Sn, at positions aligned with each other, and capable of rotation around an axis parallel to the drums of the cutting section 51. Each roller of the upper roller section 7*d* and each roller of the lower roller section 7*e* is provided at the most upstream side of the stacking section 7 so as make contact with and grip the cut sheets that have been delivered from the delivery roller section 53*d* of the cutting and folding unit 3*a*.

The upper roller section 7*d* of the ejection roller section 7*a* is provided so as to be rotatably driven in an anti-clockwise direction in FIG. 2 by an ejection upper roller drive source (not shown).

The lower roller section 7*e* of the ejection roller section 7*a* is provided so as to be rotatably driven in a clockwise direction in FIG. 2 by an ejection lower roller drive source (not shown).

The ejection upper roller section drive source (not shown) is controlled by the control member 4 so that the outer peripheral surface speed of each roller of the upper roller section 7*d* becomes the same speed as the speed of the rotating peripheral surfaces of the two rollers of the delivery roller section 53*d*, and the ejection lower roller section drive source is controlled by the control member 4 so that the outer peripheral surface speed of each roller of the lower roller section 7*e* becomes the same speed as the speed of the rotating peripheral surfaces of the two rollers of the delivery roller section 53*d*. Incidentally, it is also possible in the ejection roller section 7*a* for at least one of the upper roller section 7*d* and the lower roller section 7*e* to be provided with a single roller provided with an outer surface that continuously spans the entire cross direction of the ejected cut sheets Sn sheet.

The stacking space 7*b* is provided with 4-sides constrained to substantially the same size as a 2-page cut sheet S2 and inclined with an upstream side closer to the cutting and folding unit 3*a* higher up, with the two sides being the upstream side and the downstream side, in the ejection direction of the cut sheets Sn, of the constrained sides of the stacking space 7*b*, being defined by a delivery member 7*g* of the sheet bundle delivery mechanism 7*c*, and the other two sides being defined by appropriate means. The stacking space 7*b* has a receiving member 7*f*, and the receiving member 7*f* receives cut sheets Sn ejected from the ejection roller section 7*a* on an upper surface, that upper surface being formed from a material having a comparatively low coefficient of friction. A plurality of gaps, that the delivery member 7*g* is capable of passing through when moving from the upstream side to the downstream side of the stacking space 7*b* in order to carry out a delivery operation, are provided in the receiving member 7*f*, having appropriate intervals in a direction at right angles to the movement direction of the delivery member 7*g*.

The sheet bundle feed mechanism 7*c* is comprised of four sprocket wheels 7*h*, 7*i*, 7*j* and 7*k* having the same diameter, an endless chain 7*l*, an endless chain 7*m*, support members (not shown) attached at four places, and the delivery member 7*g*. The four sprocket wheels 7*h*, 7*i*, 7*j* and 7*k* are provided in the four lower corners of the stacking space 7*b*, capable of rotation about an axis parallel to the central axis of the drums of the cutting section 51, and aligned with two axial direction positions at the upstream side and the downstream side of the stacking space 7*b*. The endless chain 7*l* is wound between the upstream side sprocket wheel 7*h* and the downstream side sprocket wheel 7*j* of sprocket wheels 7*h*, 7*i*, 7*j*, and 7*k* whose axial direction positions are adjusted. The endless chain 7*m* is similarly wound around the upstream side sprocket wheel 7*i* and the downstream side sprocket wheel 7*k*. Support members (not shown) are attached at four places so as to be parallel to the center axis of the drums of the cutting section 51 between the endless chain 7*l* and the endless chain 7*m*. The delivery member 7*g* is attached to the support members at a predetermined spacing.

An interval between the rotational axes of the upstream side sprocket wheels 7*h* and 7*i*, and the downstream side sprocket wheels 7*j* and 7*k*, is provided as a length A plus a that is twice the length of the cross direction dimension of one page of a newspaper, plus α, and an interval between attachment of the support members attached at four places between the endless belt 7*l* and the endless belt 7*m* is set as the length A plus α, the length of a semicircular arc of a pitch circle of the sprocket wheels, length A plus α, and the length of a semicircular arc of a pitch circle of the sprocket wheels. Specifically, in a state where an attachment interval of the support members is length A plus α and the delivery member 7*g* constrains two sides, namely the upstream side and the downstream side, of the stacking space 7*b*, the delivery member 7*g* attached to the support members awaits formation of a cut sheet bundle GS by stacking up the cut sheets on the receiving member 7*f*, and if the cut sheet bundle GS has been formed the endless chain 7*l* and the endless chain 7*m* are displaced in accordance with clockwise displacement in FIG. 2 by half their length, that is, by a length corresponding to a total of the length A plus α and a semicircular length of a pitch circle of the sprocket wheels, and the cut sheet bundle GS on the receiving member 7*f* is delivered to the folding mechanism 8.

The folding mechanism 8 comprises an upper plate 8*a*, a conveyor section 8*b*, a stopper 8*c*, a folding roller pair 8*d*, and a folding blade 8*e*. The upper plate 8*a* receives and supports a cut sheet bundle GS delivered from the stacking section 7, and the conveyor section 8*b* moves the cut sheet bundle GS delivered from the stacking section 7 onto the upper plate 8*a*. The stopper 8*c* limits movement if the cut sheet bundle GS on the upper plate 8*a*. The folding roller pair 8*d* is provided below the upper plate 8*a*, and the folding blade 8*e* is provided above the upper plate 8*a* capable of reciprocal movement between a standby position, separated from the upper plate by a distance that is greater than the thickness of at least a cut sheet bundle GS, and an operating position where the tip end of the folding blade 8*e* reaches between the rollers of the folding roller pair 8*d*.

The upper plate 8*a* is divided in two by an opening section provided substantially in the center, in the movement direction of the cut sheet bundle GS by the conveyor section 8*b*. An opening section at right angles to the movement direction of the cut sheet bundle GS enables the folding blade 8*e* to be moved towards the operating position. The opening section has a width capable of passing a cut sheet bundle GS in a folded in two state when the cut sheet bundle GS positioned over the opening section is inserted between the rollers of the folding roller pair 8*d*, and the two edges of the opening section are formed in a smoothly curving shape so that passage of the cut sheet bundle GS is not obstructed.

The conveyor section 8*b* is divided by at least the opening position of the upper plate 8*a*, and has an upstream conveyor section 8*f* and a downstream conveyor section 8*j*. The upstream conveyor section 8*f* is provided with two pulley sets 8*g* and 8*h* comprising a plurality of pulleys provided capable of rotation about a central axis parallel to the center axis of the drums of the cutting section 51 and with positions aligned at appropriate intervals in the center axis direction, and an endless belt set 8*i* wound around associated pulleys of the two pulley sets with aligned positions, and the down stream conveyor section 8*j* is provided with two pulley sets 8*k* and 8*l* comprising a plurality of pulleys provided capable of rotation about a central axis parallel to the center axis of the drums of the cutting section 51 and with positions aligned at appropriate intervals in the center axis direction, and an endless belt set 8*m* wound around associated pulleys of the two pulley sets with aligned positions.

The endless belt set 8*i* and the endless belt set 8*m* are provided so that an upper side displacement section is displaced along the upper surface of the upper plate 8*a*.

The stopper 8*c* is provided on the upper surface of the upper plate 8*a*, and is provided capable of stopping a cut sheet bundle GS that has been conveyed by the conveyor section 8*b* with a central section in the conveyance direction thereof in alignment with the opening section of the upper plate 8*a*.

Also, part of a lower surface is notched so that the endless belt set 8*m* is capable of passing through.

The folding roller pair 8*d* has two opposed folding rollers 8*n* and 8*o*, and these two opposed folding rollers 8*n* and 8*o* are driven by a drive source (not shown) to be capable of rotation about an axis parallel to the center axis of the drums of the cutting section 51, are face each other with a slight gap between them. These two folding rollers 8*n* and 8*o* are close to the underneath of the upper plate 8*a*, and are provided so that a center of an opposed gap of the folding rollers 8*n* and 8*o* becomes substantially directly below a center of the opening section of the upper plate 8*a*. An opposed space of the two folding rollers 8*n* and 8*o* is a space capable of firmly folding a cut sheet bundle in two to form a cut sheet bundle GS into a signature SS having a size of one newspaper page when the folding plate 8*e* is moved towards the operating position to insert the cut sheet bundle GS on the upper plate 8*a* between the two rollers, and is provided cable of being made wider or narrower by moving at least one of the rollers backwards and forwards relative to the other roller using adjustment means, not shown. The speed of the peripheries of the folding rollers 8*n* and 8*o* can be a speed that achieves completion of the folding processing of the leading cut sheet bundle GS before the trailing cut sheet bundle GS is delivered from the stacking section 7.

The folding bundle 8*e* is provided, for example, linked to a drive source (not shown) by a link mechanism (not shown), and is provided capable of reciprocation between a standby position, separated from the upper plate by a distance that is greater than the thickness of at least a cut sheet bundle GS, and an operating position where the tip end of the folding blade 8*e* reaches between the rollers of the folding roller pair 8*d*, by operation of the drive source. Specifically, the folding blade 8*e* operates so that when a central part, in a conveyance direction, of a cut sheet bundle GS that has been conveyed onto the upper plate 8*a* by the conveyance section 8*b* has been adjusted to align with the opening section of the upper plate 8*a*, the insertion tip end of the folding blade 8*e* is brought into contact with the upper surface of the cut sheet bundle GS, and the cut sheet blade GS is pressed through the opening section of the upper plate 8*a* and in between the folding rollers 8*n* an 8*o*, by operation of a drive source whose operation timing has been adjusted by the control member 4. In the folding unit 52, reference numeral 8*q* is a take out section for taking out the signature SS that has been folded by the folding mechanism 8, and 8*p* is a guide member for guiding the signature SS that has been folded by the folding mechanism 8 to the take out section 8*q*.

Figure 7:
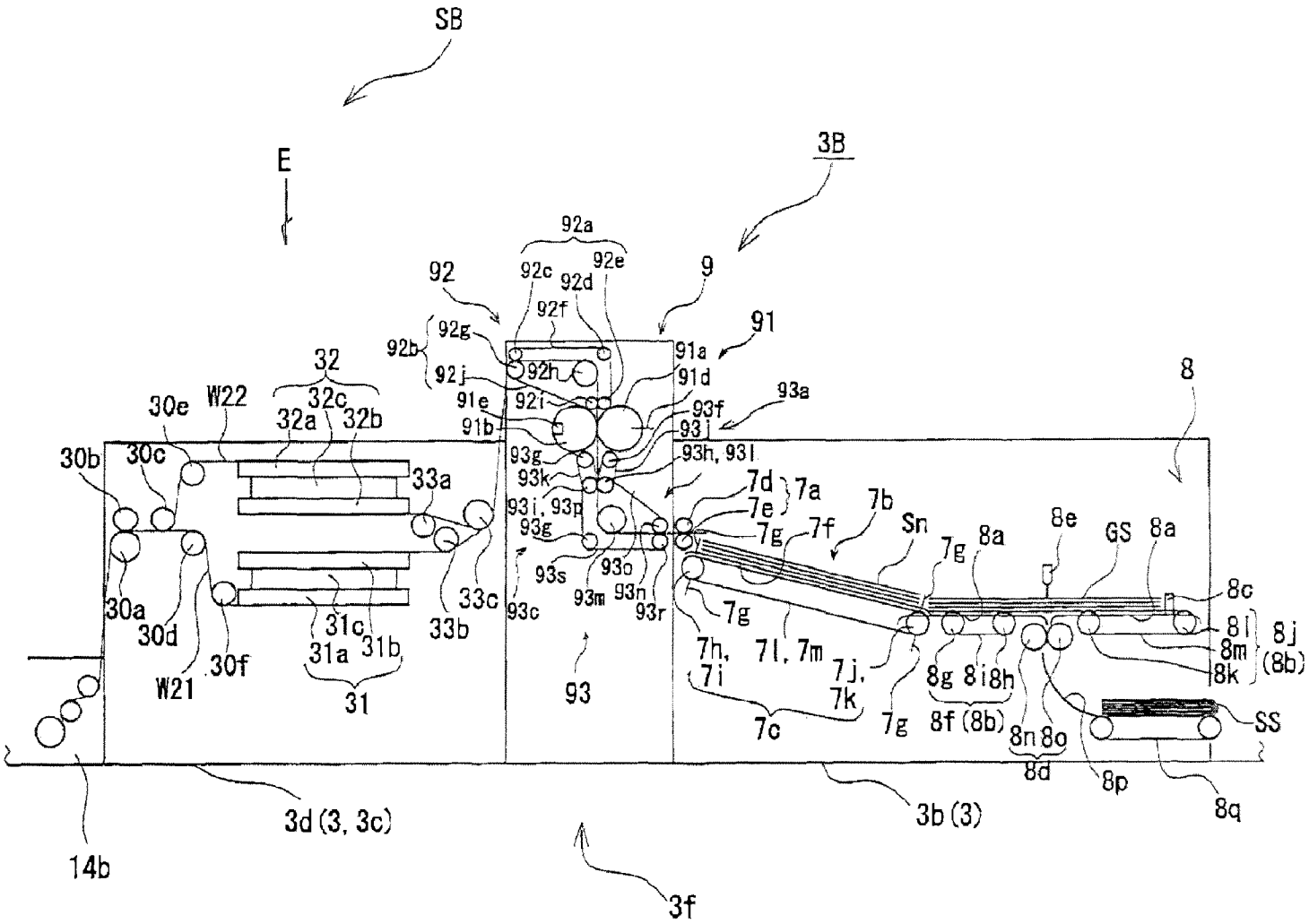
FIG. 7(*a*) is an overall structural diagram showing the structural overview of a newspaper production system SB of a second embodiment of the present invention having an ink jet printing unit for a continuous web 1B and an embodiment D of a processing unit 3B, and is a structure that can be applied to a continuous web W2 of width that conforms to the vertical dimension of two pages of a newspaper.

A newspaper production system SB that is a second embodiment shown in FIG. 7(*a*), FIG. 7(*b*), FIG. 8, FIG. 9, FIG. 10, FIG. 11, FIG. 12(*a*) and FIG. 12(*b*) has a continuous web supply unit 2B provided at an upstream side of a printing unit for printing on one surface and the other surface of a continuous web 1B, and has a divided continuous web course changing unit 3*c* (overlapping unit 3*d* or separating unit 3*e*), being a processing unit 3B, a cutting unit 3*f*, and a folding unit 3*b* provided at a downstream side of the printing unit for printing on one surface and the other surface of a continuous web 1B. A overlapping unit 3*d*, being an embodiment D of the divided continuous web course changing unit 3*c*, is shown in FIG. 7(*a*) FIG. 7(*b*) and FIG. 12(*a*), while a separating unit 3*e*, being an embodiment E of the divided continuous web course changing unit 3*c*, is shown in FIG. 11 and FIG. 12(*b*).

The continuous web supply unit 2B is provided capable of supplying a continuous web W2 having a paper width conforming to two pages of a vertical dimension of a newspaper to the printing unit for printing on one surface and the other surface of a continuous web 1B.

The divided continuous web course changing unit 3*c* (overlapping unit 3*d* or separating unit 3*e*) divides the continuous web W2 after printing in two by slitting in the longitudinal direction, and delivers the divided continuous web to a cutting unit 3*f* provided at the downstream side. With the embodiment where the divided continuous web course changing unit 3*c* is an overlapping unit 3*d*, it is possible for two divided continuous webs that have been divided to be overlapped and delivered to the cutting unit 3*f* that is provided at a downstream side.

With the embodiment where the divided continuous web course changing unit 3*c* is a separating unit 3*e*, it is possible for two divided continuous webs that have been divided to be separated and individually delivered to the cutting unit 3*f* that is provided at a downstream side.

Figure 10:
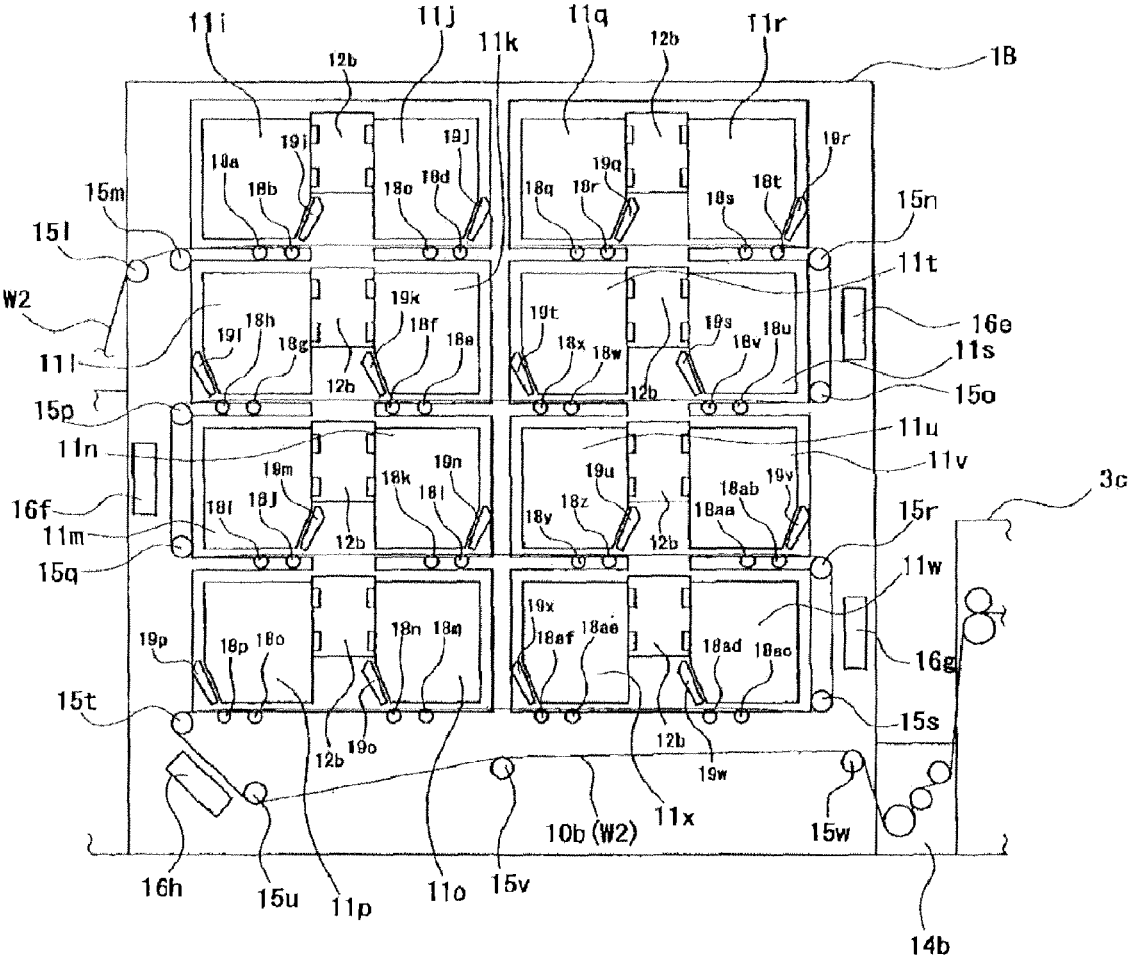
FIG. 10 is a schematic diagram of the ink jet printing unit for a continuous web 1B that is a second embodiment of this invention shown in FIG. 7(*a*).
Figure 1:
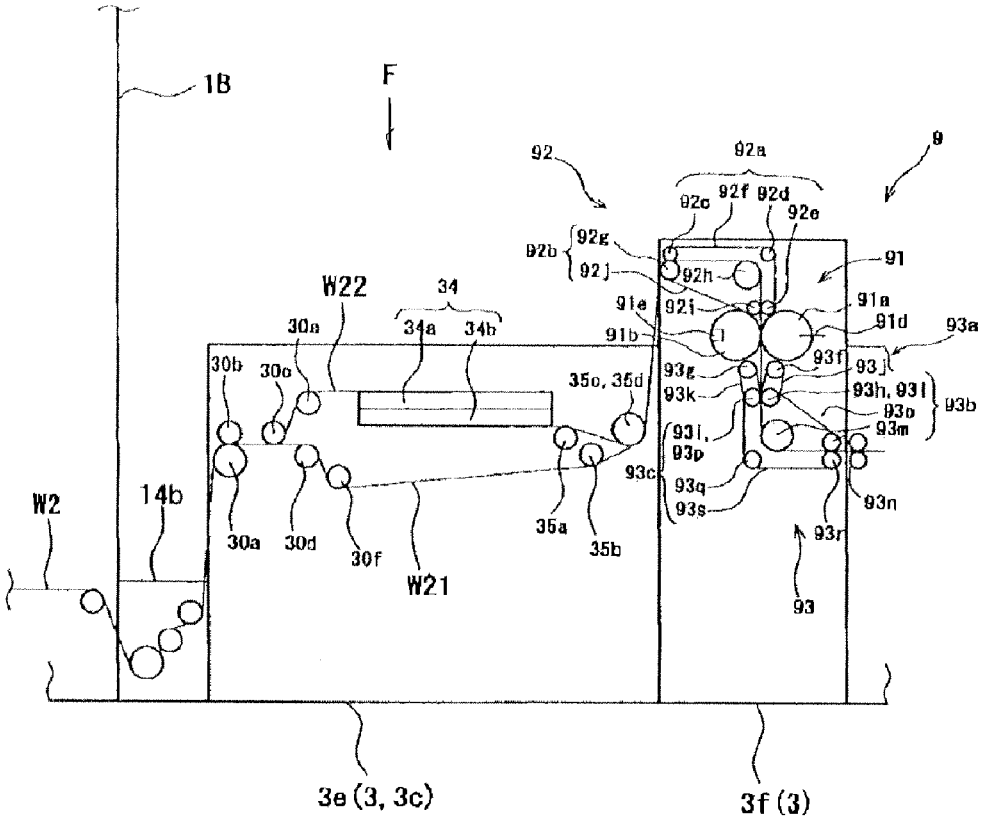
Figure 1:
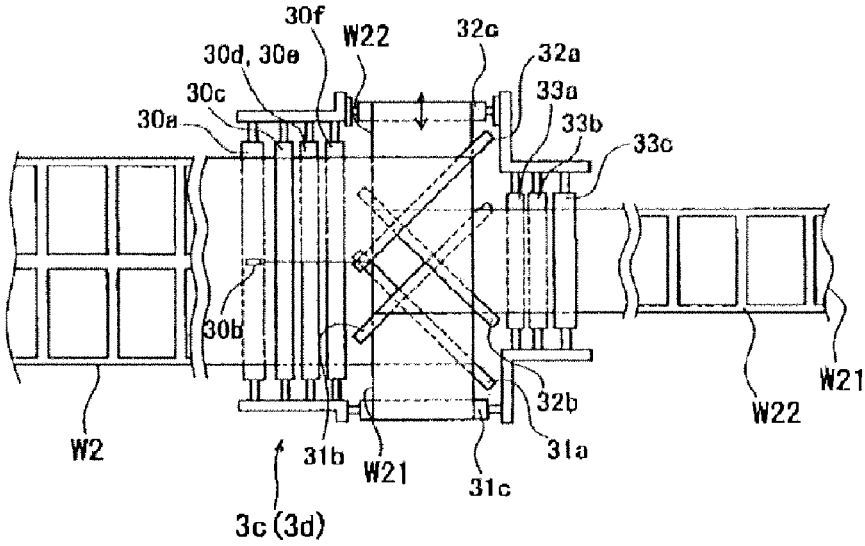
Figure 1:
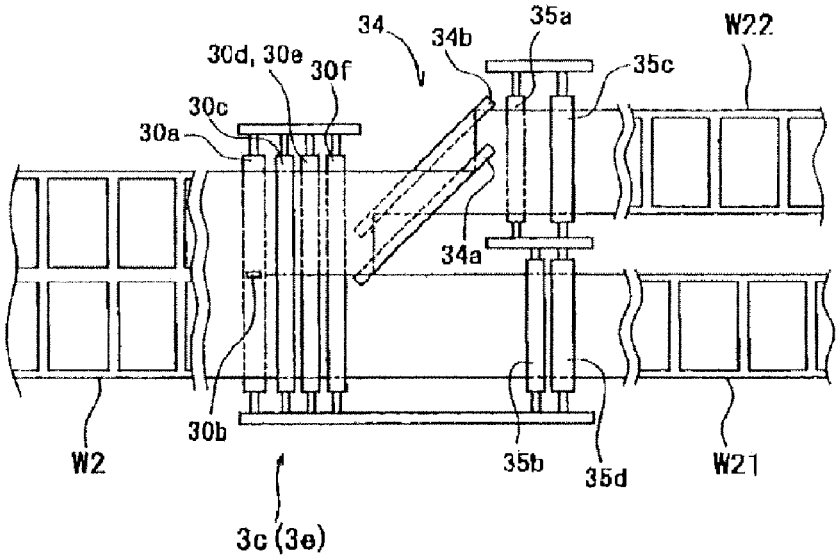
Figure 1:
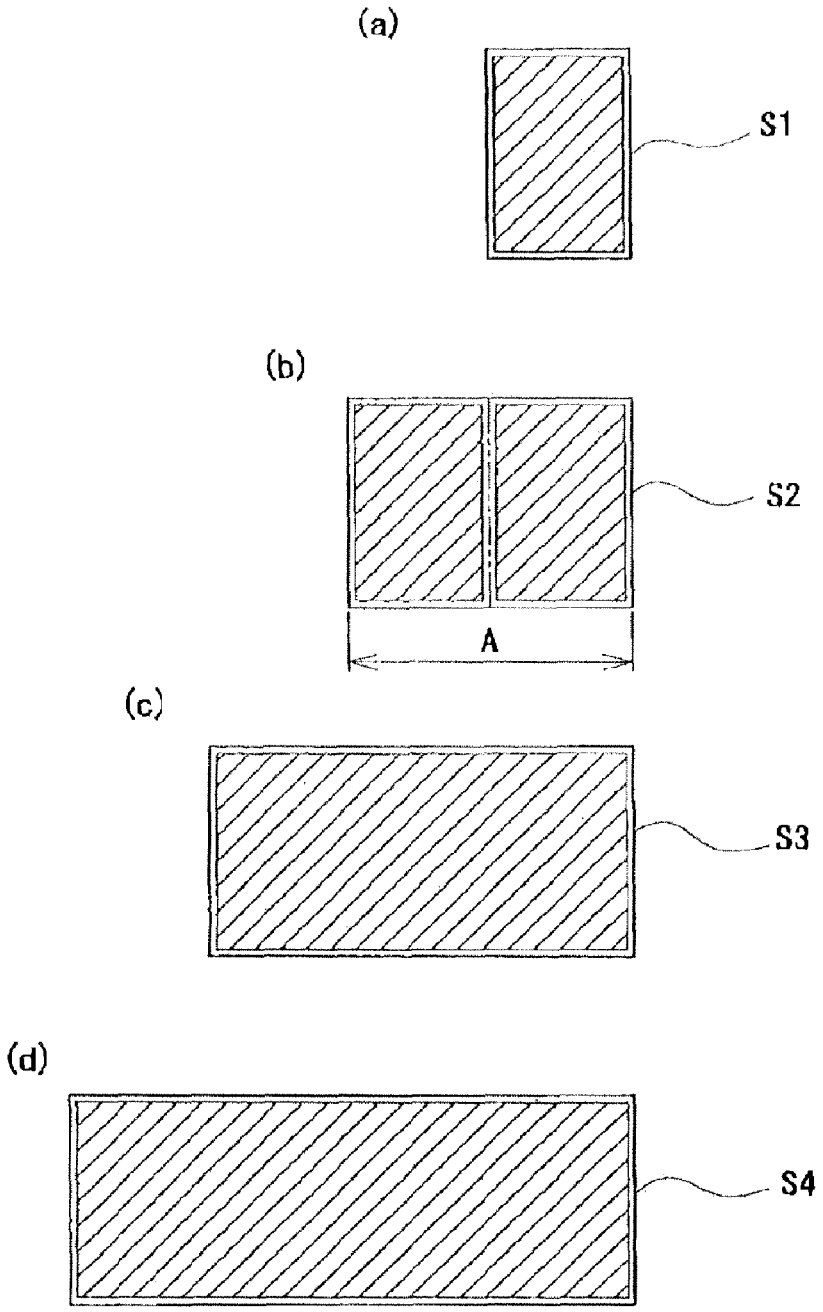
Figure 14:
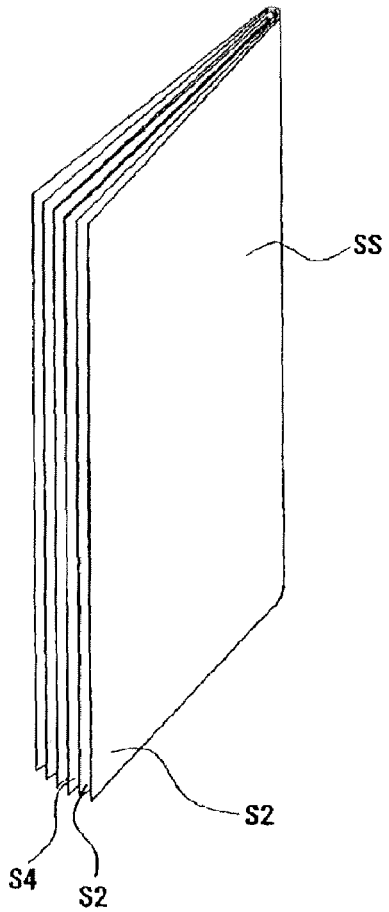
FIG. 14(*a*) is a perspective drawing of a signature SS having a size of one page of a newspaper formed using only 2-page cut sheets S2.
Figure 14:
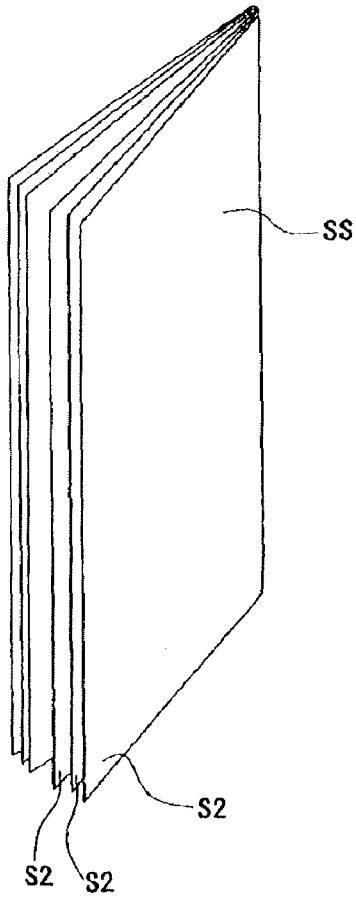
Figure 14:
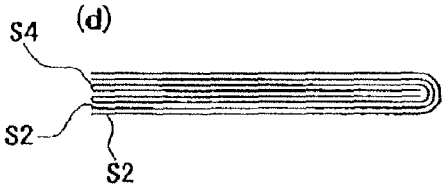
Figure 14:
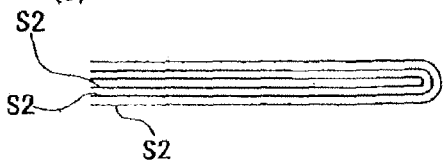

The printing unit for printing on one surface and the other surface of a continuous web 1B has ink jet printing devices 11*i* to 11*x*, having ink jet print heads (not shown) provided with a plurality of ink discharge ports spanning a dimension that is larger than the vertical direction dimension of one page of a newspaper, provided at four vertical levels, with four in each level, that is, arranged two on one side half and two on the other side half in the cross direction of the continuous web W2 corresponding to each half, so that it is possible to respectively print a region corresponding to the vertical dimension of one page of a newspaper, as shown in enlarged form in FIG. 10.

Each of the ink jet printing devices 11*i* to 11*x* is provided so as to having ink discharge openings facing downwards, and at a printing position so that central positions in the cross direction of each ink jet printing devices 11*i* to 11*p* corresponding to the one side half in the cross direction of the continuous web W2 are on substantially the same plane, while central positions in the cross direction of each ink jet printing devices 11*q* to 11*x* corresponding to the other side half in the cross direction of the continuous web W2 are on substantially the same plane, but different from the plane for the ink jet printing devices 11*i* to 11*p*. For example, the printing devices 11*i* to 11*x* are provided so that using a lateral movement unit 12*b* provided with a screw feeding mechanism (not shown), fine movement for lateral register adjustment of the printing image, and large movement between the printing position and a maintenance position (shown by the dashed double-dotted line in FIG. 8 and FIG. 9) for performing maintenance of the ink jet print heads after printing using a maintenance unit 13*b*, is possible.

Also, a plurality of guide rollers 15*l* to 15*w* forming a paper run-through path 10*b* are provided in the printing unit for printing on one surface and the other surface of a continuous web 1B, below the ink jet printing devices 11*j* to 11*x* of each stage, that is, below the ink jet print heads of each stage, so that the continuous web W2 is capable of running sequentially through from the upper stage to the lower stage in a zigzag fashion. Drying units 16*e* to 16*h* are provided respectively facing the paper run-through passages 10*b* spanning between after the paper has passed below the ink jet print heads of the upper stage and below the ink jet print heads of the next stage, and facing the run-through passage 10*b* after running below the ink jet print heads of the lowest stage. In FIG. 10, reference numerals 18*a* to 18*z* and 18*aa* to 18*af* are back-up rollers, 19*i* to 19*x* are suction devices for collecting ink mist that files off at the time of printing, and 14*b* is a feed mechanism for feeding the continuous web W2 to the downstream side.

The continuous web supply unit 2B has a support section 21*b* capable of braking rotation of a continuous web roll R2 of the continuous web W2 of a width conforming to the vertical dimension of two pages of a newspaper, and a tension detecting section 22*b* that is displaced in an oscillating fashion according to traveling tension of the continuous web W2, and the tension detection section 22*b* is provided so that strength of a braking force for braking rotation of the continuous web roll R2 can be automatically adjusted according to the magnitude of detected traveling force of the continuous web W2.

The continuous web supply unit 2B is also provided with a continuous web roll lifting mechanism (not shown) for lifting the continuous web roll R2 at the time of loading the continuous web roll R2 into the support section 21*b*. The continuous web roll lifting mechanism is formed from a link mechanism that has a hydraulic cylinder, for example, as a drive source.

A divided continuous web course changing unit 3*c*, being the processing unit 3B, is provided at a downstream side of the printing unit for printing on one surface and the other surface of a continuous web 1B. The divided continuous web course changing unit 3*c* exists as an embodiment D, being a overlapping unit 3*d* for changing the course of two divided continuous webs W21 and W22 so as to overlap the divided continuous webs W21 and W22, and an embodiment E, being a separation unit 3*e* for changing the course of two divided continuous webs W21 and W22 so as to separate the divided continuous webs W21 and W22.

Embodiment D, where the divided continuous web course changing unit 3*c* is the overlapping unit 3*d*, is shown in FIG. 7(*b*) and FIG. 12(*a*).

The overlapping unit 3*d* is comprised of a drag roller 30*a*, a slitter 30*b*, guide roller 30*c*, 30*d*, 30*e* and 30*f*, guide roller 33*a* and 33*b*, and a delivery roller 33*c*.

The drag roller 30*a* is driven to rotate by a not shown drive source, and draws in a continuous web W2 that has been printed by the printing unit for printing on one surface and the other surface of a continuous web 1B and fed by the feed mechanism 14*b*. The slitter 30*b* forms two divided continuous webs W21 and W22 of a width conforming to the vertical dimension of one newspaper page by cutting the continuous web W2 that has been drawn in by the drag roller 30*a* at the center in the cross direction, parallel to the longitudinal direction, on the drag roller 30*a*. The guide roller 30*c*, 30*d*, 30*e* and 30*f* respectively guide the divided continuous web W21 to a turn bar section 31, and the divided continuous web W22 to a turn bar section 32. The guide rollers 33*a* and 33*b* overlap the divided continuous webs W21 and W22 whose course has been changed by the turn bar sections 31 and 32 at a central part in the cross direction of the overlapping unit 3*d*, and guide them towards the downstream side cutting unit 3*f*. The delivery roller 33*c* is driven by a not shown drive source, and delivers the overlapped continuous webs W21 and W22 to a downstream side.

The turn bar section 31 is provided with an upstream turn bar 31*a* and a downstream turn bar 31*b* for changing the traveling direction of the divided continuous web W21 in a state parallel to the paper surface through 90 degrees, and a guide roller 31*c*, provided between the two turn bars, changing the travel direction of the divided continuous web W21 that has passed the upstream turn bar 31*a* by 180 degrees, and guiding towards the downstream turn bar 31*b*. The upstream turn bar 31*a* and the downstream turn bar 31*b* are provided in a mechanical relationship at right angles to each, as shown in FIG. 12(*a*). The turn bar section 32 is provided with an upstream turn bar 32*a* and a downstream turn bar 32*b* for changing the traveling direction of the divided continuous web W22 by 90 degrees in a state parallel to the paper surface, and a guide roller 32*c*, provided between the two turn bars, for changing the travel direction of the divided continuous web W22 that has passed the upstream turn bar 32*a* by 180 degrees, and guiding towards the downstream turn bar 32*b*. The turn bar section 32 is further provided with a traveling path length adjustment section (not shown) for adjusting the traveling path length for the divided continuous web W22 by moving a position of the guide roller 32*c* parallel to the travel direction of the divided continuous web W22 traveling towards the guide roller 32 (direction shown by arrows in FIG. 12(*a*)), so that page positions of the newspaper are aligned with each other when the two divided continuous webs W21 and W22 are overlapped. The upstream turn bar 32*a* and the downstream turn bar 32*b* are provided in a mechanical relationship at right angles to each, as shown in FIG. 12(*a*).

Embodiment E, where the divided continuous web course changing unit 3*c* is the separating unit 3*e*, is shown in FIG. 11 and FIG. 12(*b*).

The separating unit 3*e* is comprised of a drag roller 30*a*, a slitter 30*b*, guide rollers 30*c*, 30*d*, 30*e* and 30*f*, guide rollers 35*a* and 35*b*, and delivery rollers 35*c* and 35*d*.

The drag roller 30*a* is driven to rotate by a not shown drive source, and draws in a continuous web W2 that has been printed by the printing unit for printing on one surface and the other surface of a continuous web 1B and fed by the feed mechanism 14*b*. The slitter 30*b* forms two divided continuous webs W21 and W22 of a width conforming to the vertical dimension of one newspaper page by cutting the continuous web W2 that has been drawn in by the drag roller 30*a* at the center in the cross direction, parallel to the longitudinal direction, on the drag roller 30*a*.

The guide rollers 30*c*, 30*d*, 30*e* and 30*f* respectively guide the divided continuous web W21 as is to a downstream side guide roller 35*b*, and guide the divided continuous web W22 to a turn bar section 34. The guide roller 35*b* guides the divided continuous web W21 that travels straight on after cutting by the slitter 30*b* towards the downstream cutting unit 3*f*. The guide roller 35*a* guides the divided continuous web W22 that has had its course changed by the turn bar section 34 and travels parallel to the divided continuous web W21, towards a separate downstream side cutting unit 3*f* that is provided alongside the cutting unit 3*f* that the divided continuous web W21 has been guided to, so as to separate the divided continuous web W22 from the divided continuous web W21 traveling straight to 35*b* after being cut. The delivery roller 35*d* is driven by a not shown drive source, and delivers the divided continuous web W21 to a downstream side, while the delivery roller 35*c* is driven by a not shown drive source and delivers the divided continuous web W22 to a downstream side.

The turn bar section 34 is provided with an upstream turn bar 34*a* and a downstream turn bar 34*b* for changing the travel direction of the divided continuous web W22 through 90 degrees in a state parallel to the paper surface. The upstream turn bar 34*a* and the downstream turn bar 34*b* are provided in a mechanical relationship at parallel to each other, as shown in FIG. 12(*b*). The cutting unit 3*f* that is downstream of the separating unit 3*e*, and the folding unit 3*b* provided at the downstream side of the cutting unit 3*f*, are provided respectively corresponding to either the divided continuous web W21 or the divided continuous web W22. It is also sufficient for the cutting unit 3*f* that is downstream of the separating unit 3*e* to be the cutting and folding unit 3*a* described in relation to the printing unit for printing on one surface and the other surface of a continuous web 1A.

The cutting unit 3*f* has a cutting mechanism 9 as shown in FIG. 7(*b*) and FIG. 11. The cutting mechanism 9 is capable of cutting the divided continuous webs W21 and W22 that have been printed by the printing unit for printing on one surface and the other surface of a continuous web 1B and divided by the overlapping unit 3*d* or the separating unit 3*e*, being the divided continuous web course changing unit 3*c*, and of forming cut sheets Sn of a size of number of newspaper pages laid side by side, namely, for example, a 1-page cut sheet S1 or a 2-page cut sheet S2. The folding unit 3*b* provided at a downstream side of the cutting unit 3*f* is the same as the folding unit 3*b* described in connection with the printing unit for printing on one surface and the other surface of a continuous web 1A.

The cutting mechanism 9 of the cutting unit 3*f* has a cutting section 91, a guide-in section 92, and a delivery feed section 93. The cutting section 91 has a cutter drum 91*a* and a cutter receiving drum 91*b* provided facing each other either side of a traveling path for either one or both of the divided continuous webs W21 and W21 (hereafter referred to as the divided continuous web W21 and/or W22). The guide-in section 92 is provided at an upstream side of the cutting section 91, and allows the divided continuous web W21 and/or W22 that have been delivered from the overlapped unit 3*d* or the separating unit 3*e*, being the divided continuous web course changing unit 3*c*, to travel towards the cutting section 91. The delivery section 93 is provided at a downstream side of the cutting section 91 and delivers the divided continuous web W21 and/or W22 after cutting that have been delivered from the cutting section 91 to a downstream side.

The cutter drum 91*a* of the cutting section 91 is provided with at least one cutter 91*d* at an outer surface, and the cutter receiving drum 91*b* is provided with at least one cutter indent 91*e* at the outer surface. Both drums are provided parallel to each other, parallel to the plane of the traveling continuous web W21 and/or W22, and capable of rotation, being driven around an axis at right angles to the direction of travel of the divided continuous web W21 and/or W22, and cut paper sheets Sn, namely 1-page cut sheets S1 and 2-page cut paper sheets S2, are formed by cutting the divided continuous web W21 and/or W22 traveling between the two drums by meshing the cutter 91*d* and the cutter indent 91*e* as a result of rotation. The cutter drum 91*a* and the cutter receiving drum 91*b* form the cut sheet Sn to a size of one page or to the size of two pages laid side by side, for every cutting out of a sheet Sn, utilizing a cutting section drive source (not shown) operating under the control of control member 4, and are caused to rotate by adjusting rotational speed and rotational phase with respect to travel speed of the divided continuous web W21 and/or W22 so as to cut the divided continuous web W21 and/or W22 at blank sections between pages of the printed newspaper.

The guide-in section 92 has a guide-in upper belt section 92*a* and guide-in lower belt section 92*b* provided either side of the traveling path of the divided continuous web W21 and/or W22.

The guide-in upper belt section 92*a* comprises a plurality of pulley sets 92*c*, 92*d*, and 92*e* that are provided being capable of rotation around an axis parallel to the central axis of the drums of the cutting section 91, each having a predetermined specified number of pulleys being spaced apart spanning in the cross direction of the divided continuous web W21 and/or W22, and an endless belt set 92*f* with each belt in the set being wound around the associated pulleys of these pulley sets 92*c*, 92*d*, and 92*e* that are at the same axial direction position as each other. The guide-in lower belt section 92*b* comprises a plurality of pulley sets 92*g*, 92*h*, and 92*i* that are provided being capable of rotation around an axis parallel to the central axis of the drums of the cutting section 91, each pulley set having a predetermined specified number of pulleys being spaced apart spanning in the cross direction of the divided continuous web W21 and/or W22 so as to be at positions aligned with the pulleys of each pulley set 92*c*, 92*d* and 92*e* of the guide-in upper belt section 92*a*, and an endless belt set 92*j* with each belt in the set being wound around the associated pulleys of these pulley sets 92*g*, 92*h*, and 92*i* that are at the same axial direction position as each other. The pulley set 92*c* of the guide-in upper belt section 92*a* is rotatably driven by a guide-in upper belt section drive source (not shown) that is operated under the control of the control member 4, and the endless belt set 92*f* is rotatably displayed in an anti-clockwise direction in FIG. 7(*b*). The pulley set 92*g* of the guide-in lower belt section 92*b* is rotatably driven by a guide-in lower belt section drive source (not shown) that is operated under the control of the control member 4, and the endless belt set 92*j* is rotatably displayed in a clockwise direction in FIG. 7(*b*). Specifically, each belt of the guide-in upper belt section 92*a* and each belt of the guide-in lower belt section 92*b* face each other across the traveling path of the divided continuous web W21 and/or W22, and the facing sections sandwich the divided continuous web W21 and/or W22 and move at the same relative speed and in the same relative direction.

The delivery section 93 comprises a hopper belt section 93*a*, a delivery upper belt section 93*b* and a delivery lower belt section 93*c* provided either side of the traveling path of the divided continuous web W21 and/or W22.

The hopper belt section 93*a* comprises upstream pulley sets 93*f*, 93*g*, downstream pulley sets 93*h* and 93*i*, an one side endless belt set 93*j* and another side endless belt set 93*k*.

The upstream pulley sets 93*f* and 93*g* are provided with a predetermined specified number of pulleys at intervals spanning in the cross direction of the divided continuous web W21 and/or W22, and capable of rotation around a center axis parallel to the center axis of the drums of the cutting section 91, and are provided facing each other across the traveling path of the divided continuous web W21 and/or W22.

The downstream pulley sets 93*h* and 93*i* are provided with a predetermined specified number of pulleys at intervals spanning in the cross direction of the divided continuous web W21 and/or W22 so as to be at positioned aligned with the pulleys of the upstream pulley sets 93*f* and 93*g*, and capable of rotation around a center axis parallel to the center axis of the drums of the cutting section 91, and are provided facing each other across the traveling path of the divided continuous web W21 and/or W22.

The one side endless belt set 93*j* is wound around associated pulleys of the upstream pulley set 93*f* and the downstream pulley set 93*h*, of one side of the traveling path of the divided continuous web W21 and/or W22, that are aligned with each other in the axial direction. The other side endless belt set 93*k* is wound around associated pulleys of the upstream pulley set 93*g* and the downstream pulley set 93*i*, of the other side of the traveling path of the divided continuous web W21 and/or W22, that are aligned with each other in the axial direction. The upstream pulley sets 93*f* and 93*g* are opposite to each other spaced slightly apart.

The delivery upper belt section 93*b* is comprised of a plurality of pulley sets 93*l*, 93*m* and 93*n*, and an endless belt set 93*o*. The plurality of pulley sets 93*l*, 93*m* and 93*n* are provided with a predetermined specified number of pulleys at intervals spanning in the cross direction of the divided continuous web W21 and/or W22, and capable of rotation around a center axis parallel to the center axis of the drums of the cutting section 91. The endless belt set 93*o* is wound around associated pulleys of these pulley sets 93*l*, 93*m*, and 93*n* that have axial positions aligned with each other.

The delivery lower belt section 93*c* is comprised of a plurality of pulley sets 93*p*, 93*q* and 93*r*, and an endless belt set 93*s*.

The plurality of pulley sets 93*p*, 93*q* and 93*r* are provided with a predetermined specified number of pulleys at intervals spanning in the cross direction of the divided continuous web W21 and/or W22 so as to be at positions aligned with pulleys of each of the pulley sets 93*l*, 93*m* and 93*n* of the delivery upper belt section 93*b*, and capable of rotation around a center axis parallel to the center axis of the drums of the cutting section 91. The endless belt set 93*s* is wound around associated pulleys of these pulley sets 93*p*, 93*q*, and 93*r* that have axial positions aligned with each other.

The pulley set 93*l* of the delivery upper belt section 93*b*, and the downstream pulley set 93*h* of the hopper belt section 93*a*, are rotatably driven together by a delivery upper belt section drive source, not shown, provided on the same rotational axis and operated under control of the control member 4, with the pulley set 93*l* rotatably displacing the endless belt set 93*o* in an anti-clockwise direction in FIG. 7(*b*), and the downstream pulley set 93*h* rotatably displacing the one side endless belt set 93*j* in an anti-clockwise direction in FIG. 7(*b*). Also, the pulley set 93*p* of the delivery lower belt section 93*c*, and the downstream pulley set 93*i* of the hopper belt section 93*a*, are rotatably driven together by a delivery lower belt section drive source, not shown, provided on the same rotational axis and operated under control of the control member 4, with the pulley set 93*p* rotatably displacing the endless belt set 93*s* in a clockwise direction in FIG. 7(*b*), and the downstream pulley set 93*i* rotatably displacing the other side endless belt set 93*k* in a clockwise direction in FIG. 7(*b*). Specifically, each belt of the one side endless belt set 93*j* and the other side endless belt set 93*k* of the hopper belt section 93*a* face each other across the traveling path of the divided continuous web W21 and/or W22, and the facing sections sandwich the divided continuous web W21 and/or W22 and move at the same relative speed and in the same relative direction. Also, each belt of the endless belt set 93*o* of the delivery upper belt section 93*b* and each belt of the endless belt set 93*s* of the delivery lower belt section 93*c* face each other across the traveling path of the divided continuous web W21 and/or W22, and the facing sections sandwich the divided continuous web W21 and/or W22 and move at the same relative speed and in the same relative direction. Accordingly, each belt of the hopper belt section 93*a*, each belt of the delivery upper belt section 93*b* and each belt of the delivery lower belt section 93*c* have opposed sites that are movably displaced at either side of the traveling path of the divided continuous web W21 and/or W22 that are displaced at the same relative speed and in the same relative direction. Still further, the guide in upper belt section drive source (not shown) and the guide in lower belt drive source (not shown) of the guide in section 92, together with the delivery upper belt section drive source (not shown) and the delivery lower belt section drive source (not shown) of the delivery section 93, are controlled by the control member 4 so moving displacement speed of each belt is the same.

The control member 4 has input means 41, connected to several units of the newspaper production systems (SA, SB), namely to the printing unit for printing on one surface and the other surface of a continuous web 1 (1A, 1B), a continuous web supply unit 2 (2A, 2B), and the processing unit 3 (3A, 3B), and is input with newspaper fabrication specifications, etc., for operating the newspaper production system S, as shown in FIG. 1. Travel speed of the continuous webs W1, W2 and the divided continuous webs W21, W22, and rotational speed of the rotating sections, are detected based on required control signals from the several units, for example, pulse signals corresponding to operation amounts for drive sources and operation amounts for rotating center axes output from rotary encoders (not shown) linked to appropriate drive sources or appropriate center axes, and movement distances of the continuous webs W1, W2 and the divided continuous webs W21, W22 are detected and movement positions tracked, and newspapers produced based on newspaper fabrication specifications etc. previously input via the input means 41 while confirming that the arrival of continuous webs W1, W2, divided continuous webs W21, W22 and cut sheets Sn, or the passage of cut sheets Sn, using detectors provided at appropriate positions, for example, photoelectric detectors (not shown).

The control member 4 therefore adjusts operating timing etc. of the printing unit for printing on one surface and the other surface of a continuous web 1 (1A, 1B), the continuous web supply unit 2 (2A, 2B), and of the cutting and folding unit 3*a*, the folding unit 3*b*, the divided continuous web course changing unit 3*c* (overlapping unit 3*d* or separation unit 3*e*) and the cutting unit 3*f*, being each of the processing units 3 (3A, 3B), to control driving of each unit, and adjusts various operation timing between each unit.

Next, operation of the above described structure and a newspaper production method will be described.

With a newspaper production method using the newspaper production system SA that is the first embodiment shown in FIG. 2 to FIG. 5(*b*) newspaper fabrication specifications are input in advance from the input means 41 to the control member 4, before any printing operations. The newspaper fabrication instructions are, for example, number of pages constituting a single newspaper to be produced, image data for each page, size of cut sheet that are stacked, designation of cut sheet folding conditions, and cut sheet stacking order, etc. As a result of an operation start signal after input of the newspaper fabrication specifications, the following operations are carried out.

A continuous web W1 that is drawn out from a continuous web roll R1 loaded in the continuous web supply unit 2A provided at an upstream side, and that has been subjected to tension adjustment based on detection results of a tension detection section 22*a*, reaches the printing unit for printing on one surface and the other surface of a continuous web 1A, and is guided by the guide rollers 15*a*, 15*b* and 15*c* to travel substantially horizontally below the ink jet printing devices of the uppermost level, and between the ink jet print heads of each of the ink jet printing devices 11*a* and 11*b*, and the back up rollers 17*a*, 17*b*, 17*c* and 17*d*.

The continuous web W1 has one surface that faces upwards during this passage printed with a first ink, for example a yellow printed image, by the ink jet printing device 11*a*, and with a second ink, for example cyan printed image, by the ink jet printing device 11*b*. A first ink printing to one surface start signal is output from the control member 4 to the ink jet printing device 11*a* at an appropriate timing, and a second ink printing start signal is output from the control member 4 to the ink jet printing device 11*b* at a timing that is determined based on the printed image using the first ink that it is should be in register with, length of a passage 10*a* between installation of the ink jet printing device 11*a* and the ink jet printing device 11*b*, and travel distance of the continuous web W1. The continuous web W1 that has passed below the ink jet printing devices 11*a* and 11*b* has its travel direction changed to downward by the guide roller 15*c* that contacts the other surface, being the rear surface, to the surface that was printed by the ink jet printing units 11*a* and 11*b*, and also, similarly, the travel direction is changed to the opposite of when traveling below the ink jet print devices 11*a* and 11*b* of the uppermost level using the guide roller 15*d* that is in contact with the other surface, to turn the continuous web over. During travel between the guide rollers 15*c* and 15*d*, one surface that been printed by the ink jet printing devices 11*a* and 11*b* faces the drying unit 16*a*, and the printed image printed by the ink jet printing devices 11*a* and 11*b* is dried.

The continuous web W1 that has a printed image that was printed by the ink jet printing devices 11*a* and 11*b* dried and has been turned over together with having travel direction changed by the guide roller 15*d* is guided by the guide rollers 15*d* and 15*e* so as to pass from above to below the ink jet printing devices 11*c* and 11*d* of the second level, and travel substantially horizontally between the ink jet print heads of the ink jet printing devices 11*c* and 11*d* and the backup rollers 17*e*, 17*f*, 17*g* and 17*h*, and the other surface that is facing upwards at that time is printed with a first ink, for example, yellow printed image, by the ink jet printing device 11*c*, and a second ink, for example cyan printed image, by the ink jet printing device 11*d*. A start signal for printing of first ink to the other surface is output from the control member 4 to the ink jet printing device 11*c* at a timing determined based on position of each page of a newspaper having one side printed and position of each page of a newspaper printed on the other surface it should be in register with, length of a through passage 10*a* between the ink jet printing device 11*a* and the ink jet printing device 11*c*, and travel distance of the continuous web W1, and a start signal for printing second ink is output from the control member 4 to the ink jet printing device 11*d* at a timing determined based on printed image by the first ink that it should be in register with, length of a through passage 10*a* between the ink jet printing device 11*a* and the ink jet printing device 11*d*, and travel distance of the continuous web W1.

Next, the continuous web W1 that has passed below the ink jet printing devices 11*c* and 11*d* has its travel direction changed to downward by the guide roller 15*e* that contacts the one surface, being the rear surface, to the surface that was printed by the ink jet printing devices 11*c* and 11*d*, and also, similarly, the travel direction is changed to the same direction as when traveling below the ink jet print devices 11*a* and 11*b* of the uppermost level using the guide roller 15*f* that contacts the one surface, to turn the continuous web W1 over again. During travel between the guide rollers 15*e* and 15*f*, the other surface that has been printed by the ink jet printing devices 11*c* and 11*d* faces the drying unit 16*b*, and the printed image printed by the ink jet printing devices 11*c* and 11*d* is dried. When guiding this continuous web W1, the guide rollers 15*e* and 15*f* contact one surface of the continuous web W1, but a printed image printed by the ink jet printing devices 11*a* and 11*b* on this one surface has been dried by the drying unit 16*a*, and so print quality of that printed image is not affected by contact of the guide rollers 15*e*, 15*f* with the continuous web W1. The continuous web W1 that has been turned over again together with having travel direction changed by the guide roller 15*f* is guided by the guide rollers 15*f* and 15*g* so as to pass from above to below the ink jet printing devices 11*e* and 11*f* of the third level, and travel substantially horizontally between the ink jet print heads of the ink jet printing devices 11*e* and 11*f* and the backup rollers 17*i*, 17*j*, 17*k* and 17*l*, and the one surface that is facing upwards at that time is printed with a third ink, for example, magenta printed image, by the ink jet printing device 11*e*, and a fourth ink, for example black printed image, by the ink jet printing device 11*f*. A start signal for printing of third ink to the one surface is output from the control member 4 to the ink jet printing device 11*e* at a timing determined based on printed image by the first ink and printed image by the second ink it should be in register with, length of a through passage 10*a* between installation of the ink jet printing device 11*a* and the ink jet printing device 11*e*, and travel distance of the continuous web W1, and a start signal for printing fourth ink is output from the control member 4 to the ink jet printing device 11*f* at a timing determined based on printed image by the first ink and printed image by the second ink and printed image by the third ink that it should be in register with, length of a through passage 10*a* between the ink jet printing device 11*a* and the ink jet printing device 11*f*, and travel distance of the continuous web W1. As a result of this printing, printing to the one surface using four inks is completed.

The continuous web W1 for which printing using four inks on one surface is completed has its travel direction changed to downward by the guide roller 15*g* that contacts the other surface, being the rear surface, of the surface that was printed by the ink jet printing devices 11*e* and 11*f*, and also, similarly, the travel direction is changed to the same as when traveling below the ink jet print devices 11*c* and 11*d* of the second level using the guide roller 15*h* that contacts the other surface, to turn the continuous web W1 over three times. During travel between the guide rollers 15*g* and 15*h*, one surface that been printed by the ink jet printing devices 11*e* and 11*f* faces the drying unit 16*c*, and the printed image printed by the ink jet printing devices 11*e* and 11*f* is dried. When guiding this continuous web W1, the guide rollers 15*g* and 15*h* contact the other surface of the continuous web W1, but a printed image printed by the ink jet printing devices 11*c* and 11*d* on this other surface has been dried by the drying unit 16*b*, and so print quality of that printed image is not affected by contact of the guide rollers 15*g*, 15*h* with the continuous web W1. The continuous web W1 that has been turned over a third time together with having travel direction changed by the guide roller 15*h* is guided by the guide rollers 15*h* and 15*i* so as to pass below the ink jet printing devices 11*g* and 11*h* of the lower level, and travel substantially horizontally between the ink jet print heads of the ink jet printing devices 11*g* and 11*h* and the backup rollers 17*m*, 17*n*, 17*o* and 17*p*, and the other surface that is facing upwards at that time is printed with a third ink, for example, magenta printed image, by the ink jet printing device 11*g*, and a fourth ink, for example black printed image, by the ink jet printing device 11*h*. A start signal for printing of third ink to the other surface is output from the control member 4 to the ink jet printing device 11*g* at a timing determined based on printed image by the first ink and printed image by the second ink it should be in register with, length of a through passage 10*a* between installation positions of the ink jet printing device 11*a* and the ink jet printing device 11*g*, and travel distance of the continuous web W1, and a start signal for printing fourth ink is output from the control member 4 to the ink jet printing device 11*h* at a timing determined based on printed image by the first ink and printed image by the second ink and printed image by the third ink that it should be in register with, length of a through passage 10*a* between installation positions of the ink jet printing device 11*a* and the ink jet printing device 11*h*, and travel distance of the continuous web W1. As a result of this printing, printing to the other surface using four inks is completed.

In the above-disclosed printing operation, if the printing for a printed image using each ink for every surface is out of register, the respective registers are adjusted. Specifically, getting printing in register for continuation direction of the continuous web W1 is carried out by performing control by means of the control member 4 so that discharge timing of ink from the ink jet print heads of each of the ink jet print devices 11*a* to 11*h* is advanced or delayed, and achieving in register for the cross direction of the continuous web W1 is done by moving the ink jet printing devices 11*a* to 11*h* slightly using the lateral moving unit 12*a*. Also, ink mist arising as a result of discharge from the ink jet print heads and impacting on the continuous web W1 is collected by suction devices 19*a* to 19*h* provided at a downstream side in the travel direction of the continuous web W1 for every ink jet printing device 11*a* to 11*h*.

The continuous web W1 for which printing using four inks on the other surface is completed, that is, the continuous web W1 for which printing using four inks has been completed for both surfaces, has its travel direction changed to downward by the guide roller 15*i* that contacts the one surface, being the rear side, of the surface that was printed by the ink jet printing devices 11*g* and 11*h*, and also, similarly, the travel direction is changed to substantially the same as when traveling below the ink jet printing devices 11*a* and 11*b* of the uppermost level using the guide roller 15*j* that contacts the other surface, to turn the continuous web W1 over a fourth time. During travel between the guide rollers 15*i* and 15*j*, the other surface that has been printed by the ink jet printing devices 11*g* and 11*h* faces the drying unit 16*e*, and the printed image printed by the ink jet printing devices 11*g* and 11*h* is dried. When guiding this continuous web W1, the guide rollers 15*i* and 15*j* contact one surface of the continuous web W1, but a printed image printed by the ink jet printing devices 11*e* and 11*f* on this one surface has been dried by the drying unit 16*c*, and so print quality of that printed image is not affected by contact of the guide rollers 15*i*, 15*j* with the continuous web W1. The continuous web W1 that has been turned over a fourth time together with having the travel direction changed by the guide roller 15*j* is guided by the guide rollers 15*j* and 15*k*, and further delivered to the cutting and folding unit 3*a*, being the processing unit 3 provided at a downstream side of the printing unit for printing on one surface and the other surface of a continuous web 1A, by the feed delivery mechanism 14*a*.

The continuous web W1 that has been delivered to the cutting and folding unit 3*a* is made to travel between the endless belt set 52*f* of the guide in upper belt section 52*a* and the endless belt set 52*j* of the guide in lower belt section 52*b* of the guide in section 52, and passes between the cutter drum 51*a* and cutter receiving drum 51*b* of the cutting section 51 to reach the delivery section 53. The continuous web W1 that has reached the delivery section 53 passes between the two upstream pulley sets 53*f* and 53*g* provided spaced slightly far apart facing the hopper belt section 53*a*, to be sandwiched by the one side endless belt set 53*j* and the other side endless belt set 53*k*, and further continues on to the hopper belt section 53*a*, is sandwiched by the endless belt set 53*o* of the delivery upper belt section 53*b* and the endless belt set 53*s* of the delivery lower belt section 53*c*, and reaches the path switching section 53*e* for the direct traveling path provided horizontally while being constrained at least vertically by the one side constraining member 53*v* and the other side constraining member 53*w*.

The cutter drum 51*a* and the cutter receiving drum 51*b* of the cutting section 51 form cut sheets Sn by cutting the continuous web W1 in accordance with the size of the cut sheets stacked according to the newspaper fabrication specifications input to the control member 4. For example, when the cutter drum 51*a* and the cutter receiving drum 51*b* are configured so that when the speed of the peripheral surface is the same as the travel speed of the continuous web W1 the continuous web W1 is cut to a length that is the width dimension of one newspaper page, the control member 4, each time a cut sheet Sn is formed, carries out control to cause the cutter drum 51*a* and the cutter receiving drum 51*b* to rotate with a peripheral speed that is the same as the travel speed of the continuous web W1 when designation of the newspaper fabrication specification is a 1-page cut sheet S1, cause the cutter drum 51*a* and the cutter receiving drum 51*b* to rotate with a peripheral speed that is half the travel speed of the continuous web W1 when designation of the newspaper fabrication specification is a 2-page cut sheet S2, cause the cutter drum 51*a* and the cutter receiving drum 51*b* to rotate with a peripheral speed that is a third the travel speed of the continuous web W1 when designation of the newspaper fabrication specification is a 3-page cut sheet S3, and cause the cutter drum 51*a* and the cutter receiving drum 51*b* to rotate with a peripheral speed that is a quarter the travel speed of the continuous web W1 when designation of the newspaper fabrication specification is a 4-page cut sheet S4. Also, cutting using the cutter 51*d* of the cutter drum 51*a* and the cutter indent 51*e* of the cutter receiving drum 51*b* is required to be aligned with blank sections between adjacent newspaper pages printed on the continuous web W1. Accordingly, rotational phase of the cutter drum 51*a* and the cutter receiving drum 51*b* is determined with a structure that detects specified positions of a printed image on the paper surface of the continuous web W1 delivered from the feed mechanism 14*a*, and based on a paper passage length from that detected position to a position where the cutter 51*d* of the cutter drum 51*a* and the cutter indent 51*e* of the cutter receiving drum 51*b* mesh.

The continuous web W1 that has reached the path switching section 53*e* reaches the delivery roller 53*d* by advancing the path switching section 53*e* along the straight traveling path in accordance with the size of the formed cut sheet Sn, and is sandwiched by the upper roller section 53*t* and the lower roller section 53*u*, and is further divided into 1-page cut sheets S1 and 2-page cut sheets S2 that reach the folding unit 3*b*, being the processing unit 3 provided downstream, and 3-page cut sheets S3 and 4-page cut sheets S4 that reach the pre-folding mechanism 6 as a result of being guided by the path switching member 53*y* that swings about axis 53*x* as a pivot point. Specifically, if a leading end formed by the cutting section 51 reaches the path switching section 53*e*, when that leading end is of a 1-page cut sheet S1 or a 2-page cut sheet S2, the 1-page cut sheet S1 or the 2-page cut sheet S2 are brought to the folding unit 3*b* by the straight traveling path, and if the leading section is that of a 3-page cut sheet S3 or a 4-page cut sheet S4 then the straight traveling path is blocked off by operation of the path switching member 53*y*, together with opening of the start end of the pre-folding guide path 6*a* of the pre-folding mechanism 6 (refer to FIG. 6(*e*)), and the 3-page cut sheet S3 or the 4-page cut sheet S4 is brought to the pre-folding guide path 6*a*. An operation signal for the path switching member 53*y* is output from the control member 4 to the operating control section of a drive source (not shown) at a timing that is determined based on a paper path length between a position where the cutter 51*d* of the cutter drum 51*a* and the cutter indent 51*e* of the cutter receiving drum 51*b* mesh, and a free end position of the path switching member 53*y*, and travel distance of the continuous web W1.

Operation of the cutting and folding unit 3*a* will be described in more detail with reference to FIG. 6(*a*) to FIG. 6(*h*).

The continuous web W1 that has been delivered to the cutting and folding unit 3*a* is cut by the cutting mechanism 5. A leading end of a 4-page cut sheet S4 that has a trailing end formed by this cutting passes a position of the leading side folding section 6*b* and advances to the first support path 6*e* having a length corresponding to the width dimension of one newspaper page (refer to FIG. 6(*a*)).

If the leading end of the 4-page sheet S4 passes a position of the leading side folding section 6*b*, and advances to the first support path 6*e* by a length corresponding to the width dimension of one newspaper page, the folding blade 6*h* of the leading side folding section 6*b* is operated to insert the middle part between the leading side first page and the second page of the 4-page cut sheet S4 between the folding roller pair 6*i* rotating in the direction shown by the arrows in the drawing. The 4-page cut sheet S4 that has been inserted between the folding roller pair 6*i* by operation of the folding blade 6*h* has the inserted part folded as a leading side fold, and the leading side fold passes a position of the trailing side folding section 6*c* and approaches the second support path 6*f*. Also, the rotation direction of the paper feed roller mechanism 6*g* of the first support path 6*e* is reversed with operation of the folding blade 6*h*, and a leading end side of the 4-page cut sheet S4 that has entered the first support path 6*e* is sent out from the first support path 6*e* (refer to FIG. 6(*b*)).

The 4-page cut sheet S4 whose leading side fold line passes the position of the trailing side folding section 6*c* and that has entered into the second support path 6*f* has its leading side fold pass the position of the trailing side folding section 6*c*, and enters into the second support path 6*f* having a length corresponding to the width dimension of two newspaper pages. Also, while this is happening, a leading end of a 2-page cut sheet S2 following on from the 4-page cut sheet S4 that has had the leading end formed by the cutting passes through the path switching section 53*e*. At the time of this passage, the path switching member 53*y* operates to open up the straight travel bath, and the start end of the pre-folding guide path 6*a* of the pre-folding mechanism 6 is blocked off. As a result, the 2-page cut sheet S2 following on from the 4-page cut sheet S4 is guided into the straight traveling path, and is sandwiched by the upper roller section 53*t* and the lower roller section 53*u* of the delivery roller section 53*d* rotating in the directions shown by arrows in the drawing, and delivered to the folding unit 3*b* (refer to FIG. 6(*c*)).

If the leading side fold of the 4-page sheet S4 passes a position of the trailing side folding section 6*c*, and advances to the second support path 6*f* having a length corresponding to the width dimension of two newspaper pages, the folding blade 6*l* of the trailing side folding section 6*c* is operated to insert the middle part between the leading side third page and the fourth page of the 4-page cut sheet S4, that is the middle of the first page and the second page of the trailing side, between the folding roller pair 6*m* rotating in the directions shown by the arrows in the drawing. The 4-page cut sheet S4 that has been inserted between the folding roller pair 6*m* by operation of the folding blade 6*l* has the inserted part folded as a trailing side fold, and the trailing side fold is advanced towards the rear end of the pre-folding guide path 6*a*. Also, the drive direction of the paper feed roller mechanism 6*g* of the second support path 6*f* is reversed with operation of the folding blade 6*l*, and a leading side fold line side of the 4-page cut sheet S4 that has entered the second support path 6*f* is delivered from the second support path 6*f* (refer to FIG. 6(*f*)). Still further, together with forming the trailing end of the next 2-page cut sheet S2 that follows on from the 2-page cut sheet S2 that has been guided into the straight traveling path and reached the folding unit 3*b* by the cutting mechanism 5 while this has been going on, the leading end of the next 2-page cut sheet S2 passes through the path switching section 53*e* and is guided into the straight traveling path continuing on from the leading 2-page cut sheet S2, and is delivered to the folding unit 3*b* by the delivery roller section 53*d* (refer to FIG. 6(*d*)).

The 4-page cut sheet S4 that has been folded at a trailing side fold line has the trailing side fold made leading in the traveling direction and is further advanced towards the rear end of the pre-folding guide passage 6*a*, with the inside of the trunk passages 6*d* further upstream than the trailing side folding section 6*c* becoming empty. Also, as a result of this advancement, the leading end of the 4-page cut sheet S4 positioned in the center of the 4-page cut sheet by formation of the leading side fold passes through the folding roller pair 6*m*, but at that time an appropriate not shown guide member is actuated so that the leading end of the 4-page cut sheet S4 advances between the folding roller pair 6*m* without delay and without the occurrence of any problems such as unnecessary folding. Also, the trailing end of the next 2-page cut sheet S2 reaches the position of the path switching section 53*e*. At this time, when the newspaper fabrication specifications dictate that the cut sheet Sn continuing on from the next 2-page cut sheet S2 is a 4-page cut sheet S4, the path switching member 53*y* of the path switching section 53*e* is operated to block off the straight travel passage while raising up the trailing end of the next 2-page cut sheet S2, together with opening the start end of the pre-folding guide path 6*a*. Specifically, with the illustrated cutting and folding unit 3*a*, it is possible to form and pre-fold a new 4-page cut sheet S4 for every two formations of 2-page cut sheets S2 (refer to FIG. 6(*e*)).

The 4-page cut sheet S4 that has been folded with a trailing side fold has its trailing side fold reach the rear end of the pre-folding guide path 6*a*. While this is happening, the leading end of the next 4-page cut sheet S4 is advanced to the pre-folding guide path 6*a*. As required, the 4-page cut sheet S4 that has been folded with a trailing side fold may be held in position if its trailing side fold reaches the rear end of the pre-folding guide path 6*a*. Accordingly, it is also possible to form and pre-fold a 4-page cut sheet S4 after two or more 2-page cut sheets S2 have been formed. In the event of holding, the paper feed roller mechanism 6*g* is stopped (refer to FIG. 6(*f*)).

Figure 6:
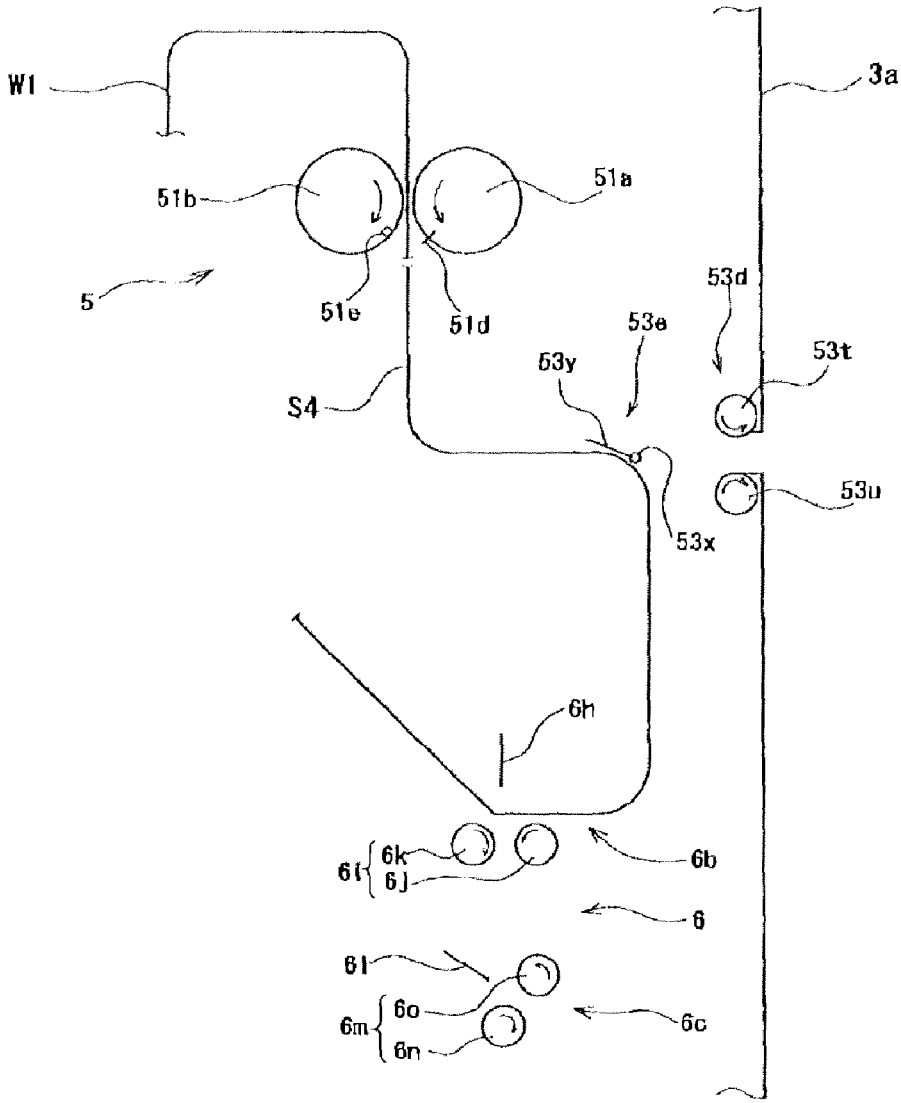
FIG. 6(*a*) to FIG. 6(*h*) are schematic drawings showing aspects of pre-folding of a cut sheet S4 having a size of four pages of a newspaper laid out sideways to a size of the width of two newspapers laid side by side by folding the two side pages inwards, using a pre-folding mechanism 6 of the cutting and folding mechanism 3*a* that is one of the processing units 3A shown in FIG. 2, together with main parts of the pre-folding mechanism 6, in sequence, viewed from the side of the paper.
Figure 6:
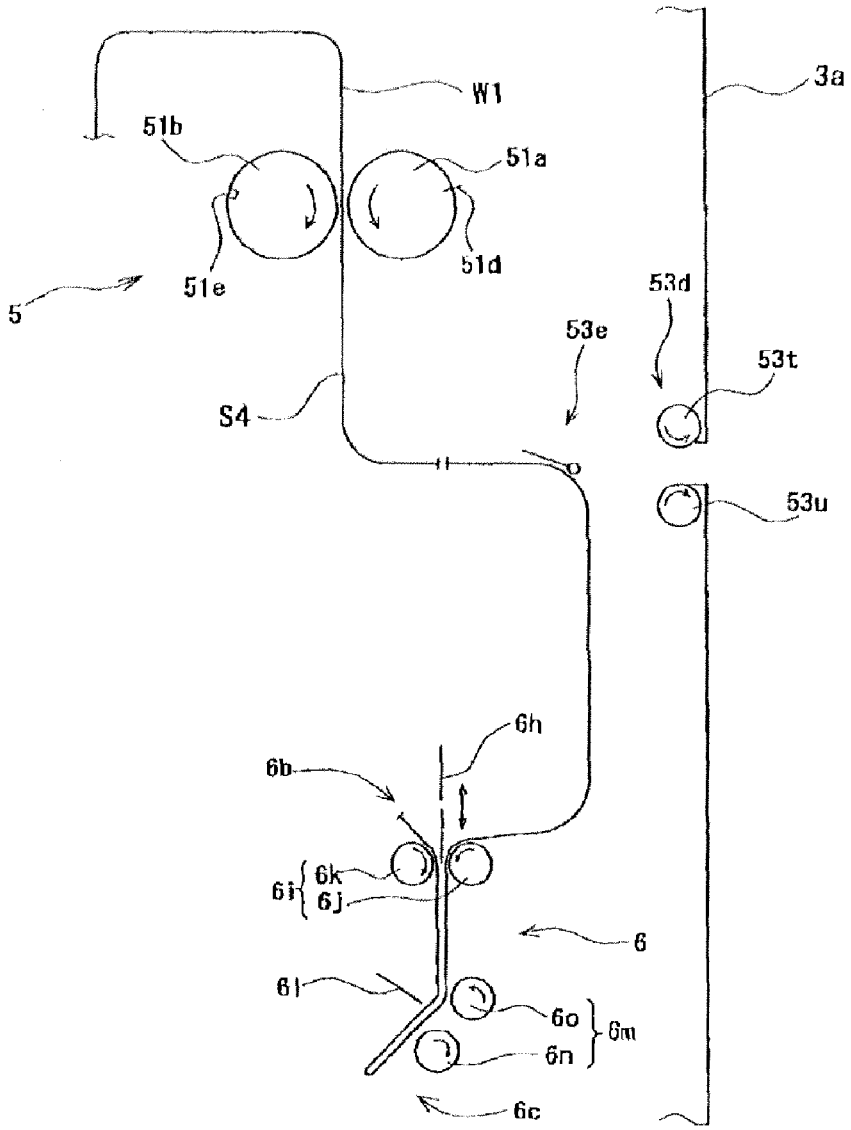
Figure 6:
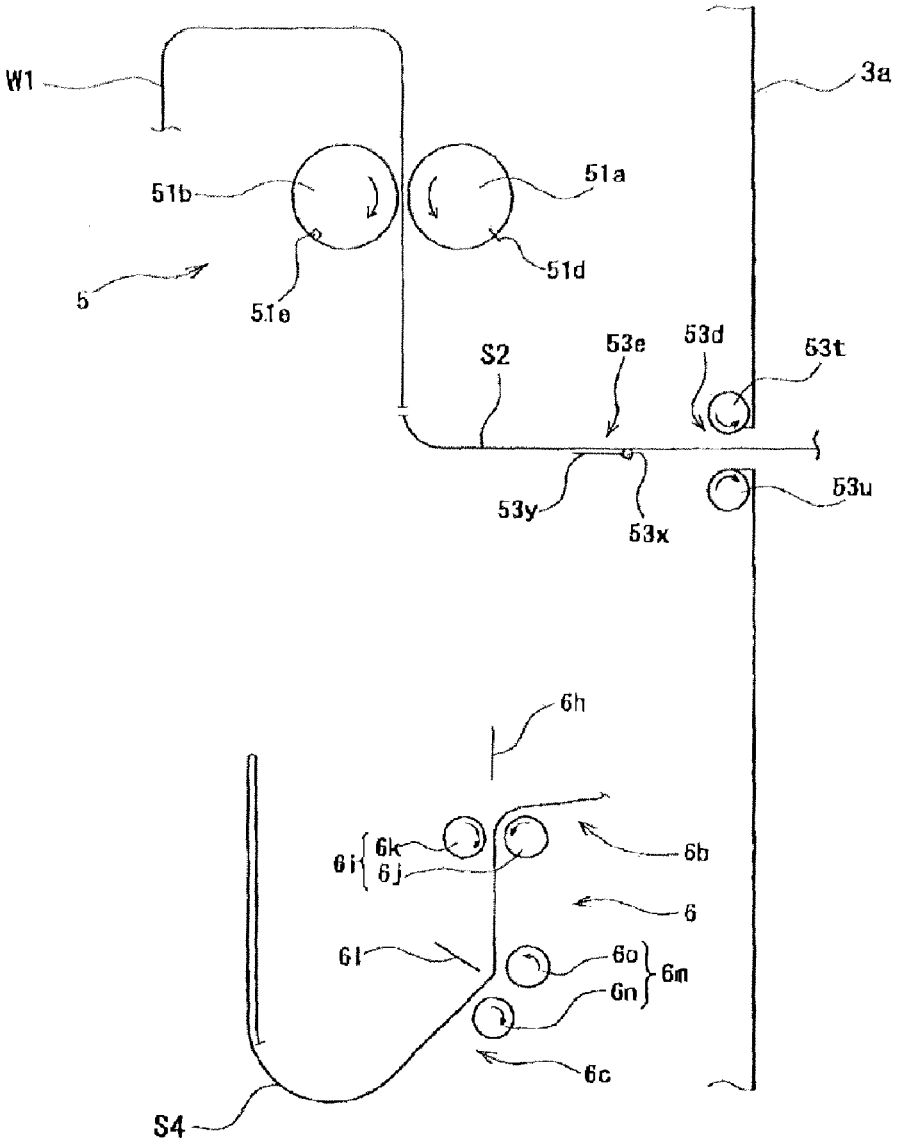
Figure 6:
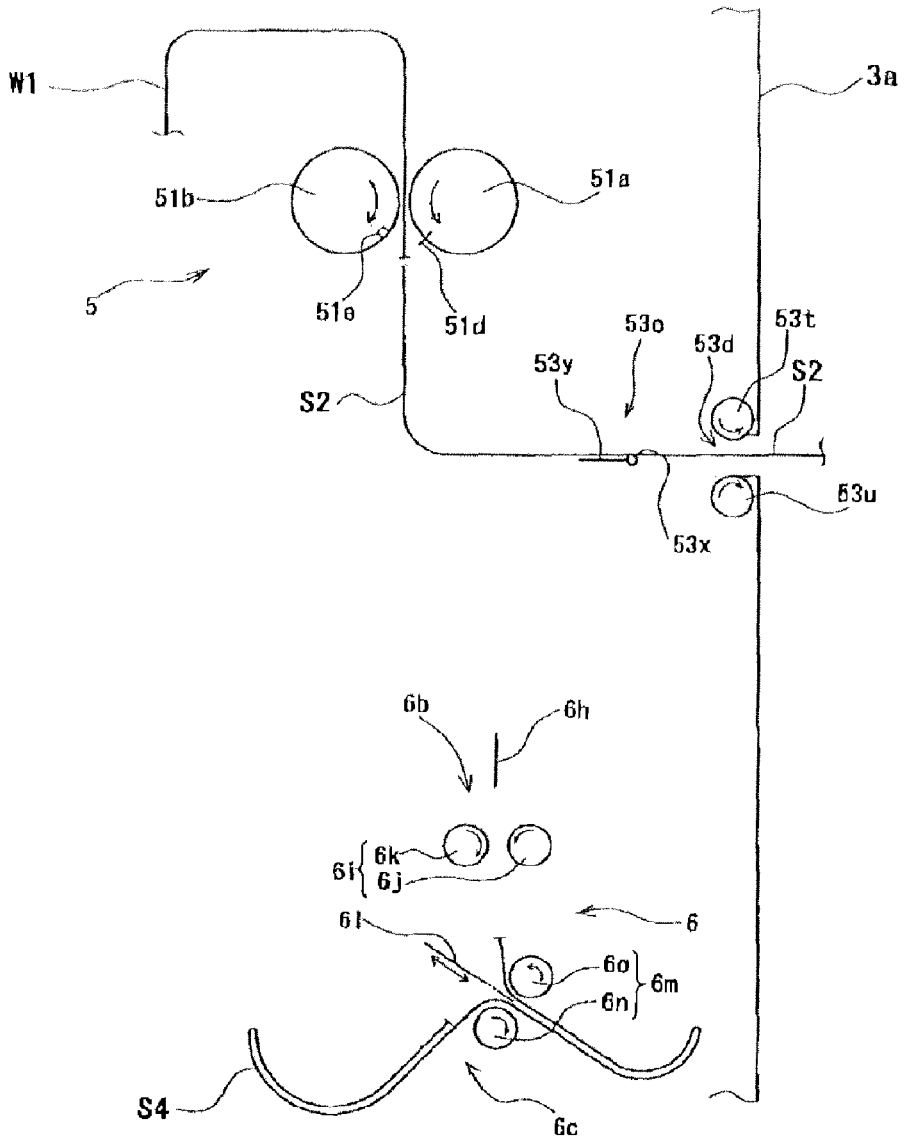
Figure 6:
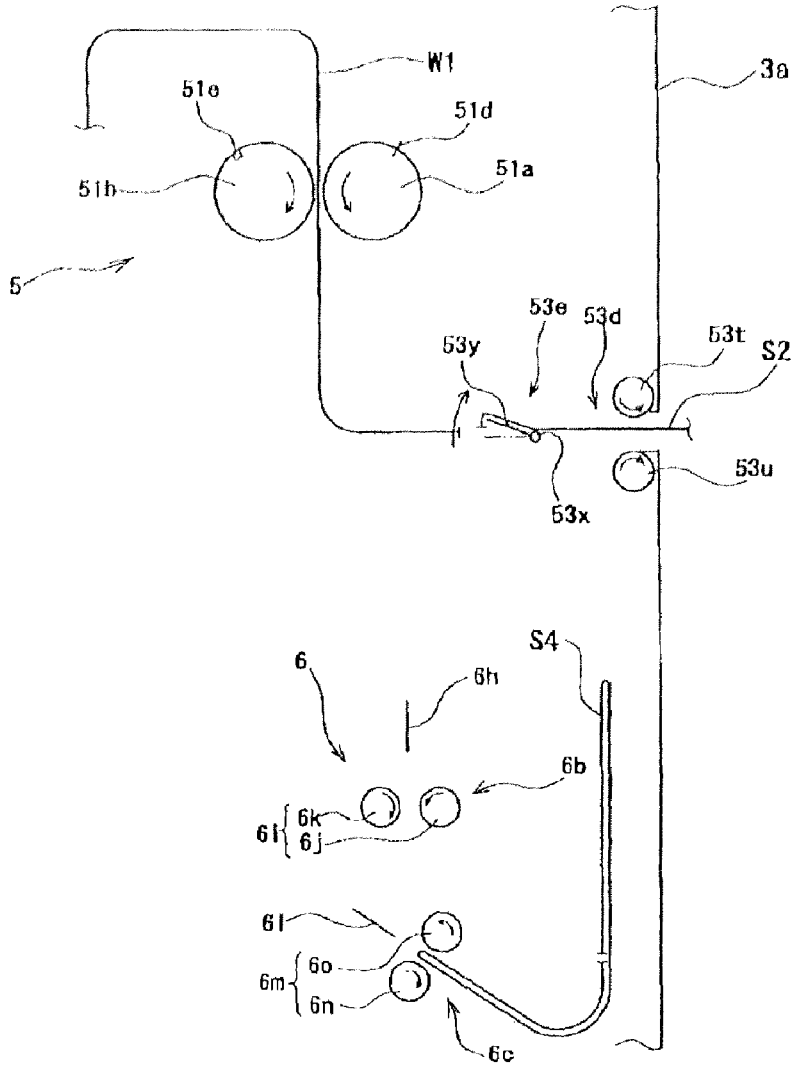
Figure 6:
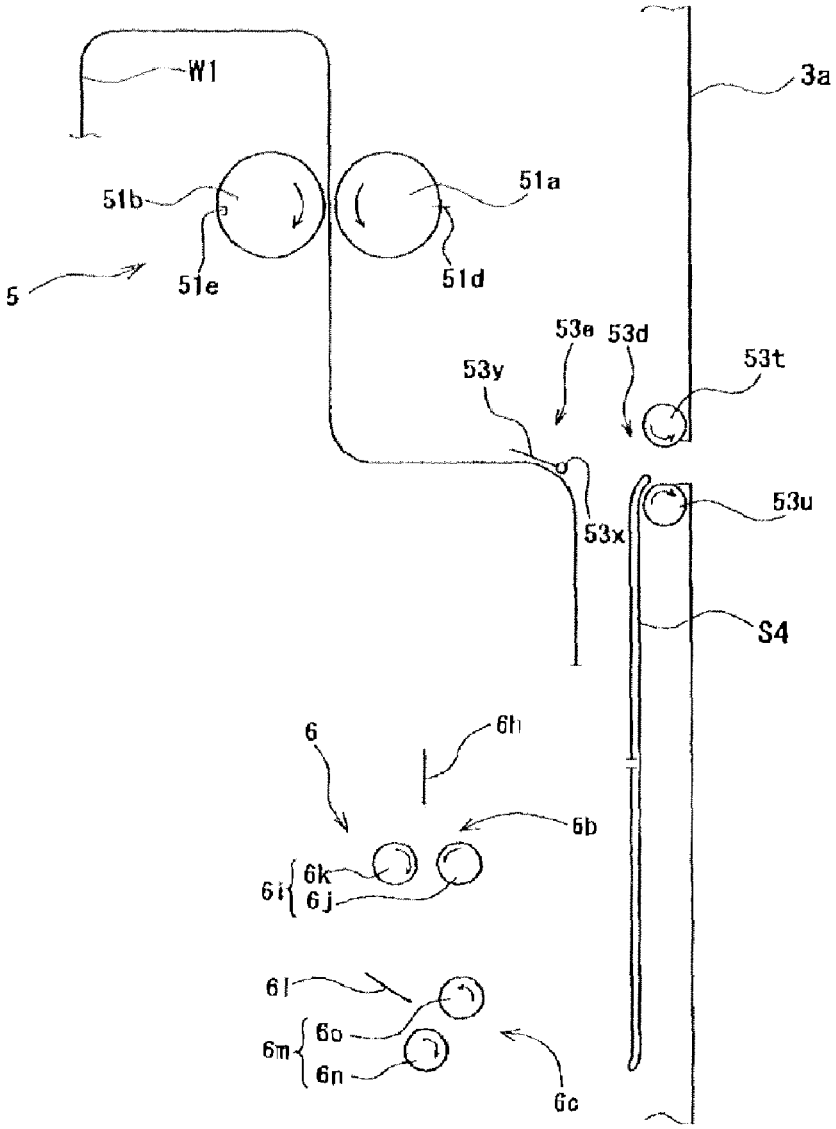
Figure 6:
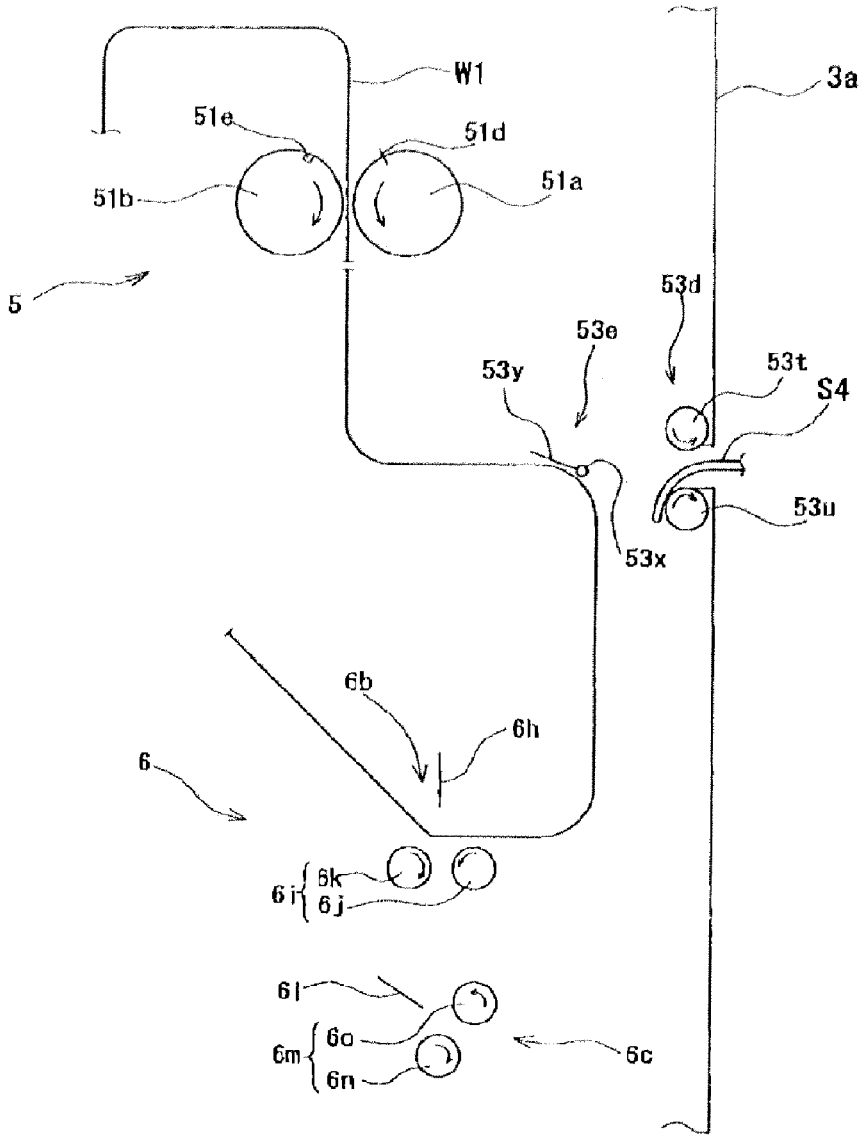
Figure 6:
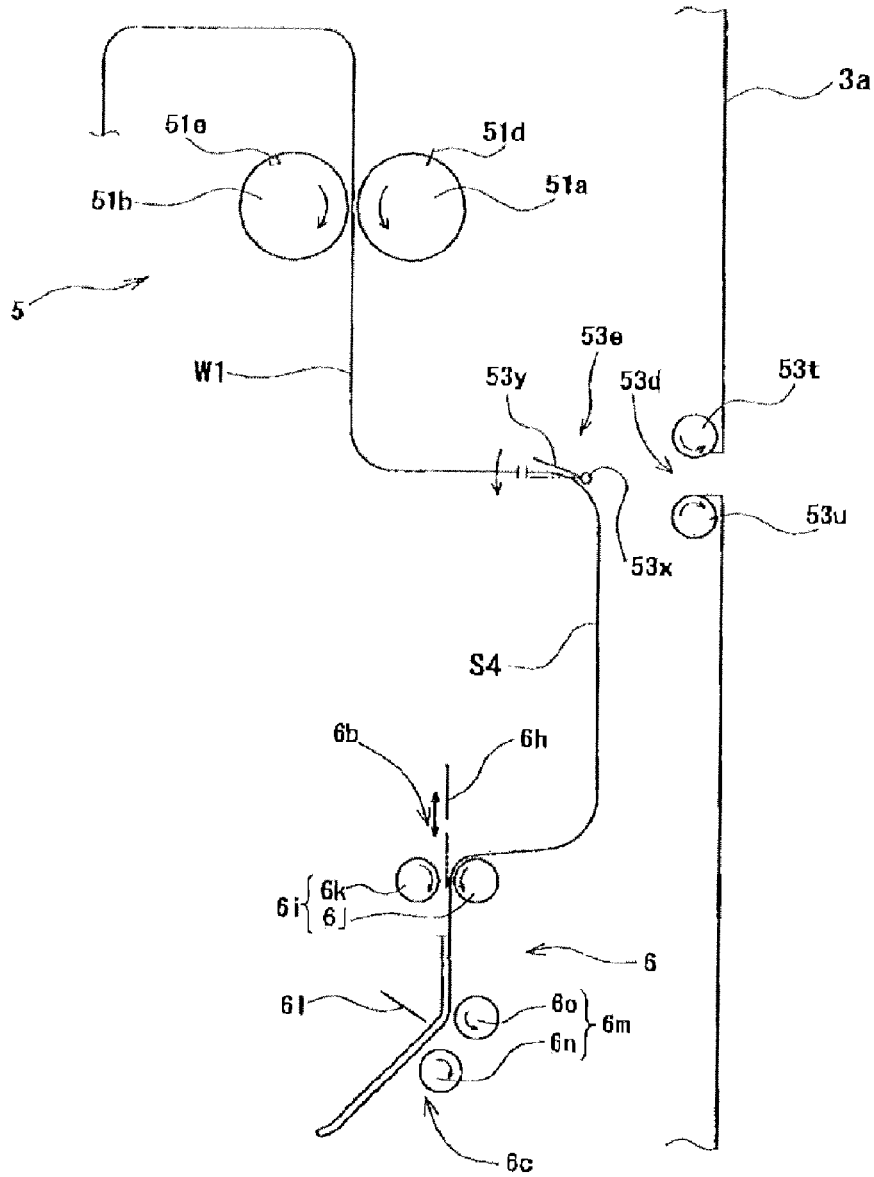

FIG. 6*f* shows a case where a 4-page cut sheet S4 that has been folded with a trailing side fold is not held by the pre-folding guide path 6*a*, wherein the 4-page cut sheet S4 that has been folded with a trailing side fold is delivered to the folding unit 3*b* by the delivery roller section 53*d* after going out to the straight traveling path from the rear end of the pre-folding guide path 6*a*. While this is taking place, the leading end of the next 4-page cut sheet S4 passes the leading side folding section 6*b* and is advanced to the first support passage 6*e* (refer to FIG. 6(*g*)).

If the leading end of the next 4-page sheet S4 passes a position of the leading side folding section 6*b*, and advances to the first support path 6*e* by a length corresponding to the width dimension of one newspaper page, then similarly to the description relating to FIG. 6(*b*), the folding blade 6*h* of the leading side folding section 6*b* is operated to form a leading side fold, and further to advance the leading side fold so as to reach a position of the trailing side folding section 6*c* and advance to the second support passage 6*f*. The rotation direction of the paper feed roller mechanism 6*g* of the first support path 6*e* is reversed with operation of the folding blade 6*h*, and a leading end side of the 4-page cut sheet S4 that has entered the first support path 6*e* is sent out from the first support path 6*e*. Also, while this is taking place the trailing end of the next 4-page cut sheet S4 and the leading end of the 2-page cut sheet S2 following on from the next 4-page cut sheet S4 are formed by the cutting mechanism 5. Then, if the leading end of the new 2-page cut sheet S2 reaches the path switching section 53*e*, the path switching member 53*y* is operated to block off the start end of the pre-folding guide path 6*a*, and open the straight traveling path (refer to FIG. 6(*h*)).

The reversely rotated paper feed roller mechanism 6*g* in the description related to FIG. 6(*b*) to FIG. 6(*d*), and the stopped paper feed roller mechanism 6*g* in the description relating to FIG. 6(*f*) are restored to normal rotation by a signal for prompting operation of the path switching member 53*y* of the path switching section 53*e* in order to guide the new 4-page cut sheet S4 to the pre-folding guide path 6*a*.

The illustrated pre-folding mechanism 6 is also capable of pre-folding a 3-page cut sheet S3.

When the leading side fold is formed in the 3-page cut sheet S3 by the pre-folding mechanism 6, then similarly to the description relating to FIG. 6(*b*), the fold is formed by the leading side folding section 6*b*, a formation operation for the trailing side fold is switched to, and the trailing end of the 3-page cut sheet S3 is guided between the folding roller pair 6*m* of the trailing side folding section 6*c* by the reverse rotation of the paper feed roller mechanism 6*g* of the second support path 6*f*. At this time, appropriate guiding is carried out so that the trailing end of the 3-page cut sheet S3, and the leading end of a 3-page cut sheet S3 positioned at the center of a trailing side page and a center page of the 3-page cut sheet S3 by formation of the leading side fold, are guided between the folding roller pair 6*m*, without delay and without the occurrence of any problems such as unnecessary folding.

When the trailing side fold is formed in the 3-page cut sheet S3 by the pre-folding mechanism 6, a formation operation for the leading side fold is switched to, and the leading end of the 3-page cut sheet S3 that has reached the leading side folding section 6*b* is guided between the folding roller pair 6*i* of the leading side folding section 6*b*. At this time, an appropriate guide member (not shown) is operated so that the leading end of the 3-page cut sheet S3 is advanced between the folding roller pair 6*i*, without delay and without the occurrence of any problems such as unnecessary folding. After the leading end of the 3-page cut sheet S3 passes the position of the trailing side folding section 6*c* and enters into the second support path 6*f* having a length corresponding to the width dimension of two newspaper pages, then similarly to the description relating to FIG. 6*d* a trailing side fold is formed by the trailing side folding section 6*c*.

Besides, it is possible, after the leading end of the 3-page cut sheet S3 has passed the position of the leading side folding section 6*b* and been advanced to the first support path 6*e* having a length corresponding to the width dimension of 2 newspaper pages, to form a trailing side fold by operating the folding blade 6*h* of the leading side folding section 6*b* to insert a middle of a center page of the 3-page cut sheet S3 and a trailing page between the folding roller pair 6*i*, and when the trailing side fold has reached the trailing side folding section 6*c* also forming a trailing side fold by guiding the trailing side fold between the folding roller pair 6*m* of the trailing side folding section 6*c*. When guiding the trailing side fold between the folding roller pair 6*m* of the trailing side folding section 6*c*, an appropriate guide member (not shown) is operated so that the trailing side fold of the 3-page cut sheet S3 is advanced between the folding roller pair 6*m*, without delay and without the occurrence of any problems such as unnecessary folding.

In accordance with the designated newspaper fabrication specification, a cut sheet Sn (1-page cut sheet S1, 2-page cut sheet S2, 3-page cut sheet S3 that has been pre-folded to the width dimension of two newspaper pages, and 4-page cut sheet S4 that has been pre-folded to the width dimension of two newspaper pages), that have been printed in an orderly manner by the printing unit for printing on one surface and the other surface of a continuous web 1A, formed by the cutting and folding unit 3*a*, and delivered to the folding unit 3*b* by the delivery roller section 53*d* of the cutting and folding unit 3*a*, are sandwiched between the upper roller section 7*d* and the lower roller section 7*e* of the ejection roller section 7*a* and the folding unit 3*b* and ejected to the stacking space 7*b* of the stacking section 7, and cut sheets Sn in a number corresponding to a single newspaper are sequentially stacked on a receiving member 7*f* to form a cut sheet bundle GS.

With respect to the loose stacking, a 1-page cut sheet S1 is aligned with a lower diagonal side of the receiving member 7*f*, that is, at the right side of the receiving member 7*f* in FIG. 2.

If loose stacking of cut sheets Sn to a number corresponding to a single newspaper is completed, the sheet bundle delivery mechanism 7*c* is activated and the cut sheet bundle GS on the receiving member 7*f* is delivered onto the upper plate 8*a* of the folding mechanism 8 by the delivery member 7*g*. The speed of delivery at this time is set to slightly faster than the speed of delivery of the earliest cut sheet Sn of the next cut sheet bundle GS by the delivery roller section 53*d* of the cutting and folding section 3*a*. Also, the cut sheet bundle GS delivered onto the upper plate 8*a* of the folding mechanism 8 is subjected to a delivery operation by the delivery member 7*g*, and is also subjected to conveyance operations of an upstream conveyor section 8*f* and a downstream conveyor section 8*j* that operate in synchronism with the sheet bundle feed mechanism 7*c* to displace the endless belt sets 8*i* and 8*m* at the same speed as the delivery speed of the upper plate 8*a* using the delivery member 7*g*, to move the leading end until it arrives at the stopper 8*c*. At the time of this movement, an appropriate guide member (not shown) temporarily at least partially blocks off the opening section so that the leading end of the cut sheet bundle GS is capable of passing through the opening section of a divided section of the upper plate 8*a* without interference.

The leading end of the cut sheet bundle GS arrives at the stopper 8*c* slightly earlier, and operation of the folding blade 8*e* that is waiting at the waiting position commences. Then, when the leading end of the cut sheet bundle GS has reached the stopper 8*c*, that is, when a central part, in a conveyance direction, of a cut sheet bundle GS has been aligned with the opening section of the upper plate 8*a*, the insertion tip end of the folding blade 8*e* is brought into contact with the upper surface of the cut sheet bundle GS, and the cut sheet bundle GS is pressed through the opening section of the upper plate 8*a* and in between the folding rollers 8*n* and 8*o* of the folding roller pair 8*d*. As a result of this pressing in the central part in the conveyance direction of the cut sheet set GS is gripped by the folding rollers 8*n* and 8*o* and folded in half, to form a signature SS having the size of a single newspaper. The signature SS formed folded up by the folding roller pair 8*d* is guided to the take out section 8*q* by the guide member 8*p* provided below the folding roller pair 8*d*, and conveyed from the newspaper production system SA by the take out section 8*q*.

Figure 3:
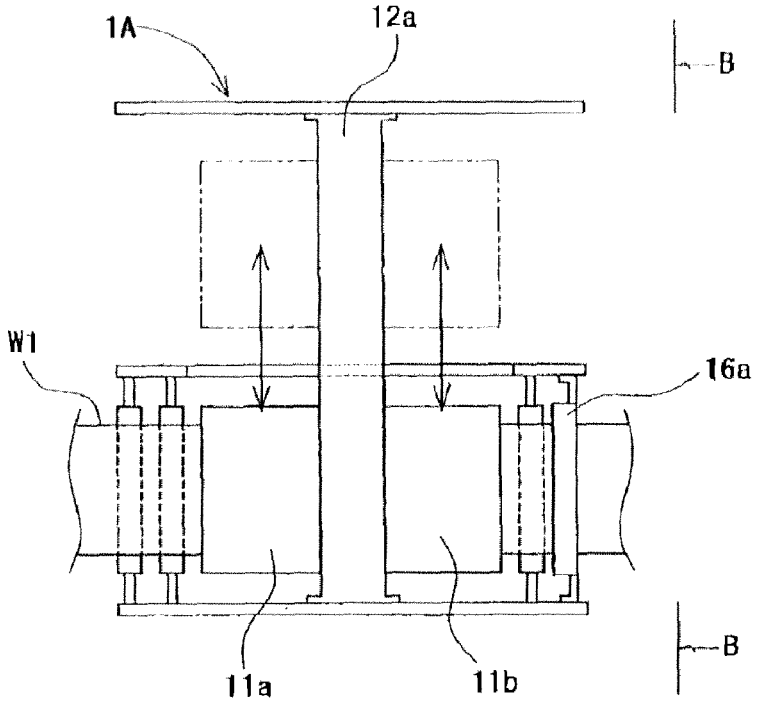
FIG. 3 is a schematic diagram viewed from the direction of arrows AA of the ink jet printing unit for a continuous web 1A shown in FIG. 2.

After completion of the newspaper production operations of the above described newspaper production system SA, the ink jet printing devices 11*a* to 11*h* are moved to a maintenance position shown by the dashed double-dotted line in FIG. 3 and FIG. 4 by a lateral movement unit 12*a*, and are put on standby below this maintenance position, that is, at a standby position that is lower down than the discharge ports of the ink jet print heads of the ink jet printing devices 11*g* and 11*h*, and maintenance such as cleaning of the ink jet print heads so that problems do not arise at the time of the next newspaper production operation are carried out using a maintenance unit 13*a* provided capable of moving up and down along a frame.

With a newspaper production method using a newspaper production system SB that is the second embodiment shown in FIG. 7(*a*) to FIG. 12(*b*), newspaper fabrication specifications are input in advance from the input means 41 to the control member 4, before any printing operations. The newspaper fabrication instructions are, for example, number of pages constituting a single newspaper to be produced, image data for each page, size of cut sheet that are stacked, designation of cut sheet folding conditions, and cut sheet stacking order, etc. The newspaper production method using the newspaper production system SB that is the second embodiment is operated as described in the following as a result of an operation start signal after newspaper fabrication specification input.

The continuous web W2 that has been drawn out from the continuous web roll R2 loaded on the continuous web supply unit 2B provided at an upstream side, and that has been subjected to tension adjustment based on detection results of the tension detection section 22*b*, reaches the printing unit for printing on one surface and the other surface of a continuous web 1B, and is guided by the guide rollers 15*l*, 15*m* and 15*n* to travel substantially horizontally below the ink jet printing devices 11*i*, 11*j*, and 11*q* 11*r* of the uppermost level, and through between the ink jet print heads of each of the ink jet printing devices 11*i*, 11*j*, and 11*q* 11*r* and the backup rollers 18*a*, 18*b*, 18*c*, 18*d* and 18*q*, 18*r*, 18*s*, 18*t*, and at another half, in a cross direction, of one surface that faces upwards at this time, printing of first ink, for example yellow printed image, is carried out by the ink jet printing device 11*i* and printing of second ink, for example cyan printed image, is carried out by the ink jet printing device 11*j*, while at one half, in the cross direction, of the one surface first ink, for example yellow printed image, is printed by the ink jet printing device 11*q* and second ink, for example cyan printed image, is printed by the ink jet printing device 11*r*.

A start signal for printing of first ink to the other half, in the cross direction, of the one surface, and a start signal for printing of first ink to the one half, in the cross direction, of the one surface are output from the control member 4 to the ink jet printing device 11*i* and to the ink jet printing devices 11*q* at a predetermined appropriate timing, a start signal for printing of second ink to the other half, in the cross direction, of the one surface is output from the control member 4 to the ink jet printing devices 11*j* at a timing determined based on a printed image using the first ink for the other half, in the cross direction, of the one surface it should be in register with, length of a paper through passage 10*b* between installation of the ink jet printing device 11*i* and the ink jet printing device 11*j*, and travel distance of the continuous web W2, and a start signal for printing second ink to the one half, in the cross direction, of the one surface is output from the control member 4 to the ink jet printing device 11*r* at a timing determined based on a printed image using the first ink for the one half, in the cross direction, of the one surface it should be in register with, length of a paper through passage 10*b* between installation of the ink jet printing device 11*q* and the ink jet printing device 11*r*, and travel distance of the continuous web W2.

The continuous web W2 that has passed below the ink jet printing devices 11*i*, 11*j* and 11*q*, 11*r* has its travel direction changed to downward by the guide roller 15*n* that contacts the other surface, being the rear surface of the surface that was printed by the ink jet printing devices 11*j* and 11*q*, 11*r*, and also, similarly, the travel direction is changed to the opposite of when traveling below the ink jet printing devices 11*i*, 11*j* and 11*q*, 11*r* of the uppermost level using the guide roller 15*o* that is in contact with the other surface, to turn the continuous web W2 over. During travel between the guide rollers 15*n* and 15*o*, the one surface that has been printed by the ink jet printing units 11*i*, 11*j* and 11*q*, 11*r* faces the drying devices 16*e*, and the printed image printed by the ink jet printing devices 11*i*, 11*j* and 11*q*, 11*r* is dried.

The continuous web W2, that has had the printed image printed by the ink jet printing devices 11*i*, 11*j* and 11*q*, 11*r* dried, and travel direction changed by the guide roller 15*o* together with being turned over, is guided by the guide rollers 15*o* and 15*p* to travel substantially horizontally below the ink jet printing devices 11*s*, 11*t*, and 11*k* 11*l* of the second level, and through between the ink jet print heads of each of the ink jet printing devices 11*s*, 11*t*, and 11*k* 11*l* and the backup rollers 18*u*, 18*v*, 18*w*, 18*x* and 18*e*, 18*f*, 18*g*, 18*h*, and at one half, in a cross direction, of the other surface that faces upwards at this time is printed with a first ink, for example yellow printed image, is carried out by the ink jet printing device 11*s* and is printed with a second ink, for example cyan printed image, is carried out by the ink jet printing device 11*t*, while at the other half, in the cross direction, of the other surface first ink, for example yellow printed image, is printed by the ink jet printing device 11*k* and second ink, for example cyan printed image, is printed by the ink jet printing device 11*l*.

A start signal for printing of first ink to one half, in the cross direction, of the other surface is output from the control member 4 to the ink jet printing device 11*s* at a timing determined based on position of each page of a newspaper having one half, in the cross direction, of one surface printed, and position of each page of a newspaper printed on the other half, in the cross direction, of the other surface, that the printing should be in register with, length of a paper through passage 10*b* between installation positions of the ink jet printing device 11*q* and the ink jet printing device 11*s*, and travel distance of the continuous web W2, and a start signal for printing second ink to one half, in the cross direction, of the other surface, is output from the control member 4 to the ink jet printing device 11*t* at a timing determined based on printed image by the first ink on the one half, in the cross direction, of the other surface that it should be in register with, length of a paper through passage 10*b* between installation positions of the ink jet printing device 11*q* and the ink jet printing device 11*t*, and travel distance of the continuous web W2. Also, a start signal for printing of first ink to the other half, in the cross direction, of the other surface is output from the control member 4 to the ink jet printing device 11*k* at a timing determined based on position of each page of a newspaper having the other half, in the cross direction, of one surface printed, and position of each page of a newspaper printed on the other half, in the cross direction, of the other surface, that the printing should be in register with, length of a paper through passage 10*b* between installation positions of the ink jet printing device 11*i* and the ink jet printing device 11*k*, and travel distance of the continuous web W2, and a start signal for printing second ink to the other half, in the cross direction, of the other surface, is output from the control member 4 to the ink jet printing device 11*l* at a timing determined based on printed image by the first ink on the other half, in the cross direction, of the other surface that it should be in register with, length of a paper through passage 10*b* between installation positions of the ink jet printing device 11*i* and the ink jet printing device 11*l*, and travel distance of the continuous web W2.

Next, the continuous web W2 that has passed below the ink jet printing devices 11*s*, 11*t* and 11*k*, 11*l* has its travel direction changed to downward by the guide roller 15*p* that contacts the one surface, being the other side to the surface that was printed by the ink jet printing devices 11*s*, 11*t* and 11*k*, 11*l*, and also, similarly, the travel direction is changed to the same direction as when traveling below the ink jet printing devices 11*i*, 11*j* and 11*q*, 11*r* of the uppermost level using the guide roller 15*q* that is in contact with the one surface, to turn the continuous web W2 over again. During travel between the guide rollers 15*p* and 15*q*, the other surface that has been printed by the ink jet printing devices 11*s*, 11*t* and 11*k*, 11*l* faces the drying unit 16*f*, and the printed image printed by the ink jet printing devices 11*s*, 11*t* and 11*k*, 11*l* is dried. When guiding this continuous web W2, the guide rollers 15*p* and 15*q* contact one surface of the continuous web W2, but a printed image printed by the ink jet printing devices 11*i*, 11*j* and 11*q*, 11*r* on this one surface has been dried by the drying unit 16*e*, and so print quality of that printed image is not affected by contact of the guide rollers 15*p*, 15*q* with the continuous web W2. The continuous web W2, that has had travel direction changed by the guide roller 15*q* together with being turned over again, is guided by the guide rollers 15*q* and 15*r* to travel substantially horizontally below the ink jet printing devices 11*m*, 11*n*, and 11*u* 11*v* of the third level, and through between the ink jet print heads of each of the ink jet printing devices 11*m*, 11*n*, and 11*u* 11*v* and the backup rollers 18*i*, 18*j*, 18*k*, 18*l* and 18*y*, 18*z*, 18*aa*, 18*ab*, and at the other half, in a cross direction, of the one surface that faces upwards at this time printing of third ink, for example magenta printed image, is carried out by the ink jet printing device 11*m* and printing of fourth ink, for example black printed image, is carried out by the ink jet printing device 11*n*, while at the one half, in the cross direction, of the one surface third ink, for example magenta printed image, is printed by the ink jet printing device 11*u* and fourth ink, for example black printed image, is printed by the ink jet printing device 11*v*. A start signal for printing of third ink to the other half, in the cross direction, of the one surface is output from the control member 4 to the ink jet printing device 11*m* at a timing determined based on the printed image using the first ink and the printed image using the second ink, of the other half, in the cross direction, of the one surface that it should be in register with, length of a paper through passage 10*b* between installation positions of the ink jet printing device 11*i* and the ink jet printing device 11*m*, and travel distance of the continuous web W2, and a start signal for printing fourth ink is output from the control member 4 to the ink jet printing device 11*n* at a timing determined based on a printed image using the first ink, a printed image using the second ink and printed image using the third ink, of the other half, in the cross direction, of the one surface, that it should be in register with, length of a paper through passage 10*b* between installation positions of the ink jet printing device 11*i* and the ink jet printing device 11*n*, and travel distance of the continuous web W2.

Also, a start signal for third ink printing to one half, in the cross direction, of the one surface, is output from the control member 4 to the ink jet printing device 11*u* at a timing that is determined based on the printing image using the first ink and the printed image using the second ink, to the one half, in the cross direction, of the one surface, that it should be in register with, length of a paper through passage 10*b* between installation positions of the ink jet printing device 11*q* and the ink jet printing device 11*u*, and travel distance of the continuous web W2. Further, a start signal for fourth ink printing is output from the control member 4 to the ink jet printing device 11*v* at a timing that is determined based on a printed image using the first ink, a printed image using the second ink and a printed image using the third ink, to the one half, in the cross direction, of the other surface, that it should be in register with, length of a paper through passage 10*b* between installation positions of the ink jet printing device 11*q* and the ink jet printing device 11*v*, and travel distance of the continuous web W2.

As a result of this printing, printing to one half, in the cross direction, of one surface and printing to the other half, in the cross direction, of the one surface, that is, printing using four inks to the one surface, is completed.

The continuous web W2 for which printing using four inks on one surface is completed has its travel direction changed to downward by the guide roller 15*r* that contacts the other surface, being the other side to the surface that was printed by the ink jet printing devices 11*m*, 11*n* and 11*u*, 11*v*, and also, similarly, the travel direction is changed to the same as when traveling below the ink jet printing devices 11*s*, 11*t* and 11*k*, 11*l* of the second level from the top using the guide roller 15*s* that contacts the other surface, to turn the continuous web W2 over a third time. During travel between the guide rollers 15*r* and 15*s*, the one surface that has been printed by the ink jet printing units 11*m*, 11*n* and 11*u*, 11*v* faces the drying unit 16*g*, and the printed image printed by the ink jet printing units 11*m*, 11*n* and 11*u*, 11*v* is dried. When guiding this continuous web W2, the guide rollers 15*r* and 15*s* contact the other surface of the continuous web W2, but printed images printed by the ink jet printing units 11*s*, 11*t* and 11*k*, 11*l* on this other surface has been dried by the drying unit 16*f*, and so print quality of that printed image is not affected by contact of the guide rollers 15*r*, 15*s* with the continuous web W2. The continuous web W2, that has had travel direction changed by the guide roller 15*s* together with being turned over a third time, is guided by the guide rollers 15*s* and 15*t* to travel substantially horizontally below the ink jet printing devices 11*w*, 11*x*, and 11*o* 11*p* of the lowermost level, and through between the ink jet print heads of each of the ink jet printing devices 11*w*, 11*x*, and 11*o* 11*p* and the backup rollers 18*ac*, 18*ad*, 18*ae*, 18*af* and 18*m*, 18*n*, 18*o*, 18*p*, and at the one half, in a cross direction, of the other surface that faces upwards at this time printing of third ink, for example magenta printed image, is carried out by the ink jet printing devices 11*w* and printing of fourth ink, for example black printed image, is carried out by the ink jet printing device 11*x*, while at the other half, in the cross direction, of the other surface third ink, for example magenta printed image, is printed by the ink jet printing device 11*o* and fourth ink, for example black printed image, is printed by the ink jet printing device 11*p*.

A start signal for printing of third ink to the one half, in the cross direction, of the other surface is output from the control member 4 to the ink jet printing device 11*w* at a timing determined based on a printed image using the first ink and printed image using the second ink, to the one half, in the cross direction, of the other surface that it should be in register with, length of a paper through passage 10*b* between installation positions of the ink jet printing device 11*q* and the ink jet printing device 11*w*, and travel distance of the continuous web W2, and a start signal for printing fourth ink is output from the control member 4 to the ink jet printing device 11*x* at a timing determined based on a printed image using the first ink, a printed image using the second ink and a printed image using the third ink, to the one half, in the cross direction, of the other surface, that it should be in register with, length of a paper through passage 10 between installation positions of the ink jet printing device 11*q* and the ink jet printing device 11*x*, and travel distance of the continuous web W2. Also, a start signal for printing of third ink to the other half, in the cross direction, of the other surface is output from the control member 4 to the ink jet printing device 110 at a timing determined based on a printed image using the first ink and the printed image using the second ink, of the other half, in the cross direction, of the other surface, that it should be in register with, length of a paper through passage 10*b* between installation positions of the ink jet printing device 11*i* and the ink jet printing device 11*o*, and travel distance of the continuous web W2, and a start signal for printing fourth ink is output from the control member 4 to the ink jet printing unit 11*p* at a timing determined based on a printed image using the first ink, a printed image using the second ink and printing image using the third ink, of the other half, in the cross direction, of the other surface, that it should be in register with, length of a paper through passage 10*b* between installation positions of the ink jet printing device 11*i* and the ink jet printing device 11*p*, and travel distance of the continuous web W2. As a result of this printing, printing to one half, in the cross direction, of the other surface and printing to the other half, in the cross direction, of the other surface, that is, printing using four inks to the other surface, is completed.

In the above disclosed printing operation, if the printed image using each ink for the one half, in the cross direction, and the other half, in the cross direction, for each surface, is out of register, the respective registers are adjusted. Specifically, getting printing in register for the continuation direction of the continuous web W2 is carried out by performing control by means of the control member 4 so that discharge timing of ink from the ink jet print heads of each of the ink jet print devices 11*i* to 11*p*, and 11*q* to 11*x* is advanced or delayed, and achieving in register for the cross direction of the continuous web W2 is done by moving the ink jet printing units 11*i* to 11*p* and 11*q* to 11*x* slightly using the lateral moving unit 12*b*. Also, ink mist arising as a result of discharge from the ink jet print heads and impacting on the continuous web W2 is collected by suction devices 19*i* to 19*p* and 19*q* to 19*x* provided at a downstream side in the travel direction of the continuous web W2 for every ink jet printing devices 11*i* to 11*p* and 11*q* to 11*x*.

The continuous web W2 for which printing using four inks on the other surface is completed, that is, the continuous web W2 for which printing using four inks has been completed for both surfaces, has its travel direction changed to downward by the guide roller 15*t* that contacts the one surface, being the rear side of the surface that was printed by the ink jet printing devices 11*w*, 11*x* and 11*o*, 11*p*, and also, similarly, the travel direction is changed to substantially the same direction as when traveling below the ink jet printing devices 11*i*, 11*j* and 11*q*, 11*r* of the uppermost level using the guide roller 15*u* that contacts the other surface, to turn the continuous web W2 over a fourth time. During travel between the guide rollers 15*t* and 15*u*, the other surface that has been printed by the ink jet printing devices 11*w*, 11*x* and 11*o*, 11*p* faces the drying unit 16*h*, and the printed image printed by the ink jet printing devices 11*w*, 11*x* and 11*o*, 11*p* is dried. When guiding this continuous web W2, the guide rollers 15*t* and 15*u* contact one surface of the continuous web W2, but printed images printed by the ink jet printing devices 11*m*, 11*n* and 11*u*, 11*v* on this one surface have been dried by the drying unit 16*g*, and so print quality of those printed images is not affected by contact of the guide rollers 15*t*, 15*u* with the continuous web W2. The continuous web W2 that has been turned over a fourth time together with having the travel direction changed by the guide roller 15*u* is guided by the guide rollers 15*u*, 15*v* and 15*w*, and further delivered to the divided continuous web course changing unit 3*c*, being the processing unit 3 provided at a downstream side of the printing unit for printing on one surface and the other surface of a continuous web 1B, by the feed mechanism 14*b*.

The divided continuous web course changing unit 3*c*, being the processing unit 3, cuts and divides the continuous web W2 in the longitudinal direction at a center part in the cross direction, to form the divided continuous webs W21 and W22, and is a unit for changing the travel directions of these divided continuous webs W21 and W22, so that it is possible to produce a newspaper. The divided continuous web course changing unit 3*c* has an embodiment D, being the overlapping unit 3*d* shown in FIG. 7(*a*), FIG. 7(*b*) and FIG. 12(*a*), and an embodiment E, being the separating unit 3*e* shown in FIG. 11 and FIG. 12(*b*).

With embodiment D, where the divided continuous web course changing unit 3*c* is the overlapping unit 3*d*, as previously described, newspaper surfaces are printed on one half and another half, in the cross direction, for both surfaces by the printing unit for printing on one surface and the other surface of a continuous web 1B, with respective front and rear surface positions being aligned, and the continuous web W2 that has been delivered to the overlapping unit 3*d*, being the divided continuous web course changing unit 3*c*, is drawn in to the overlapping unit 3*d* by the drag roller 30*a*, together with being cut in the longitudinal direction at a center part on the cross direction by the slitter 30*b* that is annexed to the drag roller 30*a*, to give the divided continuous webs W21 and W22. The divided continuous web W21 has its travel direction changed to downwards by the guide rollers 30*d* and 30*f* and is guided to the turn bar section 31, while the divided continuous web W22 has its travel direction changed to upwards by the guide rollers 30*c* and 30*e* and is guided to the turn bar section 32.

The divided continuous web W21 that has been guided to the turn bar section 31 has its travel direction changed through 90 degrees by rounding 180 degrees around the upstream turn bar 31*a*, and moving away from the divided continuous web W22, reaches the guide roller 31*c* where it has its travel direction changed through 180 degrees by rounding 180 degrees around the guide roller 31*c*, and draws near the divided continuous web W22, and further has travel direction changed through 90 degrees by rounding 180 degrees around the downstream turn bar 31*b*, to make the travel direction the same as that of the continuous web W2, and a course change is carried out so that the center, in the cross direction, of the divided continuous web W21 and the center, in a cross direction, of the continuous web W2 are placed on the same plane orthogonal to the paper surface of the divided continuous web W21 and the continuous web W2, but separated vertically. Also, the divided continuous web W22 that has been guided to the turn bar section 32 has its travel direction changed through 90 degrees by rounding 180 degrees around the upstream turn bar 32*a*, and moving away from the divided continuous web W21, reaches the guide roller 32*c* where it has its travel direction changed 180 degrees by rounding 180 degrees around the guide roller 32*c*, and draws near the divided continuous web W21, and further has travel direction changed through 90 degrees by rounding 180 degrees around the downstream turn bar 32*b*, to make the travel direction the same as that of the continuous web W2, and a course change is carried out so that the center, in the cross direction, of the divided continuous web W22 and the center, in a cross direction of the continuous web W2, are placed on the same plane orthogonal to the paper surface of the divided continuous web W22 and the continuous web W2, but separated vertically. The divided continuous web W21 is then guided to the delivery roller 33*c* by the guide roller 33*b*, while the divided continuous web W22 is guided to the delivery roller 33*c* by the guide roller 33*a*, and the divided continuous webs W21 and W22 are then overlapped on by the peripheral surface of the delivery roller 33*c* and delivered to the cutting unit 3*f*, being the processing unit 3, provided at a downstream side, by the delivery roller 33*c*. If the newspaper page positions of both of the divided continuous webs W21 and W22 are not aligned in the longitudinal direction when the divided continuous webs W21 and W22 are overlapped, the newspaper page positions are adjusted by moving the guide roller 32*c* in the direction of the arrows in FIG. 12(*a*) using a not shown traveling path longitudinal adjustment section.

In the case of embodiment E, where the divided continuous web course changing unit 3*c* is the separation unit 3*e*, as previously described, newspaper surfaces are printed on one half and another half, in the cross direction, for both surfaces by the printing unit for printing on one surface and the other surface of a continuous web 1B, with respective front and rear surface positions being aligned, and the continuous web W2 that has been delivered to the separation unit 3*e*, being the divided continuous web course changing unit 3*c*, is drawn in to the separation unit 3*e* by the drag roller 30*a*, together with being cut in the longitudinal direction at a center part in the cross direction by the slitter 30*b* that is annexed to the drag roller 30*a*, to give the divided continuous webs W21 and W22. The divided continuous web W21 has its travel direction changed to downwards by the guide rollers 30*d* and 30*f*, and is guided as is directly to the guide roller 35*b*, while the divided continuous web W22 has its travel direction changed to upwards by the guide rollers 30*c* and 30*e* and is guided to the turn bar section 34. The divided continuous web W22 that has been guided to the turn bar section 34 has travel direction changed through 90 degrees by rounding 180 degrees around the upstream turn bar 34*a*, and moving away from the divided continuous web W21, then reaches the downstream turn bar 34*b*, and has travel direction changing through 90 degrees by rounding 180 degrees around the downstream turn bar 34*b* to make the travel direction becomes the same as that of the continuous web W2. The divided continuous web W21 that has been guided as is directly from the guide roller 30*f* to the guide roller 35*b*, as described above, is then guided to the delivery roller 35*d* by the guide roller 35*b*, while the divided continuous web W22 is guided by the guide roller 35*a* to the delivery roller 35*c*, and the two divided continuous webs W21 and W22 are separated from each other, with the divided continuous web W21 being delivered to the cutting section 3*f*, being the processing unit 3 provided at a downstream side, by the delivery roller 35*d*, and the divided continuous web W22 being delivered by the delivery roller 35*c* to the cutting unit 3*f*, being the processing unit 3 provided at a downstream side, that is different to the cutting unit 3*f* to which the divided continuous web W21 is delivered.

In the embodiment D for the overlapping unit 3*d* and embodiment E for the separation unit 3*e*, the divided continuous webs W21 and/or W22 that have been delivered to the cutting unit 3*f* travel being gripped by the endless belt set 92*f* of the guide in upper belt section 92*a* and the endless belt set 92*j* of the guide in lower belt section 92*b*, of the guide-in section 92 of the cutting mechanism 9, and pass between the cutter drum 91*a* and the cutter receiving drum 91*b* of the cutting section 91 to reach the delivery section 93. The divided continuous web W21 and/or the divided continuous web 22 that have reached the delivery section 93 pass between the two upstream pulley sets 93*f* and 93*g* provided spaced slightly far apart facing the hopper belt section 93*a*, to be sandwiched by the one side endless belt set 93*j* and the other side endless belt set 93*k*, and further continue on to the hopper belt section 93*a* and are sandwiched between the endless belt set 93*o* of the delivery upper belt section 93*b* and the endless belt set 93*s* of the delivery lower belt section 93*c*, and delivered to the folding unit 3*b*, being the processing unit provided at a downstream side.

The cutter drum 91*a* and the cutter receiving drum 91*b* of the cutting section 91 of the cutting unit 3*f* form cut sheets Sn by cutting the divided continuous webs W21 and or W22 in accordance with the size of the cut sheets stacked according to the newspaper fabrication specifications input to the control member 4. For example, when the cutter drum 91*a* and the cutter receiving drum 91*b* are configured so that when the peripheral surface speed of the drums is the same as the travel speed of the divided continuous web W21 and/or W22 the divided continuous web W21 and/or W22 is cut to a length of the width dimension of one newspaper page, then the control member 4 performs control, each time a cut sheet Sn is made, so that when designation of the newspaper fabrication specification is formation of a 1-page cut sheet S1, the cutter drum 91*a* and the cutter receiving drum 91*b* are rotated with a peripheral speed that is the same as the travel speed of the divided continuous web W21 and/or W22, and when the designation of the newspaper fabrication specification is to make a 2-page cut sheet S2 the cutter drum 91*a* and the cutter receiving drum 91*b* are rotated with a peripheral speed that is the half the travel speed of the divided continuous web W21 and/or W22. Also, cutting using the cutter 91*d* of the cutter drum 91*a* and the cutter indent 91*e* of the cutter receiving drum 91*b* is required to be aligned with blank sections between adjacent newspaper pages printed on the divided continuous web W21 and/or W22. Accordingly, rotational phase of the cutter drum 91*a* and the cutter receiving drum 91*b* is determined with a structure that detects specified positions of printed images on the paper surface of the divided continuous web W21 and/or W22 delivered from the divided continuous web course changing unit 3*c*, and based on a paper passage length from that detected position to a position where the cutter 91*d* of the cutter drum 91*a* and the cutter indent 91*e* of the cutter receiving drum 91*b* mesh.

Since the cutting unit 3*f* is not provided with the pre-folding mechanism, formation of cut sheets Sn of a size in excess of 2-pages is not carried out.

Cut sheets Sn that have been delivered from the divided continuous web course changing unit 3*c* to the folding unit 3*b* are processed in the same way as the cut sheets Sn delivered from the cutting and folding unit 3*a* to the folding unit 3*b*, and conveyed from the newspaper production system SB.

Figure 8:
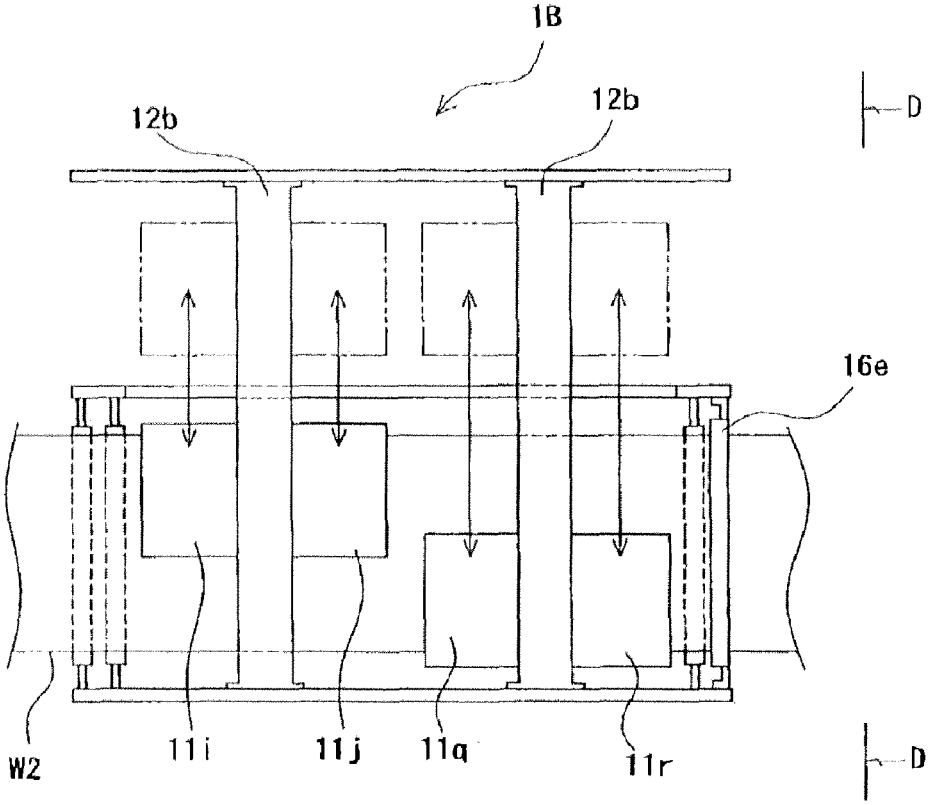
FIG. 8 is a schematic diagram looking from the arrows CC of the ink jet printing unit for a continuous web 1B shown in FIG. 7(*a*).
Figure 9:
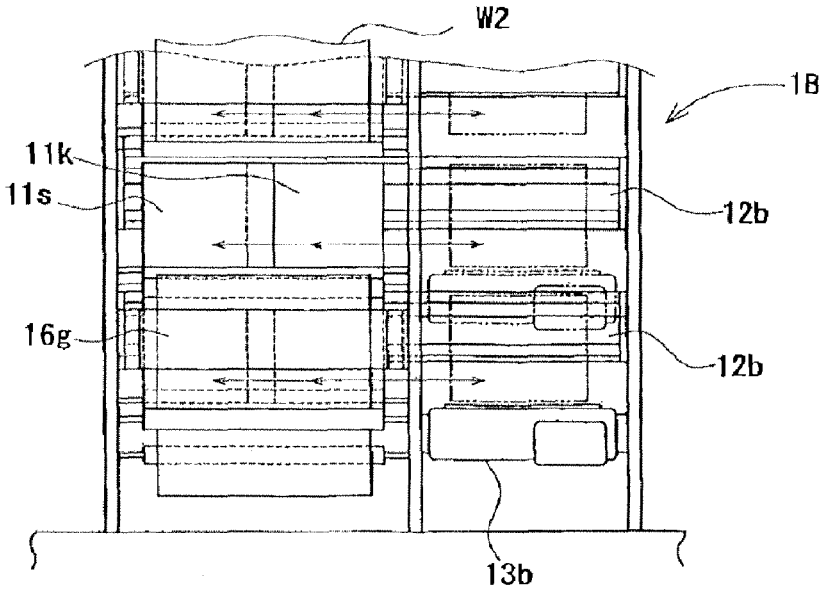
FIG. 9 is a schematic drawing of main parts looking from arrows DD of FIG. 8.

After completion of the newspaper production operations of the newspaper production system SB, the ink jet printing devices 11*i* to 11*x* are moved to a maintenance position shown by the dashed double-dotted line in FIG. 8 and FIG. 9 by a lateral movement unit 12*b*, and are put on standby below the maintenance position, that is, at a standby position that is lower down than the discharge ports of the ink jet print heads of the ink jet printing devices 11*o*, 11*p* and 11*w*, 11*x*, and maintenance such as cleaning of the ink jet print heads so that problems do not arise at the time of the next newspaper production operation are carried out using a maintenance unit 13*b* provided capable of moving up and down along a frame.

In the newspaper production system SA, it is also possible to provide the cutting unit 3*f* instead of the cutting and folding unit 3*a*. It is also possible, in the newspaper production system SB, to provide the cutting and folding unit 3*a* instead of the cutting unit 3*f*. However, in the structure of the newspaper production system SB, when the divided continuous web course changing unit 3*c* is the overlapping unit 3*d*, since the lightly stacked cut sheets Sn are processed, operating the pre-folding mechanism 6 may become less frequent.

INDUSTRIAL APPLICABILITY

This invention can be used in newspaper production, and in particular can be used in newspaper production that does not use plates.

The invention claimed is:

1. A newspaper production system for producing newspapers by ink jet printing of each page of a newspaper on one surface and an other surface of a continuous web, and cutting and folding the continuous web, comprising:

an ink jet printing unit configured to print on the one surface and the other surface of the continuous web and to dry the one surface and the other surface of the continuous web, the ink jet printing unit comprising a plurality of ink jet printing devices provided at a plurality of levels in a vertical direction and a plurality of drying units provided at a plurality of levels in a vertical direction, each ink jet printing device comprising an ink jet printing head;

a continuous web supply unit provided at an upstream side of the ink jet printing unit, the continuous web supply unit configured to supply the continuous web from a continuous web roll to the ink jet printing unit;

at least one processing unit provided at a downstream side of the ink jet printing unit comprising a cutting mechanism and a folding mechanism, the at least one processing unit configured to cut the continuous web that has been printed by the ink jet printing unit to a predetermined rectangular size and to fold a rectangular cut sheet; and a control member configured to cause the continuous web to travel from the continuous web supply unit, via the ink jet printing unit, to the processing unit, and to correlate printing of each page of the newspaper by the ink jet printing unit, in accordance with a travel speed of the continuous web, and the cutting and folding by the processing unit, wherein the control member causes the ink jet printing unit to align printing positions of each page of the newspaper on the one surface and the other surface of the continuous web such that a height direction of the newspaper is placed parallel to a cross direction of the continuous web, and while considering a predetermined number of pages constituting one part of the newspaper as one set, to arrange the pages of the newspaper next to each other in a running direction of the continuous web to repetitively print for every set, and wherein the control member causes the processing unit to:

cut the continuous web that has been printed by the ink jet printing unit to form the rectangular cut sheet having a size of a natural number of pages, printed side by side, in which a same number of pages, being the natural number, are printed on a one surface and an other surface of the rectangular cut sheet and a length of one set of two parallel sides is equal to a height direction length of the newspaper, then to fold a plurality of rectangular cut sheets having a size of three or more pages of the newspaper printed side by side, to a size that is, at largest, that of two pages of the newspaper printed side by side, then to stack each of the rectangular cut sheets in a number constituting one part of the newspaper to thereby form a bundle of rectangular cut sheets for each part of the newspaper, and to fold the bundle of rectangular cut sheets for each part of the newspaper to thereby form a signature newspaper.

2. The newspaper production system of claim 1, wherein the control member causes the processing unit to cut the continuous web that has been printed by the ink jet printing unit to form a rectangular cut sheet having a size of two pages of the newspaper printed side by side, in which two pages of the newspaper are printed side by side on the one surface and the other surface of the rectangular cut sheet and the length of one set of two parallel sides is equal to the height direction length of the newspaper, to stack the rectangular cut sheets having the size of two pages of the newspaper printed side by side in a number constituting one part of the newspaper to thereby form the bundle of rectangular cut sheets for each part of the newspaper, and to fold the bundle of rectangular cut sheets for each part of the newspaper to thereby form the signature newspaper.

3. The newspaper production system of claim 1, wherein the control member causes the processing unit to cut the continuous web that has been printed by the ink jet printing unit to form a rectangular cut sheet having a size of two pages of the newspaper printed side by side, in which two pages of the newspaper are printed side by side on the one surface and the other surface of the rectangular cut sheet and the length of one set of two parallel sides is equal to the height direction length of the newspaper, to form rectangular cut sheets having a size of one printed page of the newspaper for every formation of a predetermined number of rectangular cut sheets having a size of two pages of the newspaper printed, in which one page of the newspaper is printed on the one surface and the other surface of the rectangular cut sheet and the length of one set of two parallel sides is equal to the height direction length of the newspaper, to stack the rectangular cut sheets having the size of two pages of the newspaper printed side by side and the rectangular cut sheets having the size of one printed page of the newspaper in a number constituting one part of the newspaper such that the rectangular cut sheets having the size of one printed page of the newspaper overlap on one of the pages printed on the rectangular cut sheets having the size of two pages of the newspaper printed side by side to thereby form the bundle of cut sheets for each part of the newspaper, and to fold the bundle of rectangular cut sheets for each part of the newspaper to thereby form the signature newspaper.

4. The newspaper production system of claim 1, wherein the control member causes the processing unit to cut the continuous web that has been printed by the ink jet printing unit to form a rectangular cut sheet having a size of two pages of the newspaper printed side by side, in which two pages of the newspaper are printed side by side on the one surface and the other surface of the rectangular cut sheet and the length of one set of two parallel sides is equal to the height direction length of the newspaper, to form, for every formation of a predetermined number of rectangular cut sheets having the size of two pages of the newspaper printed side by side, rectangular cut sheets having a size of three pages of the newspaper printed side by side, in which three pages of the newspaper are printed side by side on the one surface and the other surface of the rectangular cut sheet and the length of one set of two parallel sides is equal to the height direction length of the newspaper, or rectangular cut sheets having a size of four pages of a newspaper printed side by side, in which four pages of the newspaper are printed side by side on the one surface and the other surface of the rectangular cut sheet and the length of one set of two parallel sides is equal to the height direction length of the newspaper, to make the rectangular cut sheets having the size of three pages of the newspaper printed side by side be a same size as that of the rectangular cut sheet having the size of two pages of the newspaper printed side by side by folding either side page thereof to overlap on middle pages thereof, to make the rectangular cut sheets having the size of four pages of the newspaper printed side by side to a same size as that of the rectangular cut sheets having the size of two pages of the newspaper printed side by side by folding respective side pages thereof to overlap on respective adjacent pages thereof, to stack, in a number constituting one part of the newspaper, the rectangular cut sheets having the size of two pages of the newspaper printed side by side, the rectangular cut sheets having the size of three pages of a newspaper printed side by side and folded to the same size as that of the rectangular cut sheets having the size of two pages of the newspaper printed side by side, and the rectangular cut sheets having the size of four pages of a newspaper printed side by side and folded to the same size as that of the rectangular cut sheets having the size of two pages of the newspaper printed side by side, to thereby form the bundle of cut sheets for each part of the newspaper, and to fold the bundle of cut sheets for each part of the newspaper to thereby form the signature newspaper.

5. The newspaper production system of claim 1, wherein the control member causes the processing unit to cut the continuous web that has been printed by the ink jet printing unit to form a rectangular cut sheet having a size of two pages of the newspaper printed side by side, in which two pages of the newspaper are printed side by side on the one surface and the other surface of the rectangular cut sheet and the length of one set of two parallel sides is equal to the height direction length of the newspaper, to form, for every formation of a predetermined number of cut sheets having the size of two pages of a newspaper printed side by side, rectangular cut sheets having a size of one printed page of the newspaper, in which one page of the newspaper is printed on the one surface and the other surface of the rectangular cut sheet and the length of one set of two parallel sides is equal to the height direction length of the newspaper, rectangular cut sheets having a size of three pages of the newspaper printed side by side, in which three pages of the newspaper are printed side by side on the one surface and the other surface of the rectangular cut sheet and the length of one set of two parallel sides is equal to the height direction length of the newspaper, or rectangular cut sheets having a size of four pages of the newspaper printed side by side, in which four pages of the newspaper are printed side by side on the one surface and the other surface of the rectangular cut sheet and the length of one set of two parallel sides is equal to the height direction length of the newspaper, to make the rectangular cut sheets having the size of three pages of the newspaper printed side by side a same size as that of the rectangular cut sheet having the size of two pages of a newspaper printed side by side by folding either side page thereof to overlap on middle pages thereof, to make the rectangular cut sheets having the size of four pages of the newspaper printed side by side a same size as that of the rectangular cut sheets having the size of two pages of the newspaper printed side by side by folding respective side pages thereof to overlap on respective adjacent pages thereof, to stack, in a number constituting one part of the newspaper, the rectangular cut sheets having the size of two pages of the newspaper printed side by side, the rectangular cut sheets having the size of one page of the newspaper printed side by side, the rectangular cut sheets having the size of three pages of the newspaper printed side by side and folded to a same size as that of the rectangular cut sheets having the size of two pages of the newspaper printed side by side, and the rectangular cut sheets having the size of four pages of the newspaper printed side by side and folded to a same size as that of the size of two pages of the newspaper printed side by side such that the rectangular cut sheets having the size of one printed page of the newspaper overlap on one page printed on the rectangular cut sheets having the size of two pages printed side by side to thereby form the bundle of cut sheets for each part of the newspaper, and to fold the bundle of cut sheets for each part of the newspaper to thereby form the signature newspaper.

6. A production method for newspapers, for producing newspapers using:

an ink jet printing unit configured to print on the one surface and the other surface of the continuous web and to dry the one surface and the other surface of the continuous web, the ink jet printing unit comprising a plurality of ink jet printing devices provided at a plurality of levels in a vertical direction and a plurality of drying units provided at a plurality of levels in a vertical direction, each ink jet printing device comprising an ink jet printing head;

a continuous web supply unit provided at an upstream side of the ink jet printing unit, the continuous web supply unit configured to supply the continuous web from a continuous web roll to the ink jet printing unit;

at least one processing unit provided at a downstream side of the ink jet printing unit comprising a cutting mechanism and a folding mechanism, the at least one processing unit configured to cut the continuous web that has been printed by the ink jet printing unit to a predetermined rectangular size and to fold a rectangular cut sheet; and a control member configured to cause the continuous web to travel from the continuous web supply unit, via the ink jet printing unit, to the processing unit, and to correlate printing of each page of the newspaper by the ink jet printing unit, in accordance with a travel speed of the continuous web, and the cutting and folding by the processing unit, the method comprising:

a newspaper sheet printing step comprising printing on the one surface and the other surface of the continuous web and drying the one surface and the other surface of the continuous web, the printing performed such that printing positions of each page of the newspaper on the one surface and the other surface of the continuous web are aligned such that a height direction of the newspaper is placed parallel to a cross direction of the continuous web, and while considering a predetermined number of pages constituting one part of the newspaper as one set, to arrange the pages of the newspaper next to each other in a running direction of the continuous web to repetitively print for every set a newspaper sheet cutting step comprising cutting the continuous web that has been printed by the ink jet printing unit to form the rectangular cut sheet having a size of a number of pages, being a natural number, printed side by side, in which a same number of pages, being the natural number, are printed on a one surface and an other surface of the rectangular cut sheet and a length of one set of two parallel sides is equal to a height direction length of the newspaper, a first folding step comprising folding a plurality of rectangular cut sheets having a size of three or more pages of the newspaper printed side by side, to a size that is, at largest, that of two pages of the newspaper printed side by side;

a newspaper sheet stacking step comprising stacking each of the rectangular cut sheets in a number constituting one part of the newspaper to thereby form a bundle of rectangular cut sheets for each part of the newspaper; and a second folding step comprising folding the bundle of rectangular cut sheets for each part of the newspaper to thereby form a signature newspaper.

7. The newspaper production method of claim 6, wherein the newspaper sheet cutting step comprises cutting the continuous web that has been printed by the ink jet printing unit to form a rectangular cut sheet having a size of two pages of the newspaper printed side by side, in which two pages of the newspaper are printed side by side on the one surface and the other surface of the rectangular cut sheet and the length of one set of two parallel sides is equal to the height direction length of the newspaper, the newspaper sheet stacking step comprises stacking the rectangular cut sheets having the size of two pages of the newspaper printed side by side in a number constituting one part of the newspaper to thereby form the bundle of rectangular cut sheets for each part of the newspaper, and the second folding step comprises folding the bundle of rectangular cut sheets for each part of the newspaper to thereby form a signature newspaper.

8. The newspaper production method of claim 6, wherein the newspaper sheet cutting step comprises cutting the continuous web that has been printed by the ink jet printing unit to form a rectangular cut sheet having a size of two pages of the newspaper printed side by side, in which two pages of the newspaper are printed side by side on the one surface and the other surface of the rectangular cut sheet and the length of one set of two parallel sides is equal to the height direction length of the newspaper, and forming rectangular cut sheets having a size of one printed page of the newspaper for every formation of a predetermined number of rectangular cut sheets having a size of two pages of the newspaper printed side by side, in which one page of the newspaper is printed on the one surface and the other surface of the rectangular cut sheet and the length of one set of two parallel sides is equal to the height direction length of the newspaper, the newspaper sheet stacking step comprises stacking the rectangular cut sheets having the size of two pages of the newspaper printed side by side and the rectangular cut sheets having the size of one printed page of the newspaper in a number constituting one part of the newspaper such that the rectangular cut sheets having the size of one printed page of a newspaper overlap on one of the pages printed on the rectangular cut sheets having the size of two pages printed side by side to thereby form the bundle of cut sheets for each part of the newspaper, and the second folding step comprises folding the bundle of cut sheets for each part of the newspaper to thereby form the signature newspaper.

9. The newspaper production method of claim 6, wherein the newspaper sheet cutting step comprises cutting the continuous web that has been printed by the ink jet printing unit to form a rectangular cut sheet having a size of two pages of the newspaper printed side by side, in which two pages of the newspaper are printed side by side on the one surface and the other surface of the rectangular cut sheet and the length of one set of two parallel sides is equal to the height direction length of the newspaper, and forming, for every formation of a predetermined number of rectangular cut sheets having the size of two pages of the newspaper printed side by side, rectangular cut sheets having a size of three pages of the newspaper printed side by side, in which three pages of the newspaper are printed side by side on the one surface and the other surface of the rectangular cut sheet and the length of one set of two parallel sides is equal to the height direction length of the newspaper, or rectangular cut sheets having a size of four pages of a newspaper printed side by side, in which four pages of the newspaper are printed side by side on the one surface and the other surface of the rectangular cut sheet and the length of one set of two parallel sides is equal to the height direction length of the newspaper, the first folding step comprises making the rectangular cut sheets having the size of three pages of the newspaper printed side by side be a same size as that of the rectangular cut sheet having the size of two pages of the newspaper printed side by side by folding either side page thereof to overlap on middle pages thereof, so as to make the rectangular cut sheets having the size of four pages of the newspaper printed side by side to a same size as that of the rectangular cut sheets having the size of two pages of the newspaper printed side by side by folding respective side pages thereof to overlap on respective adjacent pages thereof, the newspaper sheet stacking step comprises stacking, in a number constituting one part of the newspaper, the rectangular cut sheets having the size of two pages of the newspaper printed side by side, the rectangular cut sheets having the size of three pages of a newspaper printed side by side and folded to the same size as that of the rectangular cut sheets having the size of two pages of the newspaper printed side by side, and the rectangular cut sheets having the size of four pages of a newspaper printed side by side and folded to the same size as that of the rectangular cut sheets having the size of two pages of the newspaper printed side by side, to thereby form the bundle of cut sheets for each part of the newspaper, and the second folding step comprises folding the bundle of cut sheets for each part of the newspaper to thereby form the signature newspaper.

10. The newspaper production method of claim 6, wherein the newspaper sheet cutting step comprises cutting the continuous web that has been printed by the ink jet printing unit to form a rectangular cut sheet having a size of two pages of the newspaper printed side by side, in which two pages of the newspaper are printed side by side on the one surface and the other surface of the rectangular cut sheet and the length of one set of two parallel sides is equal to the height direction length of the newspaper, and forming, for every formation of a predetermined number of cut sheets having the size of two pages of a newspaper printed side by side, rectangular cut sheets having a size of one printed page of the newspaper, in which one page of the newspaper is printed on the one surface and the other surface of the rectangular cut sheet and the length of one set of two parallel sides is equal to the height direction length of the newspaper, rectangular cut sheets having a size of three pages of the newspaper printed side by side, in which three pages of the newspaper are printed side by side on the one surface and the other surface of the rectangular cut sheet and the length of one set of two parallel sides is equal to the height direction length of the newspaper, or rectangular cut sheets having a size of four pages of the newspaper printed side by side, in which four pages of the newspaper are printed side by side on the one surface and the other surface of the rectangular cut sheet and the length of one set of two parallel sides is equal to the height direction length of the newspaper, the first folding step comprises making the rectangular cut sheets having the size of three pages of the newspaper printed side by side a same size as that of the rectangular cut sheet having the size of two pages of a newspaper printed side by side by folding either side page thereof to overlap on middle pages thereof, and making the rectangular cut sheets having the size of four pages of the newspaper printed side by side a same size as that of the rectangular cut sheets having the size of two pages of the newspaper printed side by side by folding respective side pages thereof to overlap on respective adjacent pages thereof, the newspaper sheet stacking step comprises stacking, in a number constituting one part of the newspaper, the rectangular cut sheets having the size of two pages of the newspaper printed side by side, the rectangular cut sheets having the size of one page of the newspaper printed side by side, the rectangular cut sheets having the size of three pages of the newspaper printed side by side and folded to a same size as that of the rectangular cut sheets having the size of two pages of the newspaper printed side by side, and the rectangular cut sheets having the size of four pages of the newspaper printed side by side and folded to a same size as that of the size of two pages of the newspaper printed side by side such that the rectangular cut sheets having the size of one printed page of the newspaper overlap on one page printed on the rectangular cut sheets having the size of two pages printed side by side to thereby form the bundle of cut sheets for each part of the newspaper, and the second folding step comprises folding the bundle of cut sheets for each part of the newspaper to thereby form the signature newspaper.

11. The newspaper production method of claim 6, wherein the newspaper sheet printing step comprises:

printing on the one surface of the continuous web with at least one ink jet printing device containing a first ink, the one surface of the continuous web facing upwards and the continuous web travelling in a first horizontal travel direction;

changing a travel direction of the continuous web to a downward vertical travel direction;

drying the one surface of the continuous web with a first drying unit while the continuous web travels in the downward vertical travel direction;

changing the travel direction of the continuous web to a second horizontal travel direction such that one surface of the continuous web faces downward;

printing on the other surface of the continuous web with at least an other ink jet printing device containing a second ink, the continuous web travelling in the second horizontal travel direction;

changing the travel direction of the continuous web to the downward vertical travel direction; and drying the other surface of the continuous web with a second drying unit while the continuous web travels in the downward vertical travel direction.

* * * * *